US010310395B2

(12) United States Patent
Nakata et al.

(10) Patent No.: US 10,310,395 B2
(45) Date of Patent: Jun. 4, 2019

(54) ELECTROPHOTOGRAPHIC PHOTOSENSITIVE MEMBER, ELECTROPHOTOGRAPHIC APPARATUS, AND PROCESS CARTRIDGE

(71) Applicant: CANON KABUSHIKI KAISHA, Tokyo (JP)

(72) Inventors: Koichi Nakata, Tokyo (JP); Haruki Mori, Ichikawa (JP); Shinji Takagi, Yokohama (JP); Masaki Nonaka, Toride (JP); Ryoichi Tokimitsu, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/002,421

(22) Filed: Jun. 7, 2018

(65) Prior Publication Data

US 2018/0284629 A1 Oct. 4, 2018

Related U.S. Application Data

(63) Continuation of application No. PCT/JP2016/005044, filed on Dec. 1, 2016.

(30) Foreign Application Priority Data

Dec. 14, 2015 (JP) ..... 2015-243323
Oct. 25, 2016 (JP) ..... 2016-208737

(51) Int. Cl.

| | |
|---|---|
| ***G03G 5/05*** | (2006.01) |
| ***G03G 5/07*** | (2006.01) |
| ***G03G 15/00*** | (2006.01) |
| ***G03G 21/18*** | (2006.01) |
| ***G03G 5/147*** | (2006.01) |
| ***G03G 5/06*** | (2006.01) |

(52) U.S. Cl.

CPC ..... *G03G 5/0589* (2013.01); *G03G 5/0546* (2013.01); *G03G 5/0614* (2013.01); *G03G 5/071* (2013.01); *G03G 5/076* (2013.01); *G03G 5/14734* (2013.01); *G03G 5/14786* (2013.01); *G03G 15/75* (2013.01); *G03G 21/1814* (2013.01)

(58) Field of Classification Search

CPC . G03G 5/0546; G03G 5/0589; G03G 5/14734
USPC ..... 430/58.7
See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |
| 8,343,699 | B2 | 1/2013 | Nagasaka et al. |
| 8,415,078 | B2 | 4/2013 | Tanaka et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,783,209 | B2 | 7/2014 | Kaku et al. |
| 8,795,936 | B2 | 8/2014 | Sekido et al. |
| 9,244,369 | B2 | 1/2016 | Tanaka et al. |
| 9,316,931 | B2 | 4/2016 | Takagi et al. |
| 9,389,523 | B2 | 7/2016 | Nakata et al. |
| 9,594,318 | B2 | 3/2017 | Nakata et al. |
| 9,740,117 | B2 | 8/2017 | Kosaka et al. |
| 9,811,012 | B2 | 11/2017 | Murakami et al. |
| 9,983,490 | B2 | 5/2018 | Shimada et al. |
| 10,042,272 | B2 | 8/2018 | Mori et al. |
| 10,120,331 | B2 | 11/2018 | Nakata et al. |
| 2011/0207041 | A1* | 8/2011 | Miyamoto ..... G03G 5/051 430/56 |
| 2013/0137021 | A1* | 5/2013 | Nagasaka ..... G03G 5/0517 430/56 |
| 2014/0004450 | A1 | 1/2014 | Tokimitsu et al. |
| 2018/0329317 | A1 | 11/2018 | Mori et al. |
| 2018/0335708 | A1 | 11/2018 | Nakata et al. |

FOREIGN PATENT DOCUMENTS

| | | | | |
|---|---|---|---|---|
| JP | H04-315159 | | 11/1992 | |
| JP | H06-048999 | | 2/1994 | |
| JP | 06194852 | A * | 7/1994 | |
| JP | 2000147874 | A * | 5/2000 | ..... G07D 11/0084 |
| JP | 2007-011005 | | 1/2007 | |
| JP | 2007-011006 | | 1/2007 | |
| JP | 2007-272191 | | 10/2007 | |
| JP | 2007-272192 | | 10/2007 | |
| JP | 2007-279678 | | 10/2007 | |
| JP | 2008-070761 | | 3/2008 | |

OTHER PUBLICATIONS

English language machine translation of JP 2015-225132 (Dec. 2015).*
English language machine translation of JP 06-194852 (Jul. 1994).*
English language machine translation of JP 2000-147874 (May 2000).*
U.S. Appl. No. 16/053,905, Ryoichi Tokimitsu, filed Aug. 3, 2018.
U.S. Appl. No. 16/101,575, Koichi Nakata, filed Aug. 13, 2018.
U.S. Appl. No. 16/136,828, Haruki Mori, filed Sep. 20, 2018.

* cited by examiner

*Primary Examiner* — Christopher D Rodee
(74) *Attorney, Agent, or Firm* — Venable LLP

(57) ABSTRACT

Provided are an electrophotographic photosensitive member capable of satisfying abrasion resistance and electrical properties and suppressing image deletion, and an electrophotographic apparatus and a process cartridge having the electrophotographic photosensitive member. A surface layer of the electrophotographic photosensitive member contains a polymer of a hole transport material having a polymerizable functional group, wherein the hole transport material has a specific structure.

17 Claims, 3 Drawing Sheets

ELECTROPHOTOGRAPHIC PHOTOSENSITIVE MEMBER, ELECTROPHOTOGRAPHIC APPARATUS, AND PROCESS CARTRIDGE

CROSS-REFERENCE TO RELATED APPLICATIONS

This application is a Continuation of International Patent Application No. PCT/JP2016/005044, filed Dec. 1, 2016, which claims the benefit of Japanese Patent Application No. 2015-243323, filed Dec. 14, 2015, and Japanese Patent Application No. 2016-208737, filed Oct. 25, 2016, all of which are hereby incorporated by reference herein in their entirety.

BACKGROUND OF THE INVENTION

Field of the Invention

The present invention relates to an electrophotographic photosensitive member, and an electrophotographic apparatus and a process cartridge having the electrophotographic photosensitive member.

Description of the Related Art

Since a surface layer of an electrophotographic photosensitive member is repeatedly subjected to stress by a series of electrophotographic processes such as charging, exposure, development, transfer, and cleaning, abrasion resistance and chemical stability are required.

As a method for improving abrasion resistance, a method in which a curable resin is contained in the surface layer of the electrophotographic photosensitive member can be mentioned. However, when a surface layer having high abrasion resistance is installed, the surface layer is hard to wear, so that it is difficult to refresh a surface of the surface layer, and chemical deterioration is likely to be accumulated on the surface of the surface layer. Chemical deterioration is a phenomenon that a hole transport material (hole transporting compound) present in the surface layer undergoes a chemical change due to the stress caused by the series of electrophotographic processes described above. The chemical change of the hole transport material sometimes causes a phenomenon that an electrophotographic image output under a high temperature and high humidity environment becomes blurred (hereinafter, also referred to as image deletion). Therefore, in order to suppress image deletion, there is a need to suppress the chemical change of the hole transport material.

As a method for improving chemical stability of the hole transport material, there is a technology of allowing an additive to be contained together with the hole transport material in the surface layer. Japanese Patent Application Laid-Open No. 2007-11005 discloses a technology of alleviating the image deletion by adding a specific fluorine atom-containing monomer having a polymerizable functional group to a surface layer. Japanese Patent Application Laid-Open No. 2007-11006 discloses a technology of allowing a surface layer to have a specific fluorine atom-containing hole transport monomer. Japanese Patent Application Laid-Open No. 2007-272191, Japanese Patent Application Laid-Open No. 2007-272192, and Japanese Patent Application Laid-Open No. 2007-279678 disclose technologies of alleviating image deletion by adding a specific amine compound to a surface layer. Japanese Patent Application Laid-Open No. 2008-70761 discloses a technology of alleviating image deletion by adding a specific siloxane compound having a specific polymerizable functional group to a surface layer. Japanese Patent Application Laid-Open No. H4-315159 and Japanese Patent Application Laid-Open No. H6-48999 disclose stilbene derivatives having a specific substituent.

Technologies using compounds of Japanese Patent Application Laid-Open No. 2007-11005 and Japanese Patent Application Laid-Open No. 2007-272191, Japanese Patent Application Laid-Open No. 2007-272192, Japanese Patent Application Laid-Open No. 2007-279678, and Japanese Patent Application Laid-Open No. 2008-70761 are technologies for alleviating exposure of stress described above to a hole transport material, and are not technologies for improving chemical stability of the hole transport material itself. Further, in a technology of Japanese Patent Application Laid-Open No. 2007-11006, an object to allow a surface layer to have low surface energy is disclosed, but Japanese Patent Application Laid-Open No. 2007-11006 does not disclose deterioration nor electrical properties during long-term use under a specific environment. Further, compounds of Japanese Patent Application Laid-Open No. H4-315159 and Japanese Patent Application Laid-Open No. H6-48999 do not have a polymerizable functional group and do not form a crosslinked structure as in the present invention. Therefore, these compounds are not suitable for being applied to a high-durability electrophotographic photosensitive member.

Recently, durability of an electrophotographic photosensitive member has been significantly increased, and there is an increasing demand for alleviating image deletion. In order to alleviate image deletion, there is a need to improve chemical stability of the hole transport material itself in addition to alleviating exposure of stress described above. Further, there is a need to improve potential properties in a case of using a high-durability electrophotographic photosensitive member for a long period of time under a specific low humidity environment.

Therefore, an object of the present invention is to provide an electrophotographic photosensitive member which has high durability, satisfies electrical properties, and in which image deletion is satisfactorily alleviated, and an electrophotographic apparatus and a process cartridge having the electrophotographic photosensitive member.

SUMMARY OF THE INVENTION

The present invention is an electrophotographic photosensitive member including: a support member; and a photosensitive layer on the support member, wherein a surface layer of the electrophotographic photosensitive member contains a polymer of a hole transporting compound represented by the following Formula (1),

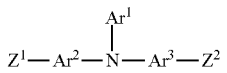

(1)

(where in Formula (1), $Ar^1$ is a substituted or unsubstituted aryl group; $Ar^2$ and $Ar^3$ are each independently a substituted or unsubstituted arylene group; $Ar^1$ to $Ar^3$ do not have a fluorine atom; substituents of the aryl group or arylene groups of $Ar^1$ to $Ar^3$ are groups selected from the group consisting of a (C1-C6) alkyl group, a (C1-C6) alkoxy group, and a monovalent group having a polymerizable functional group, and at least one of the aryl group or arylene groups of $Ar^1$ to $Ar^3$ is substituted with the monovalent group having the polymerizable functional group; $Z^1$ is a monovalent group represented by the following Formula (2) or a monovalent group represented by the following Formula (3); $Z^2$ is a hydrogen atom, a monovalent group represented by the following Formula (2), or a monovalent group represented by the following Formula (3); when $Z^1$ and $Z^2$ are the monovalent groups represented by the following Formula (2), or $Z^1$ and $Z^2$ are the monovalent groups represented by the following Formula (3), structures of $Z^1$ and $Z^2$ are equal to or different from each other),

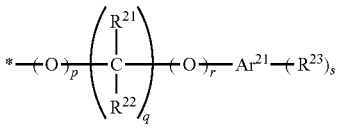

(2)

(in Formula (2), * is a bonding position of the substituent bonded to $Ar^2$ or $Ar^3$ in Formula (1); $R^{21}$ and $R^{22}$ are each independently a hydrogen atom or a (C1-C4) alkyl group; p is 0 or 1; q is an integer of 1 or more and 4 or less; r is 0 or 1; p, q, and r satisfy $2 \leq p+q+r \leq 4$; when q is 2 or more, $(R^{21})$s are groups equal to or different from each other, and $(R^{22})$s are groups equal to or different from each other; $Ar^{21}$ is a (s+1) valent group derived by removing (s+1) hydrogen atoms from substituted or unsubstituted arene; $R^{23}$ is a fluorine atom, a C1 or C2 alkyl group having a fluorine atom as a substituent, or a methoxy group having a fluorine atom as a substituent; s is the number of $(R^{23})$S directly bonded to $Ar^{21}$, and is an integer of 1 or more and 5 or less; when s is 2 or more, $(R^{23})$s are groups equal to or different from each other), and

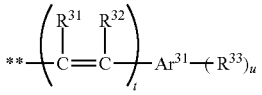

(3)

(in Formula (3), ** is a bonding position of the substituent bonded to $Ar^2$ or $Ar^3$ in Formula (1); $R^{31}$ and $R^{32}$ are each independently a hydrogen atom or a (C1-C4) alkyl group; t is an integer of 1 or more and 3 or less; when t is 2 or more, $(R^{31})$s are groups equal to or different from each other, and $(R^{32})$S are groups equal to or different from each other; $Ar^{31}$ is a (u+1) valent group derived by removing (u+1) hydrogen atoms from substituted or unsubstituted arene; $R^{33}$ is a fluorine atom, a (C1-C4) alkyl group having a fluorine atom as a substituent, or a (C1-C3) alkoxy group having a fluorine atom as a substituent; u is the number of $(R^{33})$s directly bonded to $Ar^{31}$, and is an integer of 1 or more and 5 or less; and when u is 2 or more, $(R^{33})$s are groups equal to or different from each other).

In addition, the present invention provides an electrophotographic apparatus including the electrophotographic photosensitive member described above, and a charging unit, an exposure unit, a developing unit, and a transfer unit.

Further, the present invention provides a process cartridge capable of integrally supporting the electrophotographic photosensitive member and at least one unit selected from the group consisting of a charging unit, a developing unit, a transfer unit, and a cleaning unit and being attachable to and detachable from a main body of an electrophotographic apparatus.

Further features of the present invention will become apparent from the following description of exemplary embodiments with reference to the attached drawings.

DESCRIPTION OF THE EMBODIMENTS

Figure 1:
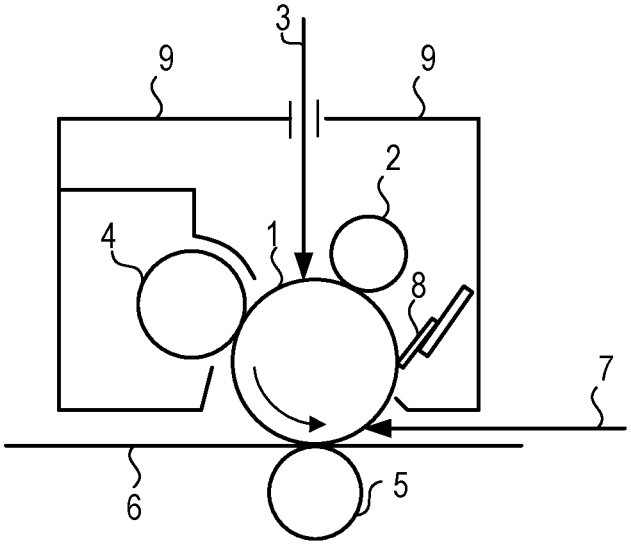
FIG. 1 is a schematic view illustrating an example of a process cartridge having an electrophotographic photosensitive member.

Preferred embodiments of the present invention will now be described in detail in accordance with the accompanying drawings.

The present invention relates to an electrophotographic photosensitive member of which a surface layer contains a polymer of a hole transporting compound having a polymerizable functional group, wherein the hole transporting compound has a specific triarylamine structure and has an aromatic group substituted with a fluorine atom or an alkyl group having a fluorine atom as a substituent or an alkoxy group containing a fluorine atom as a substituent (hereinafter, referred to as a 'fluorine atom-containing substituent'). Hereinafter, the hole transporting compound having the above-mentioned features is referred to as a 'hole transport material of the present invention'.

Generally, as a hole transport material used in an electrophotographic photosensitive member, an arylamine compound having excellent hole transport properties has been widely used.

It is thought that as an electron donating property of the amine structure is enhanced by interactions of an aryl group, or the like, around nitrogen atoms, the hole transport properties of the arylamine compound is exhibited. Meanwhile, it is thought that since in the amine structure of the arylamine compound, charge exchange is actively carried out through a repetitive electrophotographic process, the amine structure of the arylamine compound is in a state in which it is susceptible to chemical reactions. Particularly, it is thought that the amine structure of the arylamine compound tends to be susceptible to a change such as oxidation, or the like, caused by an action of ozone or an oxidative material formed by discharge energy and a discharge phenomenon in a charging process. As a result, it is presumed that a chemical change in the amine structure of the arylamine compound is caused. Further, it is thought that the chemical change of the hole transport material and a high temperature and high humidity environment are combined, such that resistance of the surface of the electrophotographic photosensitive member is lowered, and thus image deletion occurs.

The present inventors searched a hole transport material of which deterioration is suppressed in spite of having an amine structure and which can function with high stability and high durability, thereby completing the present invention.

That is, in order to suppress deterioration caused by the repetitive electrophotographic process, the hole transport material according to the present invention having an aromatic group substituted with a fluorine atom or a fluorine atom-containing substituent in a specific position from a specific triarylamine structure. The hole transport material has the aromatic group substituted with the fluorine atom or the fluorine atom-containing substituent, such that surface energy of the surface layer of the electrophotographic photosensitive member is optimally adjusted, and affinity to a discharge product, and the like, can be decreased. Therefore, deterioration of the hole transport material according to the present invention can be suppressed.

Meanwhile, when the hole transport material according to the present invention excessively has fluorine atoms or fluorine atom-containing substituents, various adverse effects may occur. Particularly, when the electrophotographic photosensitive member is used for a long period of time under a low humidity environment, a risk that potential fluctuation will be deteriorated is increased. For this reason, there is a need to adopt an optimal structure that minimizes the above-mentioned adverse effects due to the presence of the fluorine atom or the fluorine atom-containing substituent.

As a result of studies, the present inventors found that durability and electrical properties of the electrophotographic photosensitive member are satisfied and an effect of suppressing image deletion is exhibited by using the polymer of the hole transport material according to the present invention in the surface layer of the electrophotographic photosensitive member.

The reason may be that since the hole transport material according to the present invention has the fluorine atom or the fluorine atom-containing substituent at a site at which the fluorine atom or the fluorine atom-containing substituent does not have a negative influence on a hole transport function, chemical stability and electrical properties can be simultaneously exhibited as described below.

When the hole transport material according to the present invention is a hole transporting compound represented by Formula (1), having a group represented by Formula (2), the hole transport material has a group derived from arene represented by $Ar^{21}$ separately from the triarylamine structure. $Ar^{21}$ is substituted with a fluorine atom or a fluorine atom-containing substituent represented by $R^{23}$. Here, in order to allow the hole transporting compound represented by Formula (1) to simultaneously have chemical stability and electrical properties, it is essential that $Ar^{21}$ is bonded to $Ar^2$ or $Ar^3$ of the triarylamine structure with a specific interval therebetween and is present in the same molecule. Atomic groups contributing to a bond between the triarylamine structure and $Ar^{21}$ needs to be atomic groups selected from carbon atoms and oxygen atoms, and these atomic groups needs to be bonded to $Ar^{21}$ and $Ar^2$ and/or $Ar^3$ through at least two and at most four saturation bonds. Therefore, in the group represented by Formula (2), p, q, and r need to satisfy $2 \leq p+q+r \leq 4$.

The reason why a specific interval between $Ar^2$ or $Ar^3$ and $Ar^{21}$ is favorable is as follows: the fluorine atom or the fluorine atom-containing substituent has high electronegativity and is thought to exhibit an action that inhibits hole transport properties when the fluorine atom or the fluorine atom-containing substituent excessively approaches the triarylamine structure having the hole transport properties. Further, it is thought that the fluorine atom-containing substituents have a large volume and are repulsive to each other, and when a sum of p, q, and r is 5 or more, the fluorine atom-containing substituents approach as if they turn in a direction toward the triarylamine structure and enter into the triarylamine structure, thereby causing steric hindrance against charge transport to deteriorate electrophotographic properties.

In the hole transport material according to the present invention, positions of the triarylamine structure and $Ar^{21}$ are fixed, respectively, due to an anchor effect of $Ar^{21}$. For this reason, $Ar^{21}$ can be stably present in the surface layer of the electrophotographic photosensitive member in a state in which $Ar^{21}$ maintains a suitable distance from the triarylamine structure.

Further, it is thought that due to the anchor effect as described above, even after film formation of the surface layer of the electrophotographic photosensitive member, thermal movement of the hole transport material according to the present invention is prevented, and deterioration of properties of the electrophotographic photosensitive member with long time elapse hardly occurs.

It is thought that when there is no $Ar^{21}$ and the fluorine atom or the fluorine atom-containing substituent is directly substituted in the triarylamine structure, electrical properties of the electrophotographic photosensitive member are deteriorated due to high electronegativity of the fluorine atom or the fluorine atom-containing substituent.

Further, when there is no $Ar^{21}$ and $Ar^2$ or $Ar^3$ and the fluorine atom-containing substituent are bonded to each other through a long-chain structure of an atomic group selected from carbon atoms and oxygen atoms, the hole transport material according to the present invention does not have the anchor effect derived from $Ar^{21}$. Therefore, it is thought that since the fluorine atom-containing substituent becomes excessively close to the triarylamine structure having the hole transport properties in a shape in which it turns to enter into the triarylamine structure, the electrical properties of the electrophotographic photosensitive member are deteriorated.

Meanwhile, when in the group represented by Formula (2), the sum of p, q, and r is 0 or 1, an influence of the fluorine atom, a fluorinated alkyl group, and the like, on the triarylamine structure is increased, and thus, there is risk that the electrical properties of the electrophotographic photosensitive member will be deteriorated.

For this reason, the present inventors found that in order to minimize the adverse effects of the fluorine atom and the fluorine atom-containing substituent and maximally exhibit effects of the fluorine atom and the fluorine atom-containing substituent, the hole transporting compound represented by Formula (1), which has the triarylamine structure and $Ar^{21}$ substituted with the fluorine atom or the fluorine atom-containing substituent at a predetermined interval, is particularly excellent.

However, in the case in which a substituent represented by $R^{23}$ is the fluorine atom-containing substituent, when the number of carbon atoms constituting the fluorine atom-containing substituent is excessively large, there is a risk that the fluorine atom-containing substituent will have a negative influence on a triphenylamine structure due to a degree of freedom of bonding. Particularly, when the number of carbon atoms constituting the fluorine atom-containing substituent is excessively increased, the tendency to inhibit the electrophotographic characteristics is increased.

For this reason, when the group represented by $R^{23}$ is an alkyl group having a fluorine atom as a substituent, the number of carbon atom thereof is 1 or 2. When the group represented by $R^{23}$ is an alkoxy group having a fluorine atom as a substituent, $R^{23}$ is limited to a methoxy group having a fluorine atom as a substituent. Further, s is the number of $(R^{23})$s directly bonded to $Ar^{21}$, and it is preferable that s is 1 or more and 5 or less. When s is 2 or more, s $(R^{23})$s may be groups that are equal to or different from each other.

When the hole transport material according to the present invention is a hole transporting compound represented by Formula (1), having a group represented by Formula (3), the hole transport material has a group derived from arene represented by $Ar^{31}$ separately from the triarylamine structure. $Ar^{31}$ is substituted with a fluorine atom or a specific fluorine atom-containing substituent represented by $R^{33}$. Here, in order to allow the hole transporting compound represented by Formula (1) to simultaneously have chemical stability and electrical properties, it is essential that $Ar^{31}$ is bonded to $Ar^2$ or $Ar^3$ of the triarylamine structure through a specific linking group and is present in the same molecule. When the linking group linking $Ar^2$ or $Ar^3$ of the triarylamine structure and $Ar^{31}$ to each other is composed of 2, 4, or 6 carbon atoms having an $sp^2$ hybridized orbital (hereinafter, referred to as '$sp^2$ carbon atom(s)') and composed of a double bond site $(—(CR^{31}{=}CR^{32})_t—)$. When the number of $sp^2$ carbon atoms is 4 or 6, that is, when t is 2 or 3, the double bond site is a conjugated double bond.

In Formula (3), t is preferably 2 or less, and more preferably 1. When t is an integer of 4 or more, a molecular weight is increased, which may cause a problem in a film formation property, film strength, or the like.

The linking group between $Ar^2$ or $Ar^3$ and $Ar^{31}$ is composed of only the $sp^2$ carbon atoms, a conjugated system from the triarylamine structure to $Ar^{31}$ is formed. A structure from the triphenylamine structure to $Ar^{31}$ is fixed due to planarity of this conjugated system. It is thought that due to this effect, the triarylamine structure and the fluorine atom-containing substituent are not too close to each other, and the charge transport property of the triarylamine structure is not inhibited.

Since the linking group between $Ar^2$ or $Ar^3$ and $Ar^{31}$ is rigidly fixed, in $R^{33}$, the number of carbon atoms of an alkyl group having a fluorine atom as a substituent can be 1 or more and 4 or less, and the number of carbon atoms of an alkoxy group having a fluorine atom as a substituent can be 1 or more and 3 or less. When the numbers of carbon atoms of the alkyl group having the fluorine atom as the substituent and the alkoxy group having the fluorine atom as the substituent are larger than the above-mentioned numbers of carbon atoms, since these groups turn to enter into the triphenylamine structure to thereby be close thereto, there is a risk that the electrical properties of the electrophotographic photosensitive member will be deteriorated.

As described above, positions of the triarylamine structure and a fluorine atom-containing aromatic structure are fixed, respectively, due to an effect of fixing a structure of a monovalent group represented by Formula (3). For this reason, $Ar^{31}$ can be stably present in the surface layer of the electrophotographic photosensitive member in a state in which $Ar^{31}$ maintains a suitable distance from the triarylamine structure.

Further, it is thought that due to an anchor effect of $Ar^{31}$, even after film formation, thermal movement of the hole transport material according to the present invention is prevented, and deterioration of properties of the electrophotographic photosensitive member with long time elapse hardly occurs.

For this reason, the present inventors found that in order to minimize the adverse effects of the fluorine atom and the fluorine atom-containing substituent and maximally exhibit effects of the fluorine atom and the fluorine atom-containing substituent, the hole transporting compound represented by Formula (1), which has the specific linking group between the triarylamine structure and $Ar^{31}$ while having the triarylamine structure and $Ar^{31}$ substituted with the fluorine atom or the fluorine atom-containing substituent, is particularly excellent.

Further, a structure of a monovalent group represented by Formula (3) is fixed, but when in the fluorine atom and the fluorine atom-containing substituent represented by $R^{33}$, the number of carbon atoms of $R^{33}$ is excessively large, there is a risk that the fluorine atom-containing substituent will have a negative influence on electrophotographic properties of the triphenylamine structure due to a degree of freedom in an angle and a direction of a saturation bond of the carbon atom. Therefore, u is the number of $(R^{33})$s directly bonded to $Ar^{31}$, and it is preferable that u is an integer of 1 or more and 5 or less, preferably 2 or less. When u is 2 or more, $(R^{33})$s may be groups that are equal to or different from each other.

In the hole transporting compound represented by Formula (1) corresponding to the hole transport material according to the present invention, $Ar^1$ is a substituted or unsubstituted aryl group, and examples of thereof can include a phenyl group, a naphthyl group, an anthracenyl group, a phenanthrenyl group, a pyrenyl group, a fluorenyl group, a fluoranthenyl group, a triphenylenyl group, and the like. In order to allow the hole transporting compound represented by Formula (1) not to have a structure with an excessively large volume and a large molecular weight, it is preferable that $Ar^1$ is the phenyl group.

In the hole transporting compound represented by Formula (1), $Ar^2$ and $Ar^3$ are each independently a substituted or unsubstituted arylene group. Examples of the arylene group can include a phenylene group and a naphthylene group, and divalent groups obtained from anthracene, pyrene, fluorene, fluoranthene, triphenylene, and the like. In order to allow the hole transporting compound represented by Formula (1) not to have a structure with an excessively large volume and an excessively large molecular weight, it is preferable that $Ar^2$ and $Ar^3$ are the phenylene group.

In the monovalent group represented by Formula (2), $Ar^{21}$ is a (s+1) valent group derived by removing (s+1) hydrogen atoms from substituted or unsubstituted arene, and in the monovalent group represented by Formula (3), $Ar^{31}$ is a (u+1) valent group derived by removing (u+1) hydrogen atoms from substituted or unsubstituted arene. Examples of arene can include benzene, naphthalene, anthracene, phenanthrene, pyrene, fluorene, fluoranthene, triphenylene, and the like. In order to allow the hole transporting compound represented by Formula (1) not to have a structure with an excessively large volume and an excessively large molecular weight, it is preferable that $Ar^{21}$ and $Ar^{31}$ are groups derived from benzene.

Examples of substituents of $Ar^1$ to $Ar^3$, $Ar^{21}$, and $Ar^{31}$ can include a group selected from alkyl groups and alkoxy groups.

In the monovalent group represented by Formula (2), $R^{21}$ and $R^{22}$ are each independently a hydrogen atom or a (C1-C4) alkyl group. Examples of the alkyl group can include a methyl group, an ethyl group, an n-propyl group, an iso-propyl group, an n-butyl group, an iso-butyl group, a sec-butyl group, a tert-butyl group, and the like. $R^{21}$ and $R^{22}$ may be equal to or different from each other.

$R^{23}$ is a fluorine atom, a C1 or C2 alkyl group having a fluorine atom as a substituent, or a methoxy group having a fluorine atom as a substituent. Examples of the C1 or C2 alkyl group having the fluorine atom as the substituent can include a monofluoromethyl group, a difluoromethyl group, a trifluoromethyl group, a 1,1-difluoroethyl group, a 2,2,2-trifluoroethyl group, 1,2,2-trifluoroethyl group, 1,1,2,2-tetrafluoroethyl group, 1,1,2,2,2-pentafluoroethyl group, and the like. Among them, the trifluoromethyl group and 1,1,2,2,2-pentafluoroethyl group are preferable. Examples of the methoxy group having the fluorine atom as the substituent can include a monofluoromethoxy group, a difluoromethoxy group, and a trifluoromethoxy group. Among them, the trifluoromethoxy group is preferable.

In Formula (3), $R^{31}$ and $R^{32}$ are each independently a hydrogen atom or a (C1-C4) alkyl group. Examples of the alkyl group can include a methyl group, an ethyl group, an n-propyl group, an iso-propyl group, an n-butyl group, an iso-butyl group, a sec-butyl group, a tert-butyl group, and the like. $R^{31}$ and $R^{32}$ may be equal to or different from each other.

$R^{33}$ is a fluorine atom, a (C1-C4) alkyl group having a fluorine atom as a substituent, or a (C1-C3) alkoxy group having a fluorine atom as a substituent. Examples of the (C1-C4) alkyl group having the fluorine atom as the substituent can include a monofluoromethyl group, a difluoromethyl group, a trifluoromethyl group, a 1,1-difluoroethyl group, a 2,2,2-trifluoroethyl group, a 1,2,2-trifluoroethyl group, a 1,1,2,2-tetrafluoroethyl group, a 1,1,2,2,2-pentafluoroethyl group, a 1,1-difluoropropyl group, a 3,3,3-trifluoropropyl group, a 2,2,3,3,3-pentafluoropropyl group, a 1,1,2,2,3,3,3-heptafluoropropyl group, a 4,4,4-trifluorobutyl group, a 3,3,4,4,4-pentafluorobutyl group, a 1,1,2,2,3,3,4,4,4-nonafluorobutyl group, and the like. Among them, the trifluoromethyl group, the 1,1,2,2,2-pentafluoroethyl group, the 1,1,2,2,3,3,3-heptafluoropropyl group, and the 1,1,2,2,3,3,4,4,4-nonafluorobutyl group are preferable. Examples of the (C1-C3) alkoxy group having the fluorine atom as the substituent can include a monofluoromethoxy group, a difluoromethoxy group, a trifluoromethoxy group, a 1,1-difluoroethoxy group, a 2,2,2-trifluoroethoxy group, a 1,2,2-trifluoroethoxy group, a 1,1,2,2-tetrafluoroethoxy group, a 1,1,2,2,2-pentafluoroethoxy group, a 1,1-difluoropropoxy group, a 3,3,3-trifluoropropoxy group, a 2,2,3,3,3-pentafluoropropoxy group, a 1,1,2,2,3,3,3-heptafluoropropoxy group, and the like. Among them, the trifluoromethoxy group, the 1,1,2,2,2-pentafluoroethoxy group, and 1,1,2,2,3,3,3-heptafluoropropoxy group are preferable.

In the compound represented by Formula (1), $Z^1$ is a monovalent group represented by Formula (2) or a monovalent group represented by Formula (3). Further, in the hole transporting compound represented by Formula (1), $Z^2$ is a hydrogen atom, a monovalent group represented by Formula (2), or a monovalent group represented by Formula (3). When the hole transporting compound represented by Formula (1) has an excessively large molecular weight due to excessively high symmetry, a risk that a film formation property, a curing property, electrical properties, and the like, will be deteriorated is increased. For this reason, it is preferable that in the hole transporting compound represented by Formula (1), $Z^1$ is the monovalent group represented by Formula (2) or the monovalent group represented by Formula (3), and at the same time, $Z^2$ is the hydrogen atom.

In the monovalent group represented by Formula (3), the double bond site corresponding to the linking group may be either a cis form or a trans form. Alternatively, a double bond of a cis form and a trans form may also exist.

Specific examples of the substituents of $Ar^1$ to $Ar^3$ can include the following alkyl groups and alkoxy groups.

Examples of the alkyl group can include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexylmethyl group, a 4-tert-butylcyclohexyl group, an n-heptyl group, a cycloheptyl group, and the like.

Examples of the alkoxy group can include a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, and the like.

The hole transporting compound represented by Formula (1) has a polymerizable functional group. The polymerizable functional group means a functional group capable of bonding molecules to each other through a covalent bond when polymerizable functional groups cause a polymerization reaction therebetween. Examples of the polymerizable functional group of the hole transporting compound represented by Formula (1) can include the following polymerizable functional groups. The polymerizable functional group does not have a fluorine atom.

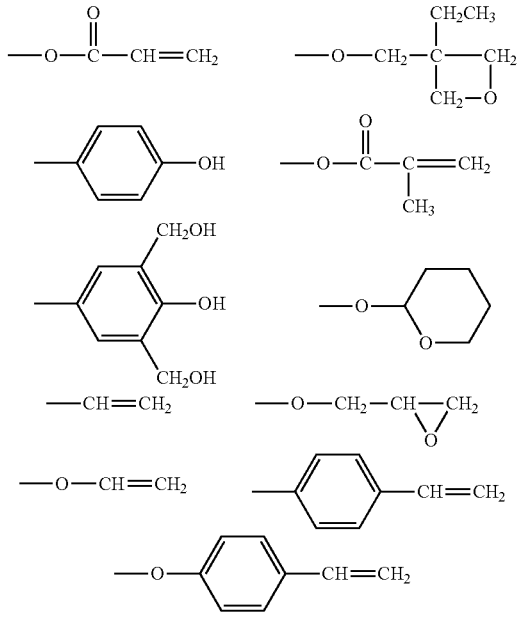

In view of abrasion resistance of the surface layer and a polymerization reaction rate during polymerization after film formation, it is preferable that the polymerizable functional group is a functional group having chain polymerizability. Particularly, an acryloyloxy group and a methacryloyloxy group are preferable.

In the hole transporting compound represented by Formula (1), at least one of $Ar^1$ to $Ar^3$ has the polymerizable functional group. The polymerizable functional group may be directly bonded to $Ar^1$ to $Ar^3$, but it is preferable that the hole transporting compound has a divalent group between the polymerizable functional group and $Ar^1$ to $Ar^3$ in order to improve polymerization properties and a melting point of the hole transporting compound represented by Formula (1), flowability at the time of film formation and curing, physical properties of the polymer, and the like. Examples of the divalent group can include a linear or branched alkylene group or an oxyalkylene group.

As described above, a substituent containing a polymerizable functional group to be introduced is preferably a monovalent group represented by the following Formula (4).

(4)

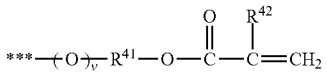

(In Formula, *** is a bonding position of the substituent bonded to $Ar^1$ to $Ar^3$. $R^{41}$ is a single bond or a (C1-C6) alkylene group. $R^{42}$ is a hydrogen atom or a methyl group. v is 0 or 1. However, when v is 1, $R^{41}$ is not a single bond.)

Examples of the alkylene group represented by $R^{41}$ can include a methylene group, an ethylene group, an n-propylene group, an iso-propylene group, an n-butylene group, an iso-butylene group, a sec-butylene group, a tert-butylene group, an n-pentylene group, a 1-methyl-n-butylene group, a 2-methyl-n-butylene group, a 3-methyl-n-butylene group, a 1,1-dimethyl-n-propylene group, a 1,2-dimethyl-n-propylene group, a 2,2-dimethyl-n-propylene group, and the like. The monovalent group represented by Formula (4) does not have a fluorine atom.

In the case of forming the surface layer of the electrophotographic photosensitive member by polymerizing the hole transporting compound represented by Formula (1), one kind or two or more kinds of hole transporting compounds represented by Formula (1) can be used. As a unit for polymerizing the hole transporting compound represented by Formula (1), a unit for imparting energy such as ultraviolet ray, electron beam, heat, or the like, or an auxiliary agent such as a polymerization initiator, or a unit for allowing compounds such as an acid, an alkali, a complex, or the like, to coexist can be used.

Examples of a compound of the hole transport material according to the present invention are as follows. However, the present invention is not limited thereto. In the following exemplified compounds, the polymerizable functional group corresponding to the monovalent group represented by Formula (4) may be replaced with any of the above-mentioned polymerizable functional groups. Similarly, substituents may also be substituted with the above-mentioned substituents.

Exemplified Compound No. 1

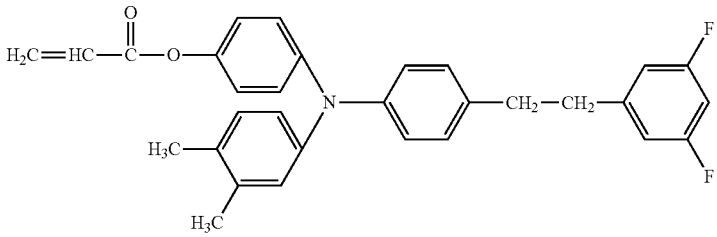

Exemplified Compound No. 2

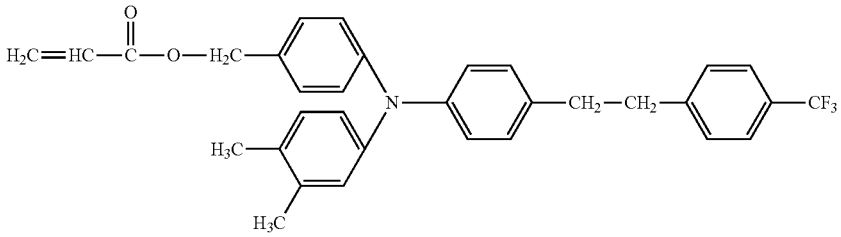

Exemplified Compound No. 3

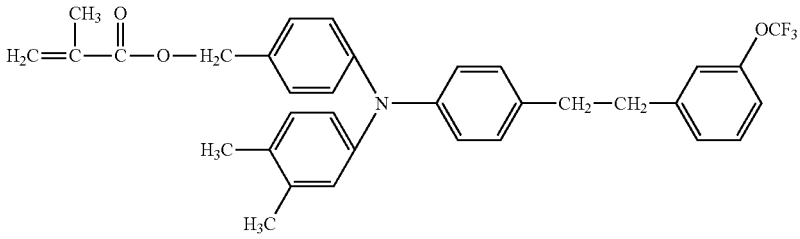

Exemplified Compound No. 4

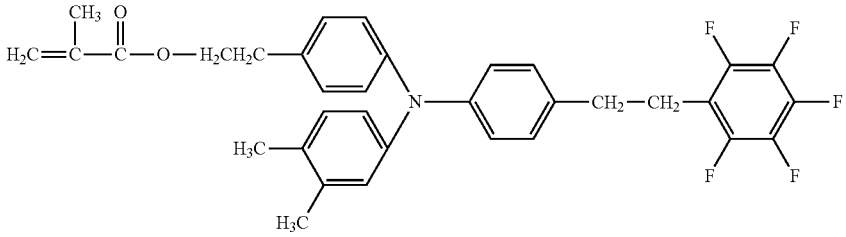

-continued
Exemplified Compound No. 5
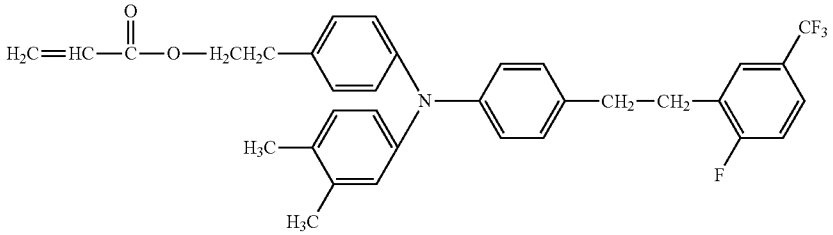
Exemplified Compound No. 6
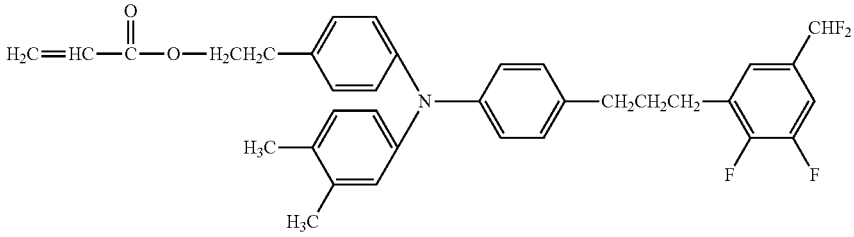
Exemplified Compound No. 7
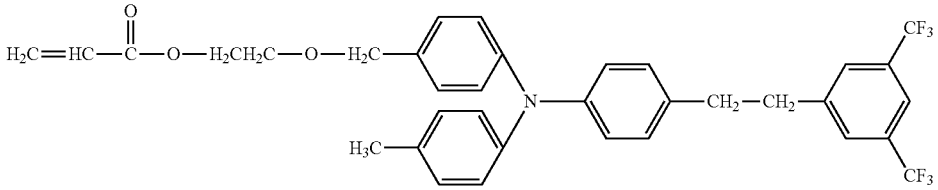
Exemplified Compound No. 8
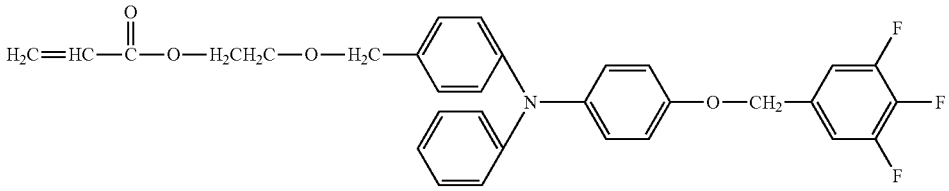
Exemplified Copound No. 9
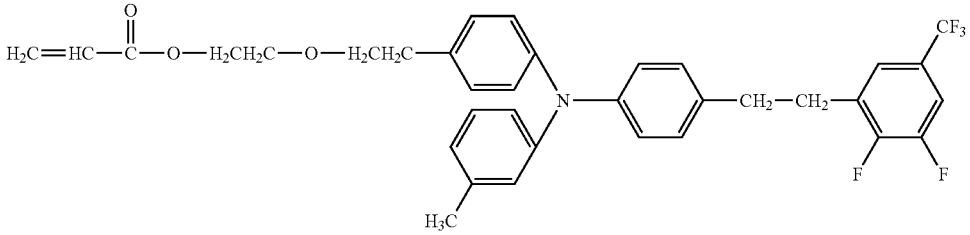
Exemplified Compound No. 10
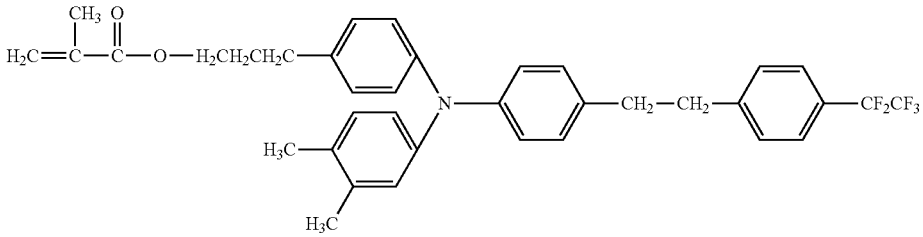
Exemplified Compound No. 11
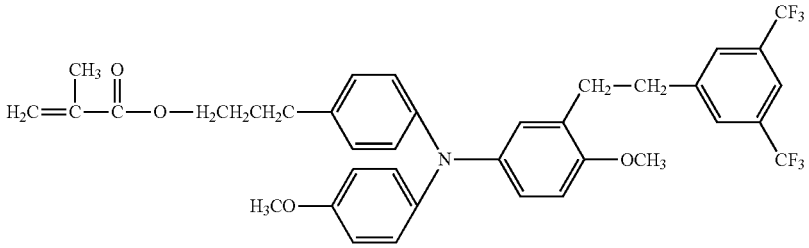

-continued
Exemplified Compound No. 12
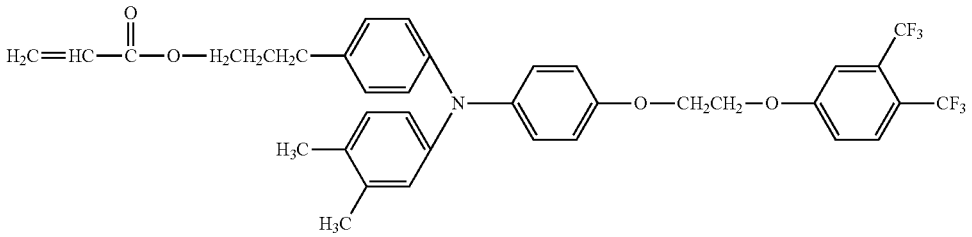
Exemplified Compound No. 13
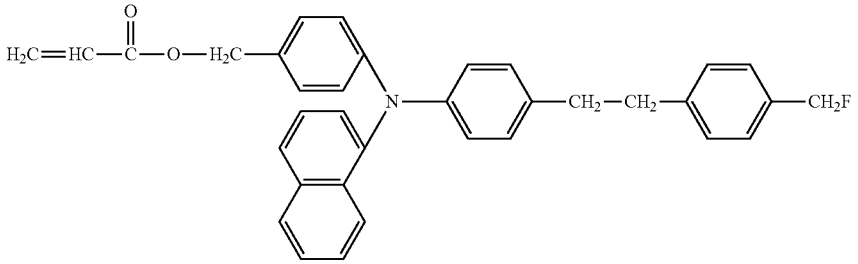
Exemplified Compound No. 14
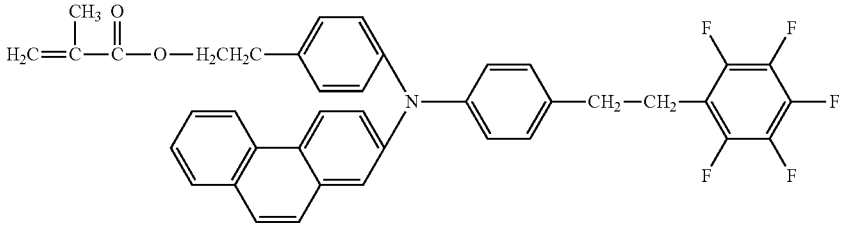
Exemplified Compound No. 15
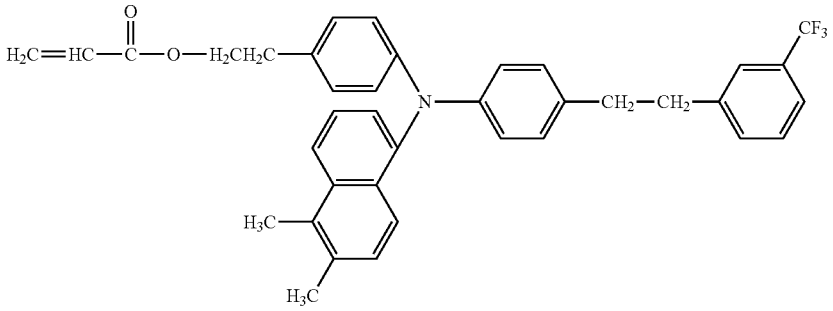
Exemplified Compound No. 16
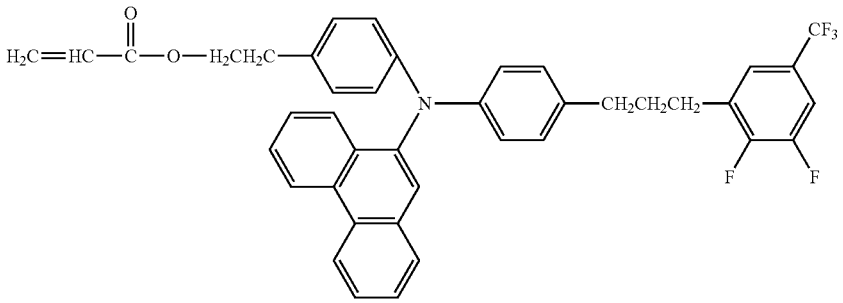

-continued
Exemplified Compound No. 17
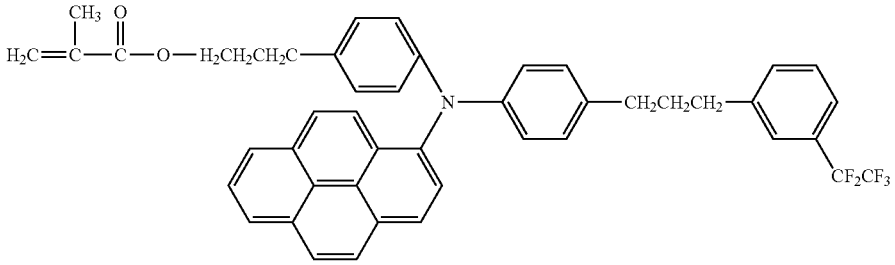
Exemplified Compound No. 18
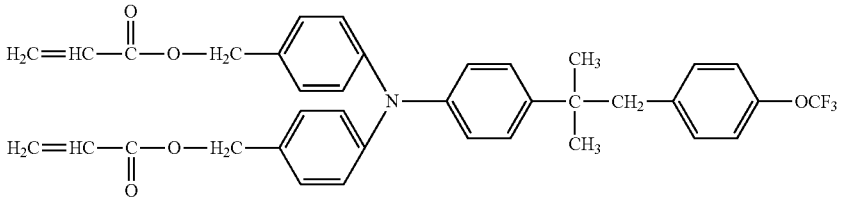
Exemplified Compound 19
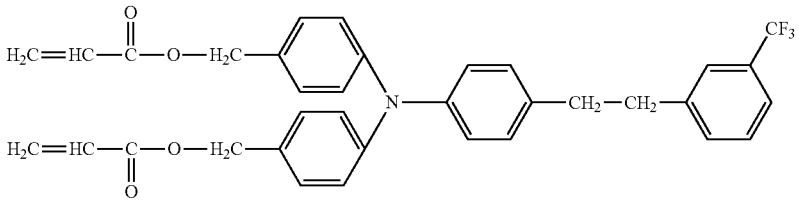
Exemplified Compound 20
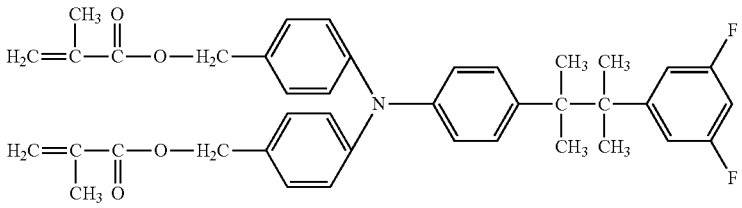
Exemplified Compound No. 21
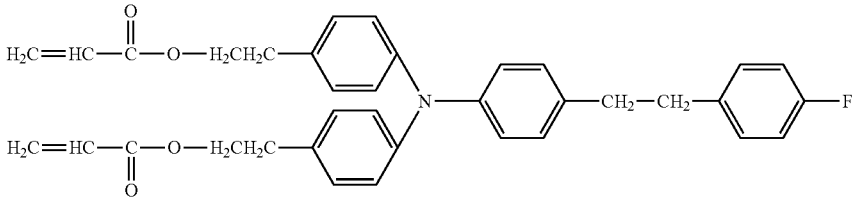
Exemplified Compound No. 22
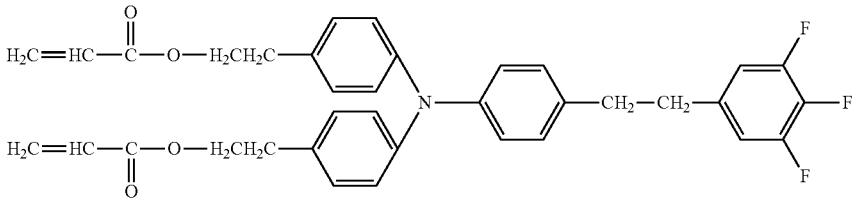
Exemplified Compound No. 23
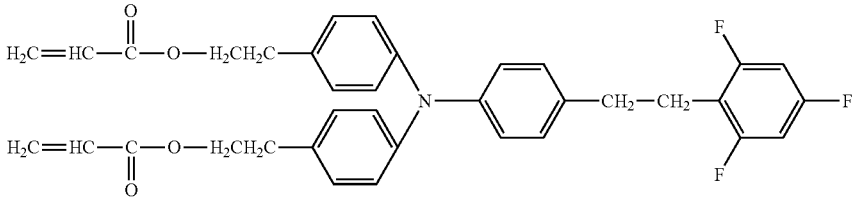

-continued
Exemplified Compound No. 24
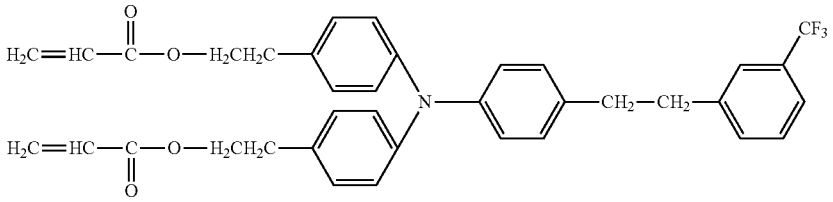
Exemplified Compound No. 25
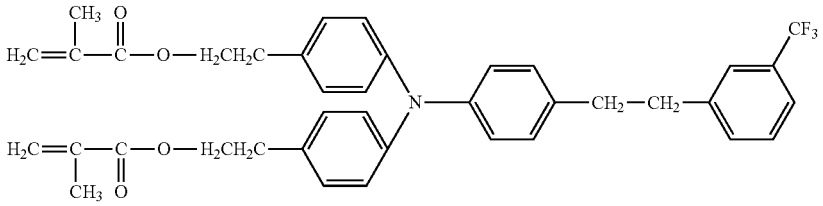
Exemplified Compound No. 26
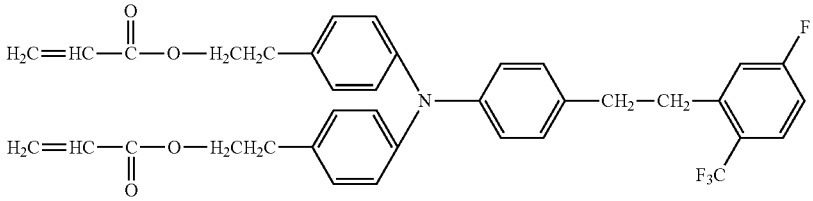
Exemplified Compound No. 27
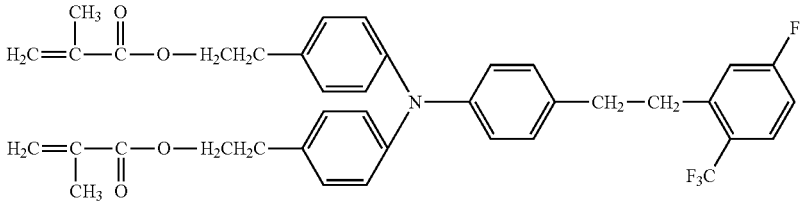
Exemplified Compound No. 28
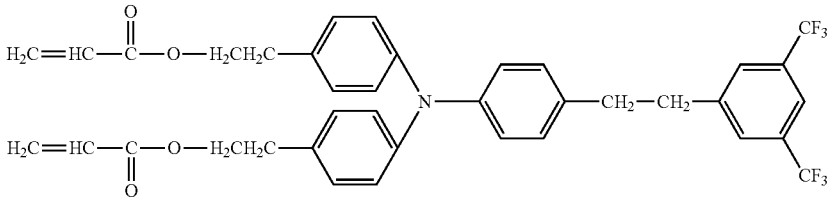
Exemplified Compound No. 29
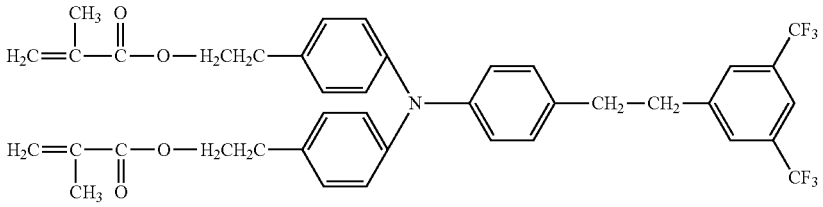
Exemplified Compound No. 30
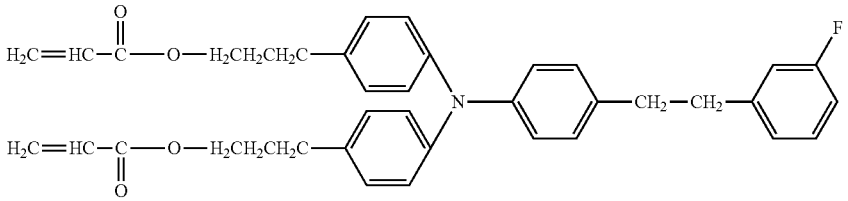

-continued
Exemplified Compound No. 31
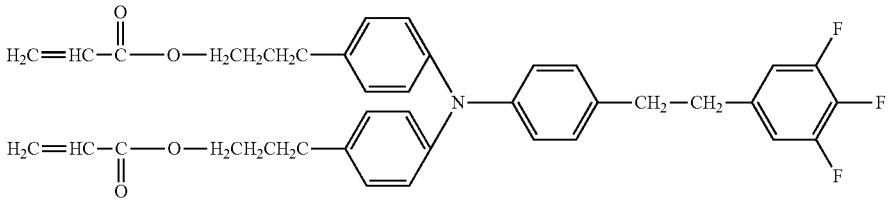
Exemplified Compound No. 32
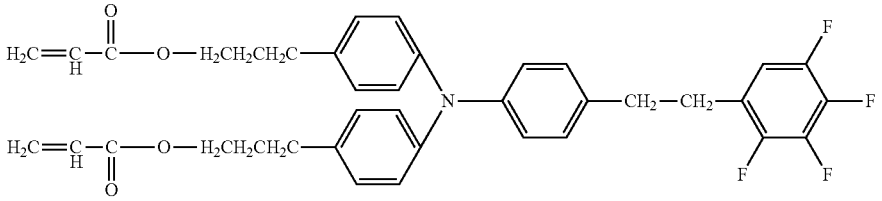
Exemplified Compound No. 33
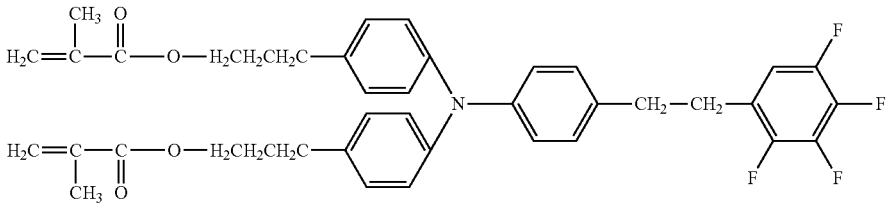
Exemplified Compound No. 34
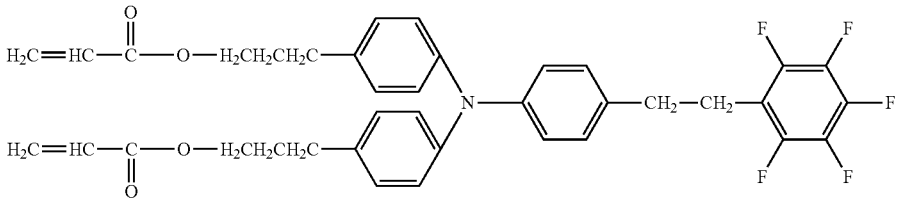
Exemplified Compound No. 35
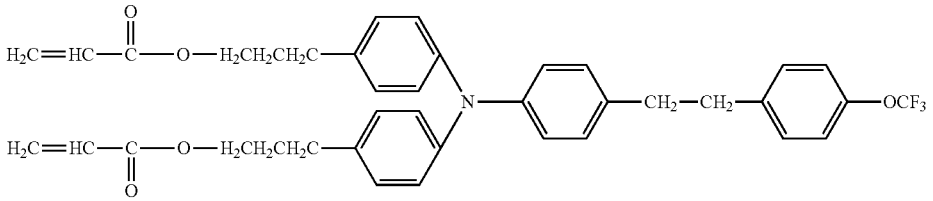
Exemplified Compound No. 36
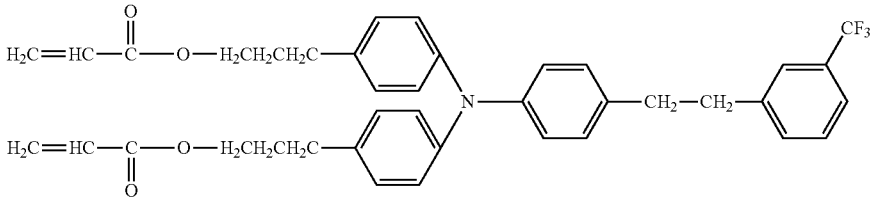
Exemplified Compound No 37
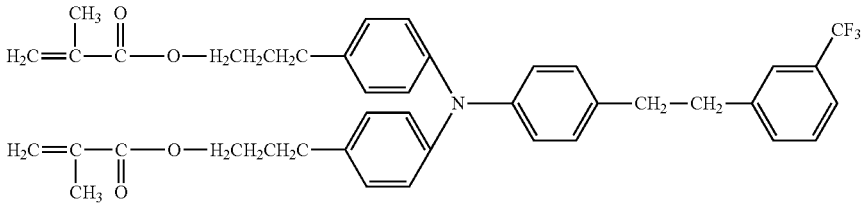

-continued
Exemplified Compound No. 38
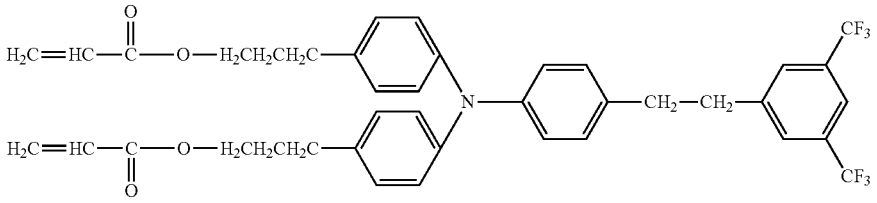
Exemplified Compound No 39
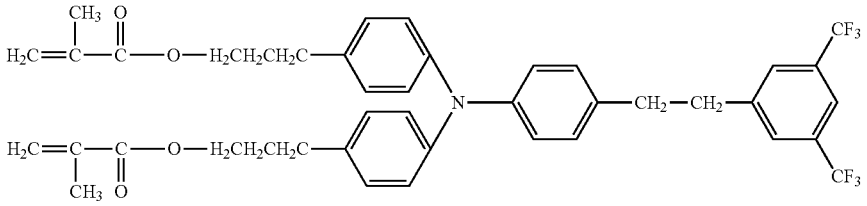
Exemplified Compound No. 40
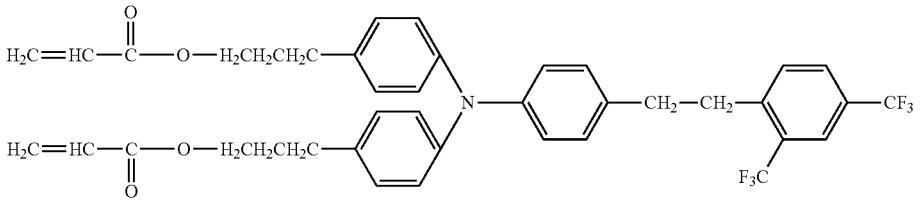
Exemplified Compound No. 41
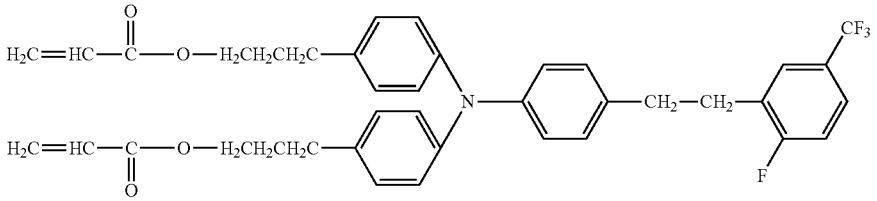
Exemplified Compound No. 42
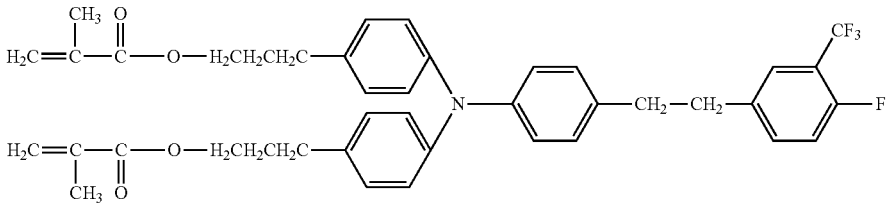
Exemplified Compound No. 43
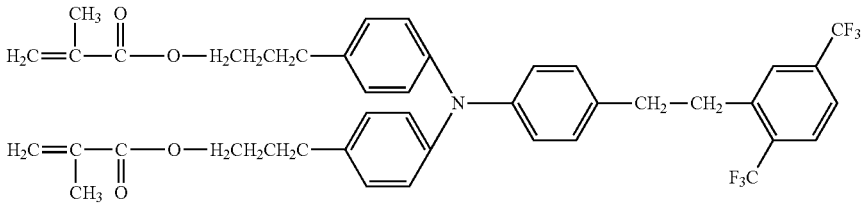
Exemplified Compound No. 44
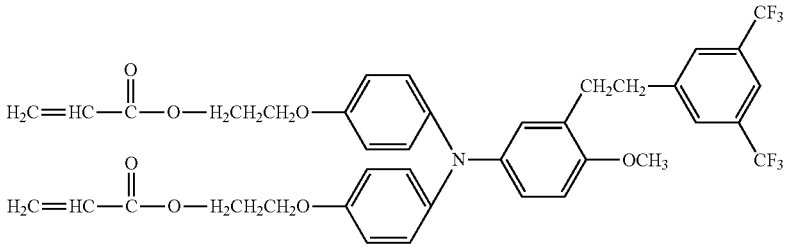

-continued
Exemplified Compound No. 45
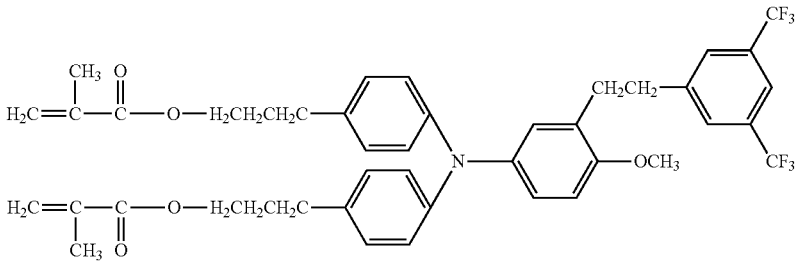
Exemplified Compound No. 46
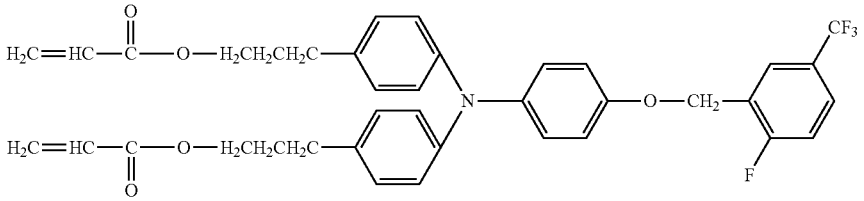
Exemplified Compound No 47
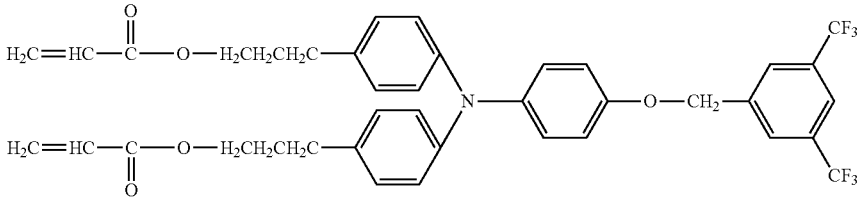
Exemplified Compound No. 48
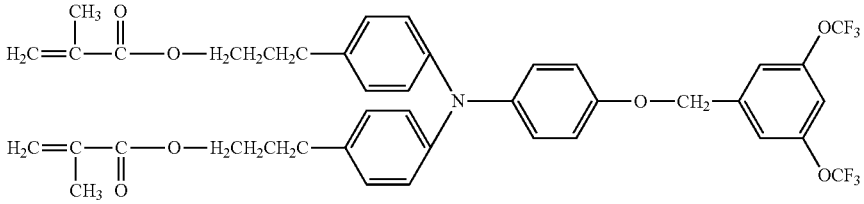
Exemplified Compound No. 49
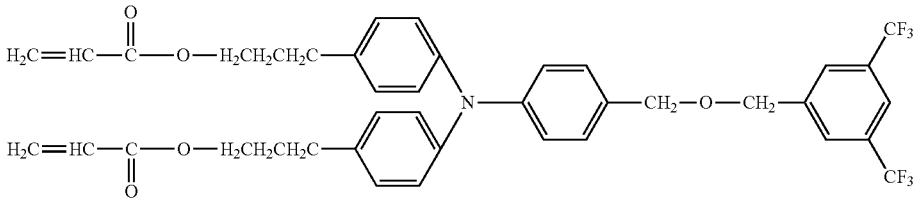
Exemplified Compound No. 50
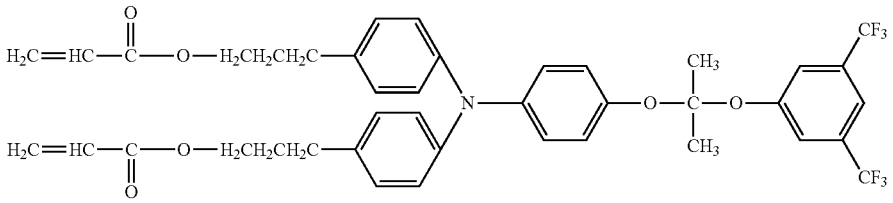
Exemplified Compound No. 51
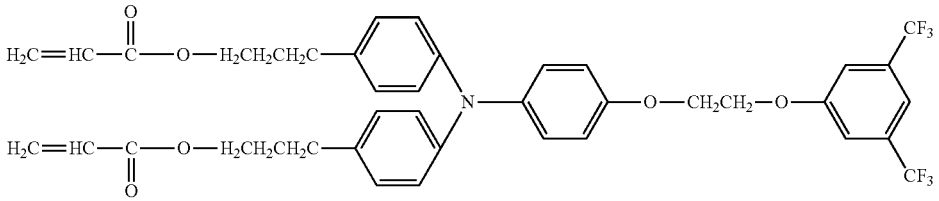

-continued
Exemplified Compound No. 52
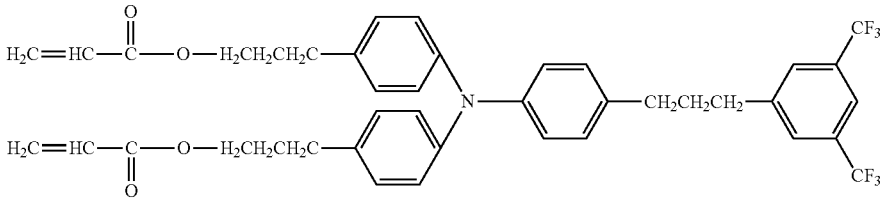
Exemplified Compound No. 53
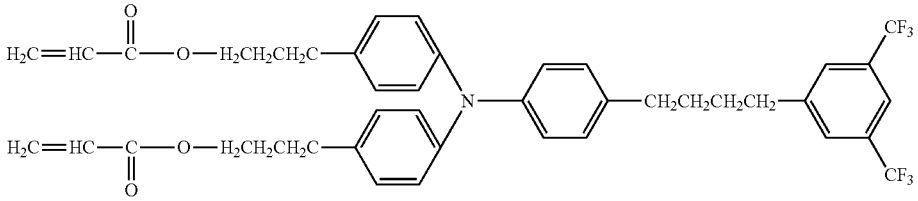
Exemplified Compound No. 54
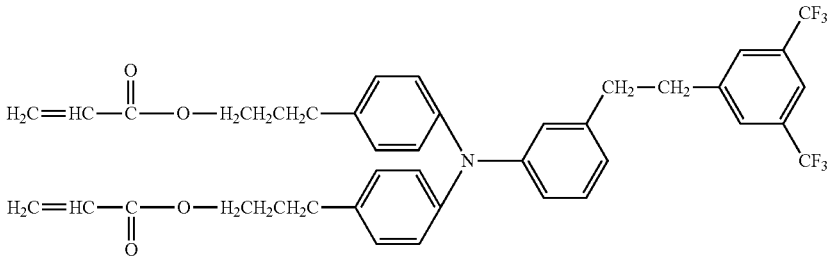
Exemplified Compound No. 55
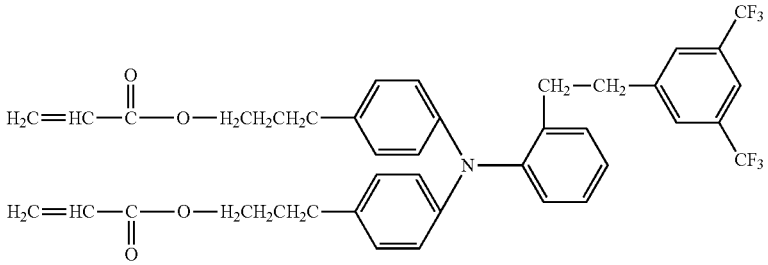
Exemplified Compound No. 56
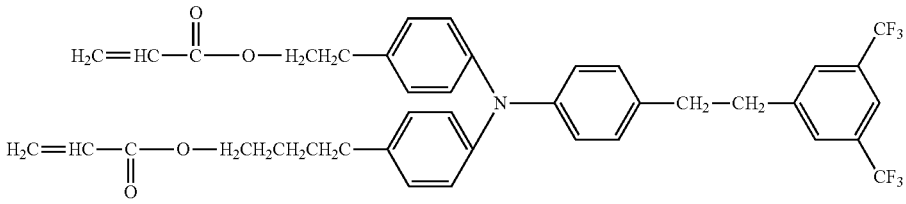
Exemplified Compound No. 57
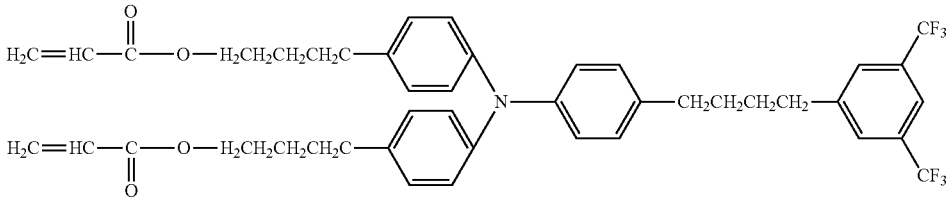
Exemplified Compound No. 58
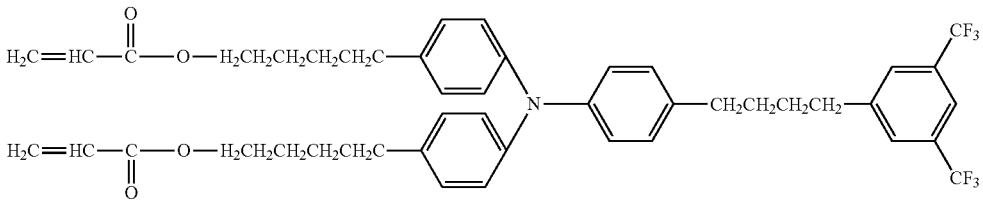

-continued
Exemplified Compound No. 59
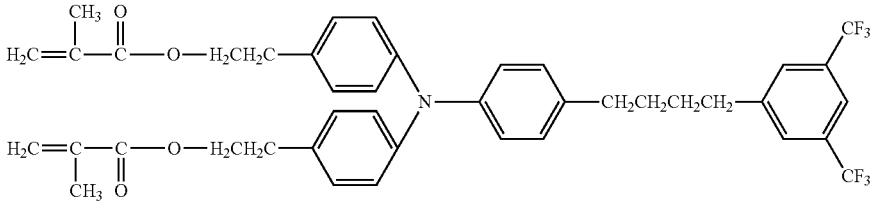
Exemplified Compound No. 60
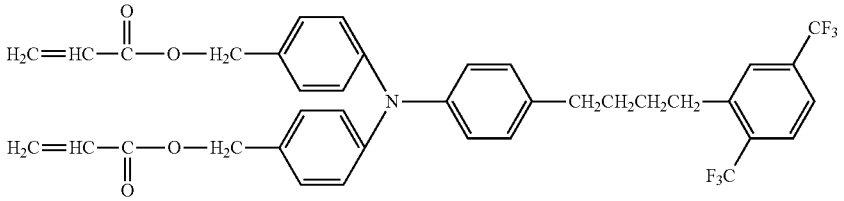
Exemplified Compound No. 61
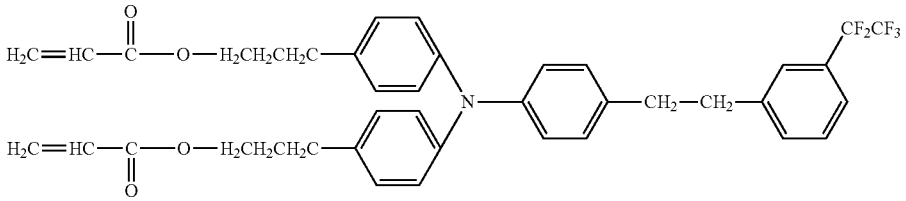
Exemplified Compound No 62
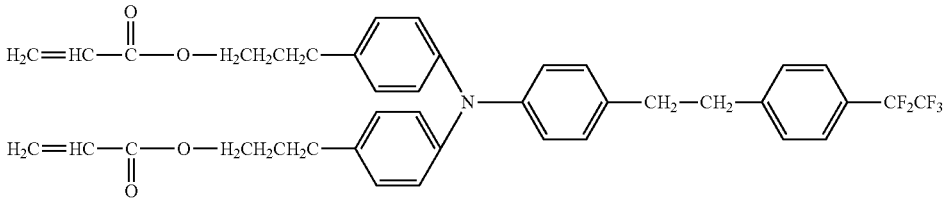
Exemplified Compound No. 63
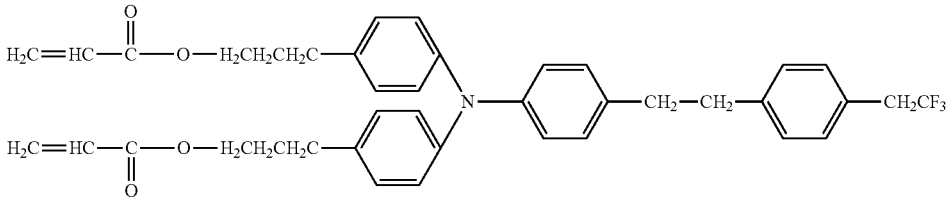
Exemplified Compound No. 64
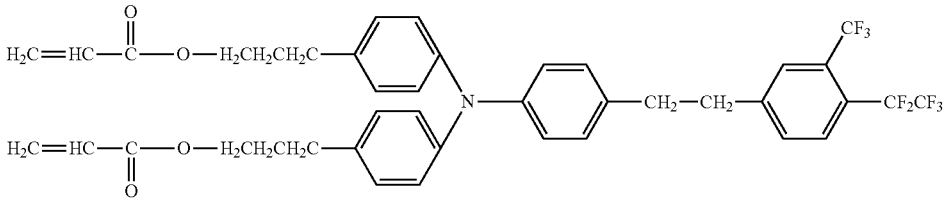
Exemplified Compound No. 65
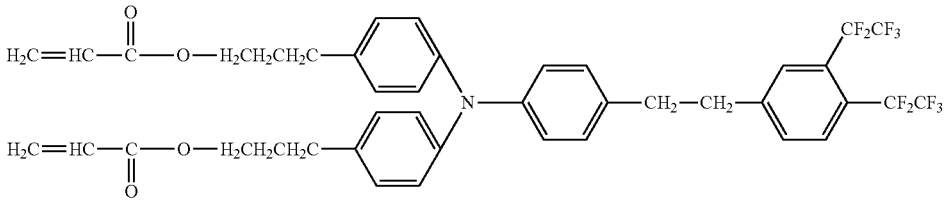

-continued
Exemplified Compound No. 66
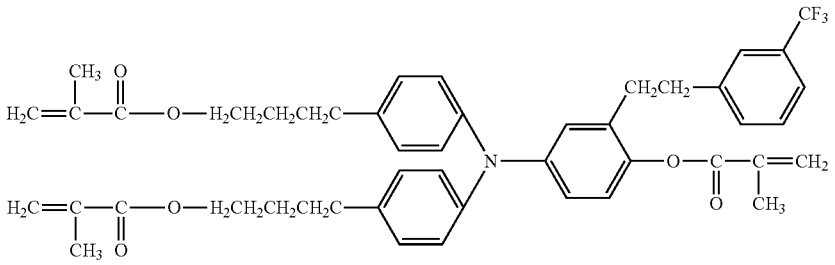
Exemplified Compound No. 67
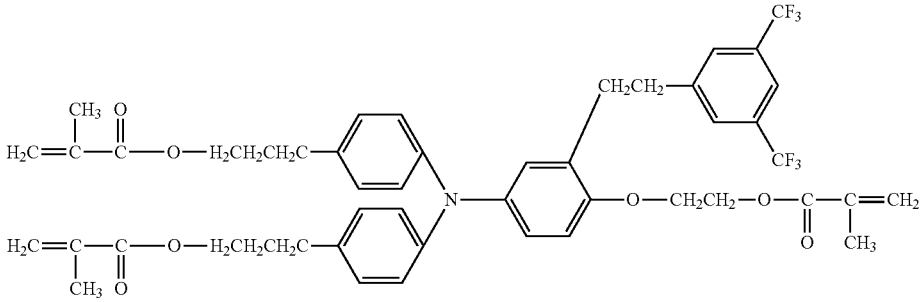
Exemplified Compound No. 68
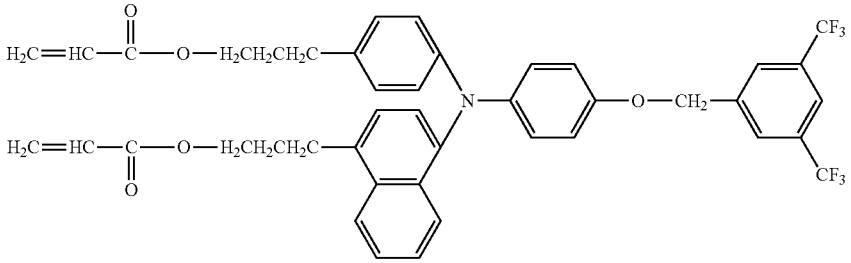
Exemplified Compound No. 69
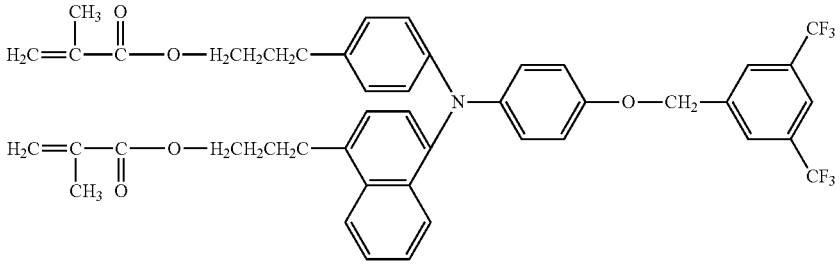
Exemplified Compound No. 70
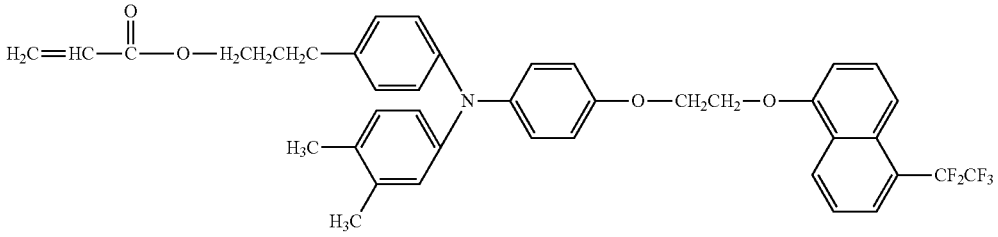
Exemplified Compound No. 71
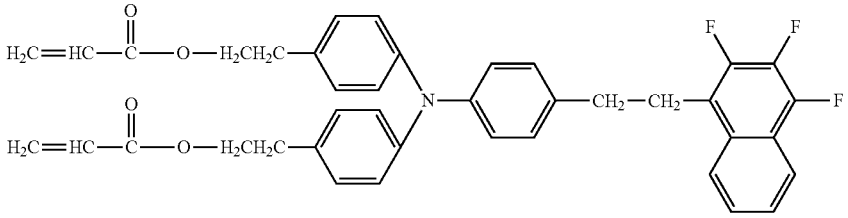

-continued
Exemplified Compound No. 72
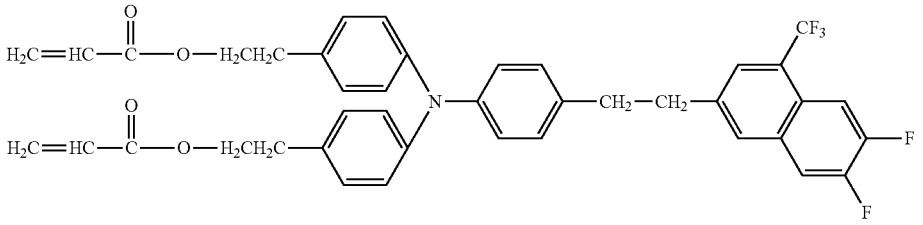
Exemplified Compound No. 73
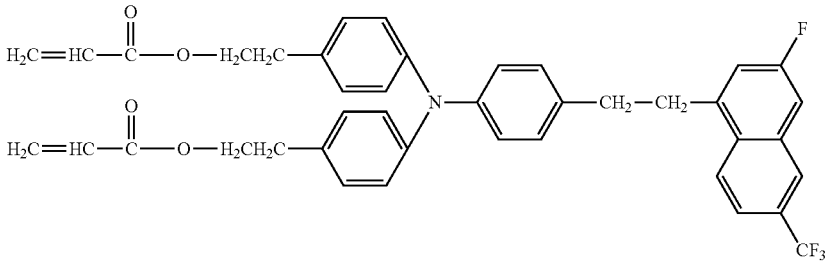
Exemplified Compound No. 74
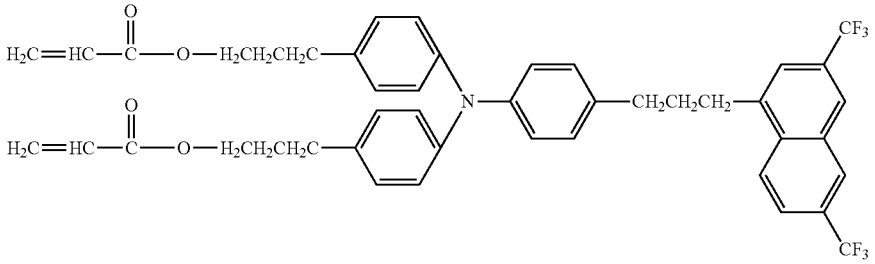
Exemplified Compound No. 75
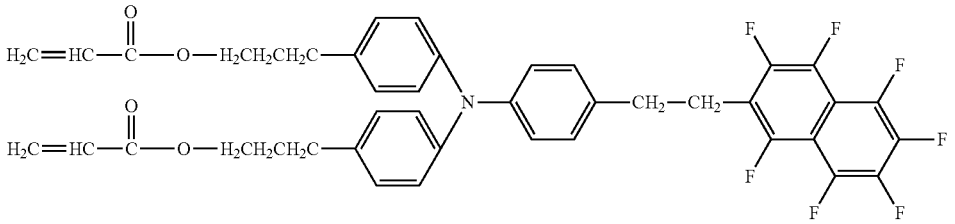
Exemplified Compound No. 76
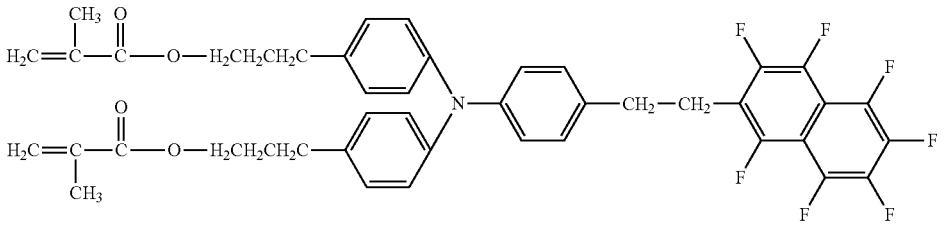
Exemplified Compound No. 77
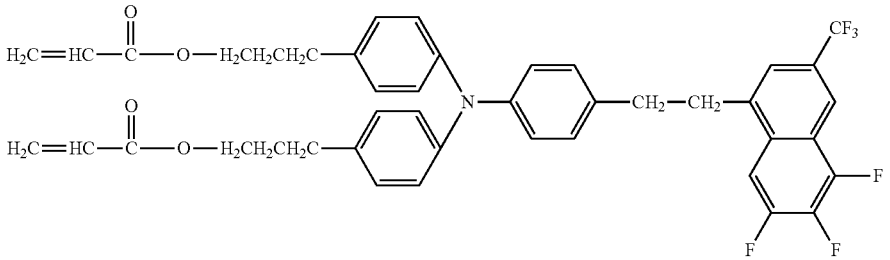

-continued
Exemplified Compound No. 78
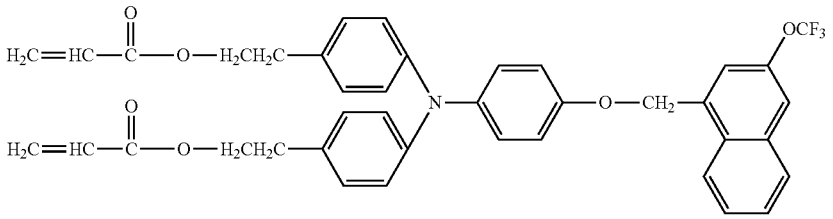
Exemplified Compound No. 79
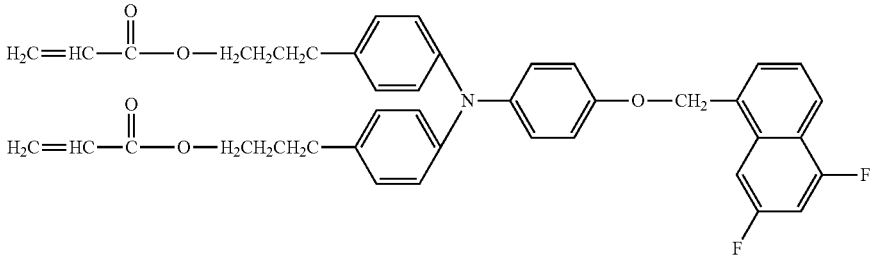
Exemplified Compound No. 80
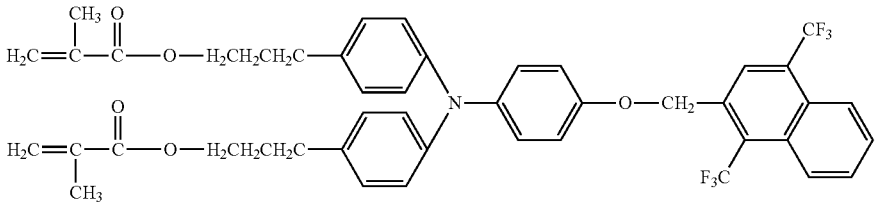
Exemplified Compound No. 81
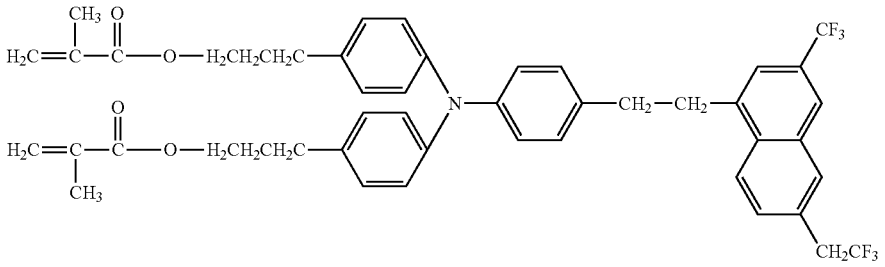
Exemplified Compound No. 82
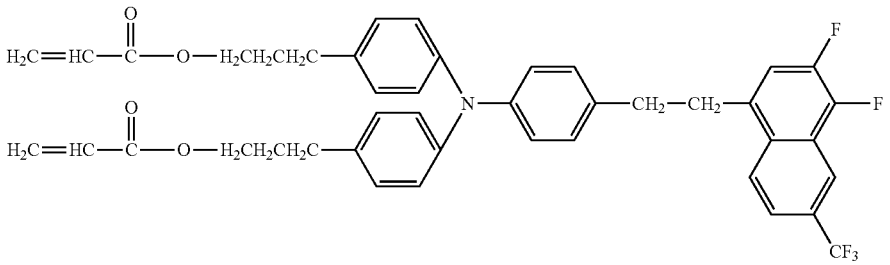
Exemplified Compound No. 83
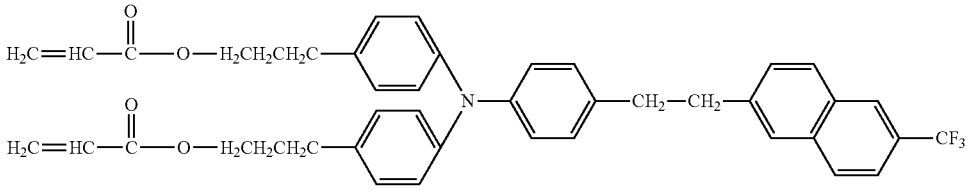

-continued
Exemplified Compound No. 84
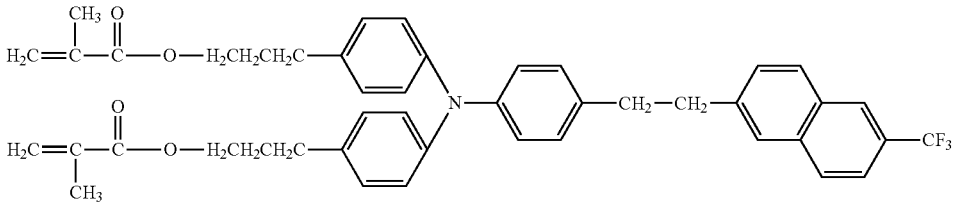
Exemplified Compound No. 85
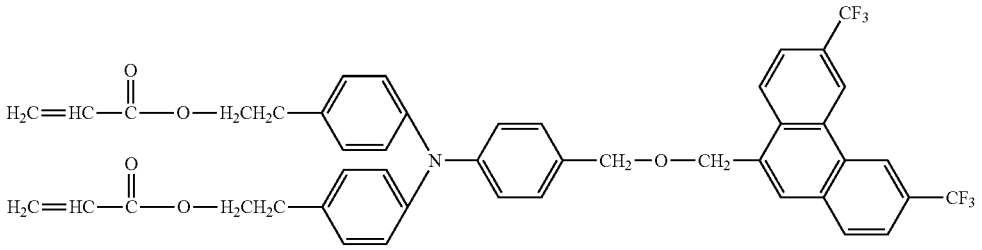
Exemplified Compound No. 86
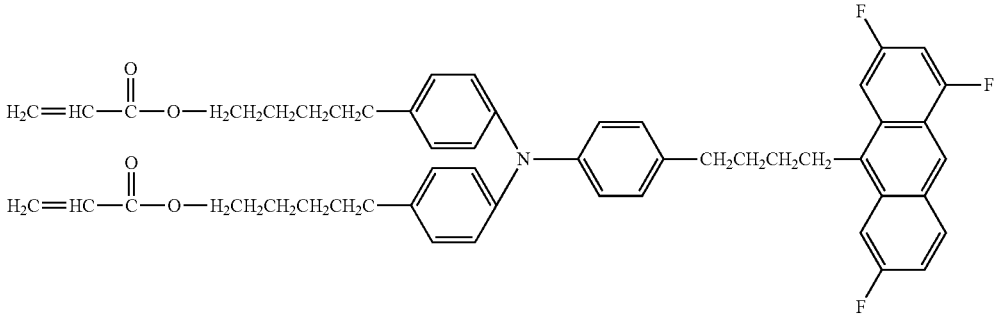
Exemplified Compound No. 87
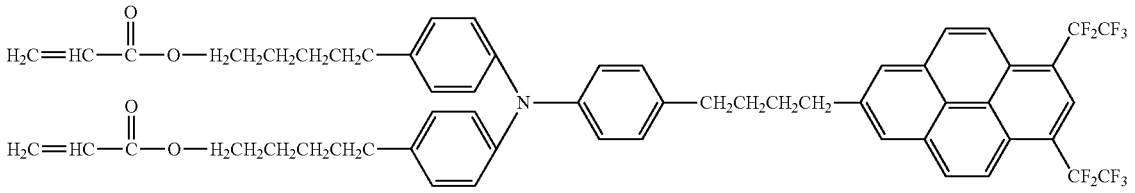
Exemplified Compound No. 88
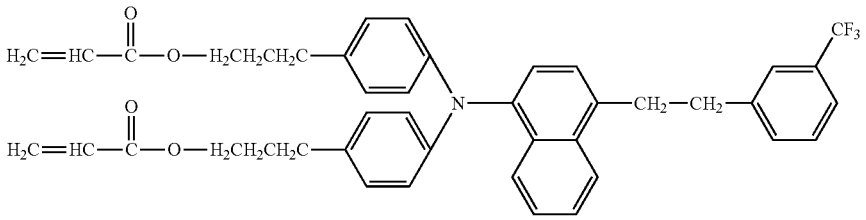
Exemplified Compound No. 89
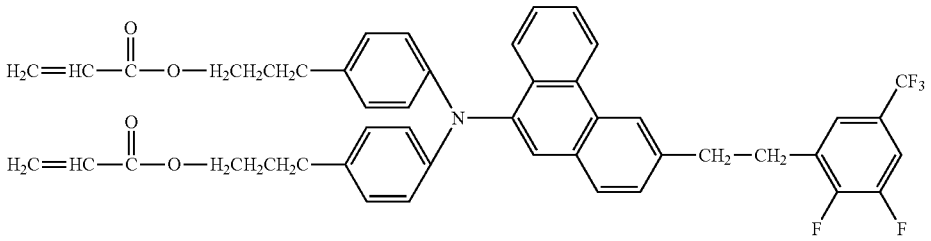

-continued
Exemplified Compound No. 90
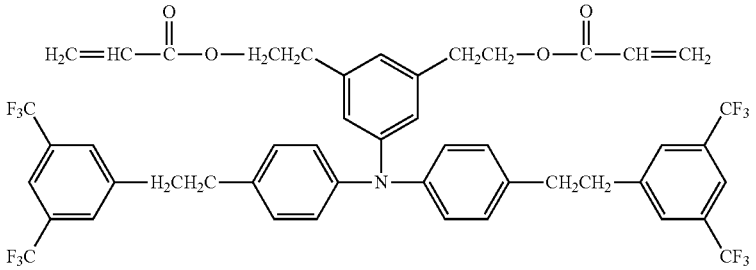
Exemplified Compound No. 91
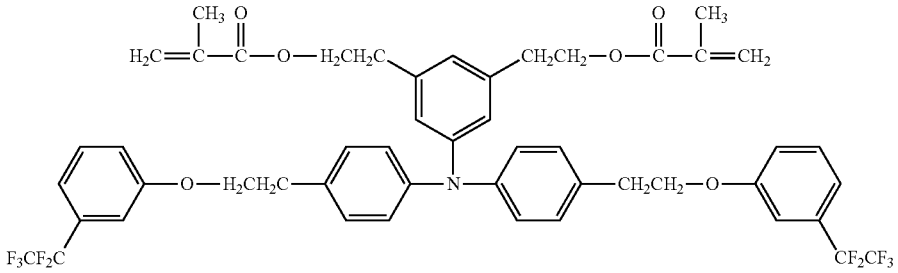
Exemplified Compound No. 92
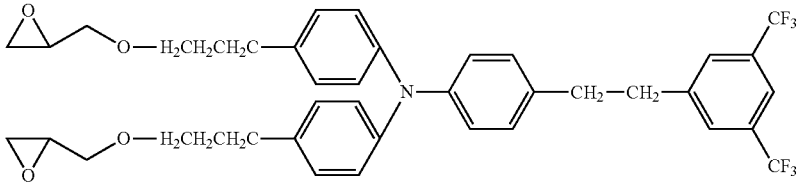
Exemplified Compound No. 93
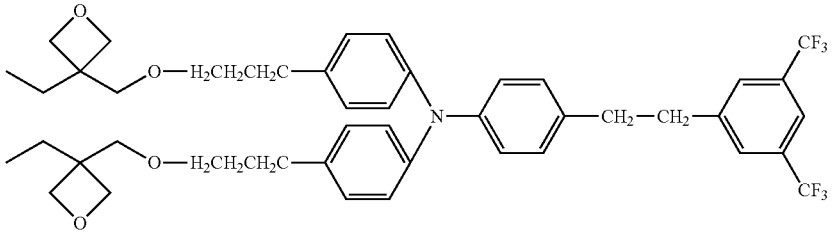
Exemplified Compound No. 94
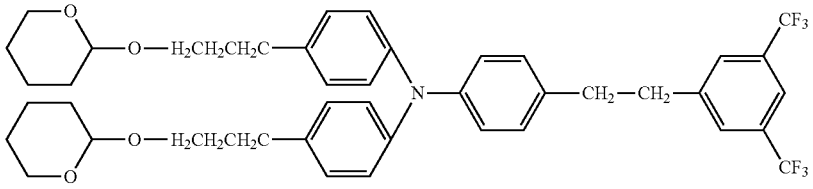
Exemplified Compound No.95
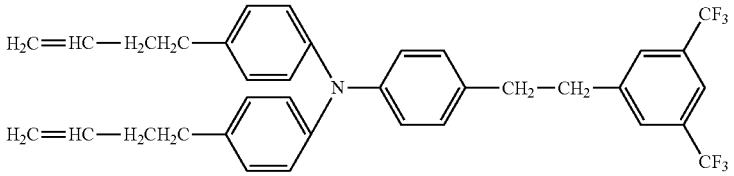
Exeplified Compund No. 96
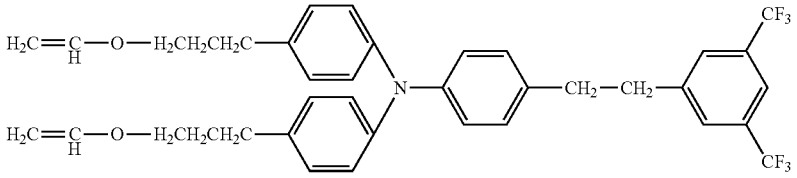

-continued
Exemplified Compound No. 97
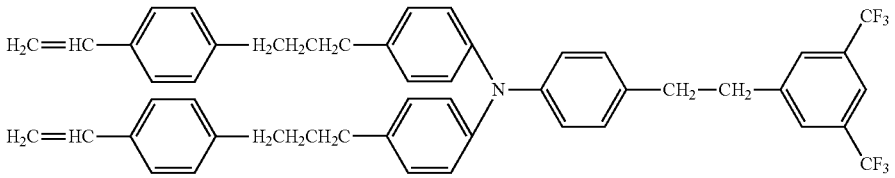
Exemplified Compound No. 98
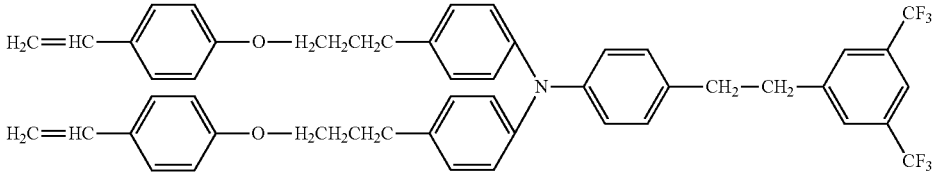
Exeplified Compound No. 99
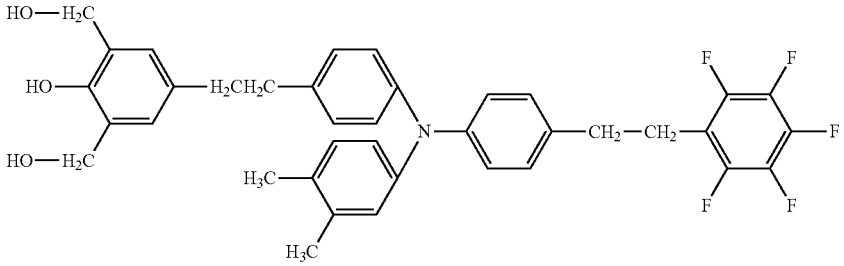
Exemplified Compound No. 100
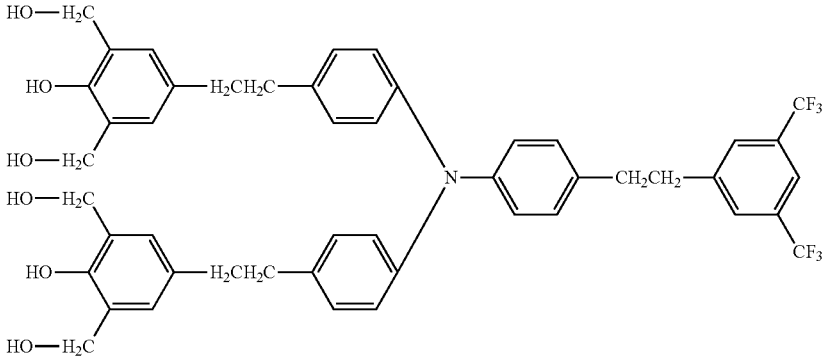
Exemplified Compound No. 101
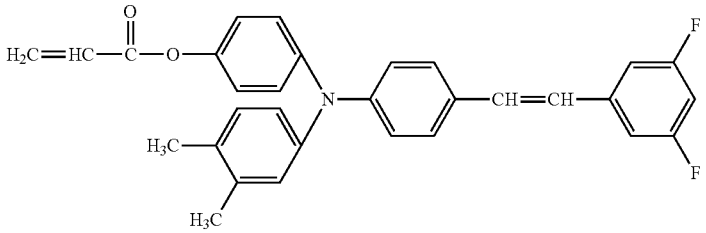
Exemplified Compound No. 102
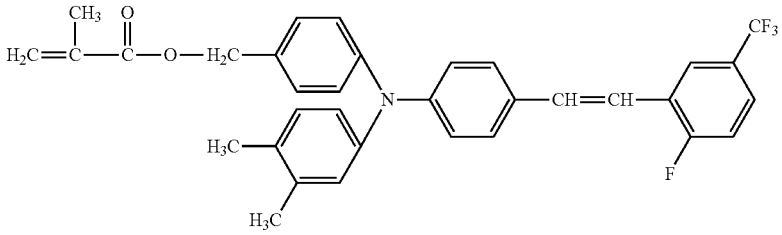

-continued
Exemplified Compound No. 103
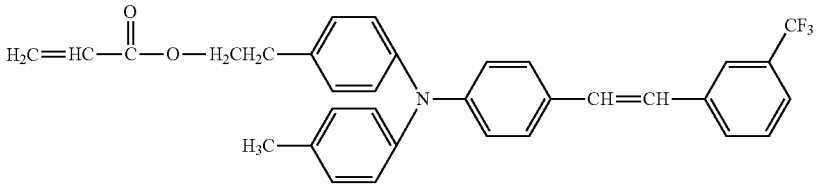
Exemplified Compound No. 104
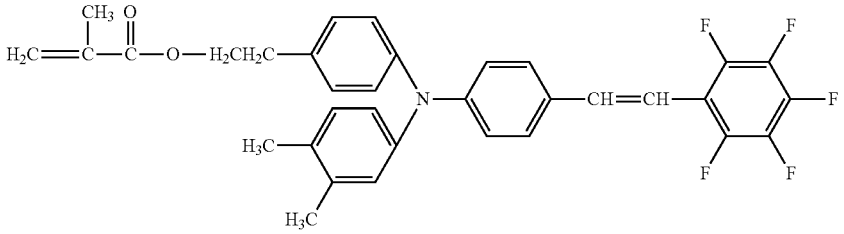
Exemplified Compound No. 105
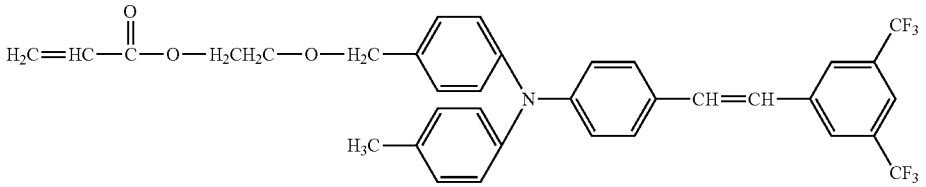
Exemplified Compound No. 106
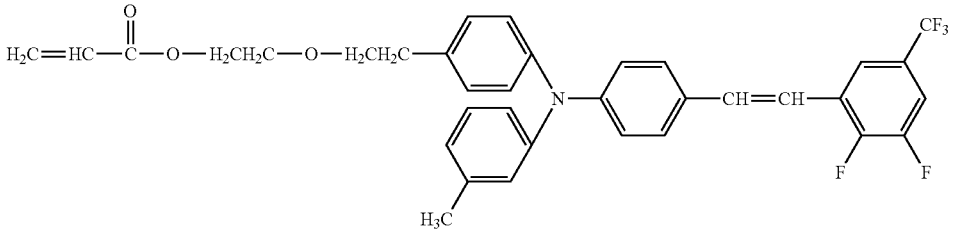
Exemplified Compound No. 107
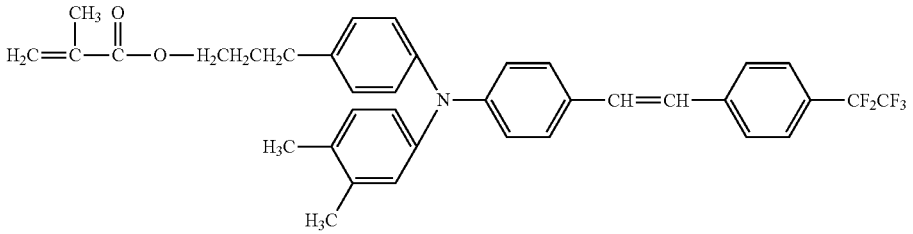
Exemplified Compound No. 108
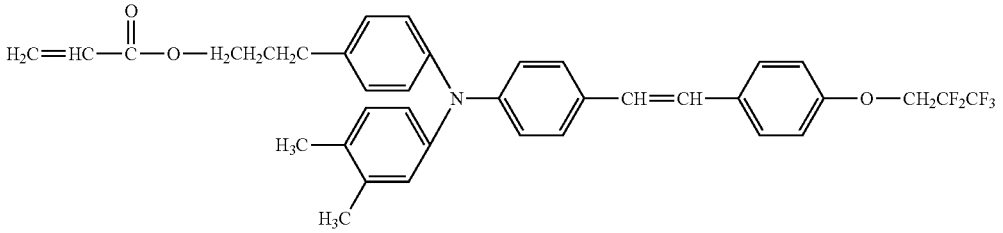

-continued
Exemplified Compound No.109
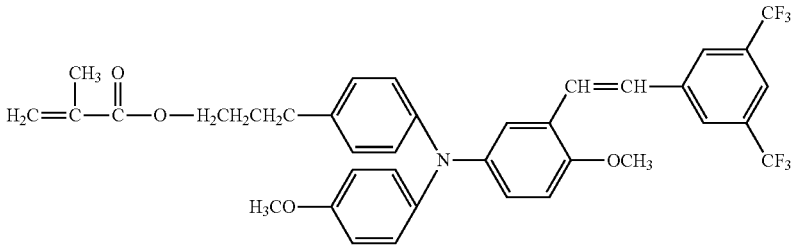
Exemplified Compound No. 110
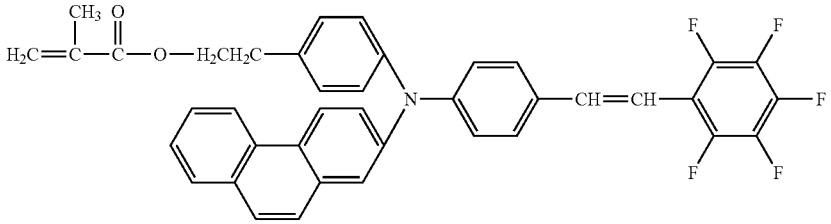
Exemplified Compound No. 111
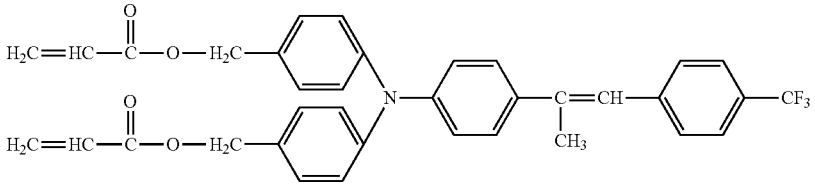
Exemplified Compound No. 112
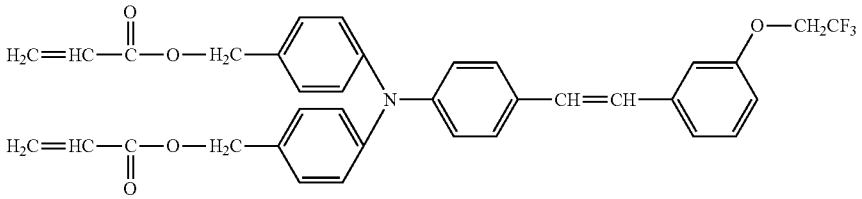
Exemplified Compound No. 113
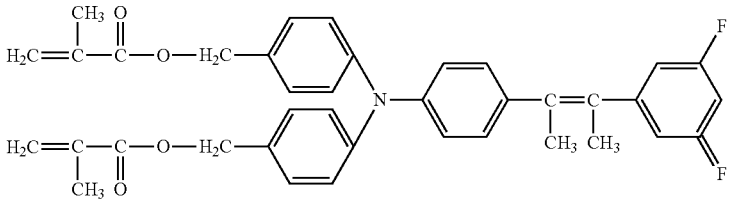
Exemplified Compound No. 114
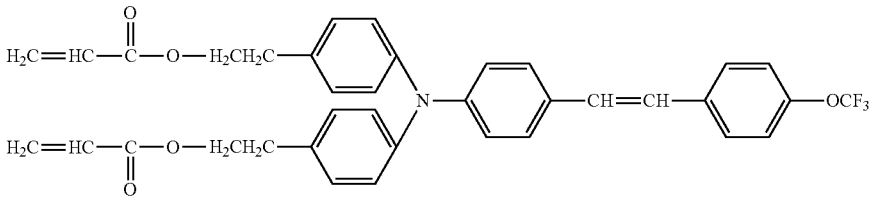
Exemplified Compound No. 115
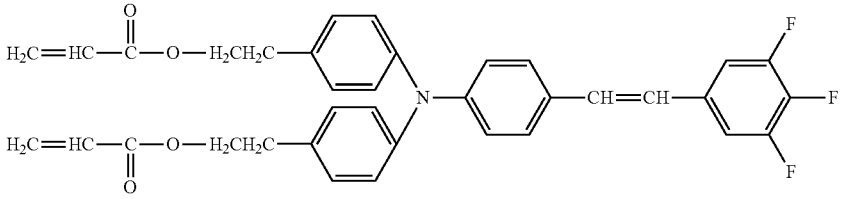

-continued
Exemplified Compound No. 116
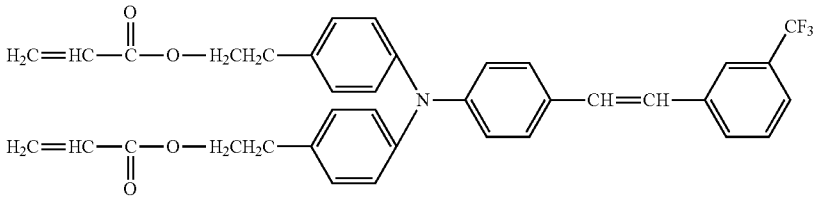
Exemplified Compound No. 117
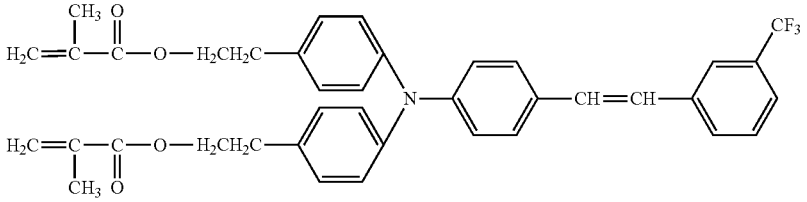
Exemplified Compound No. 118
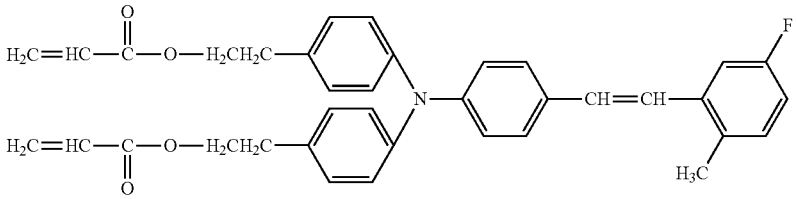
Exemplified Compound No. 119
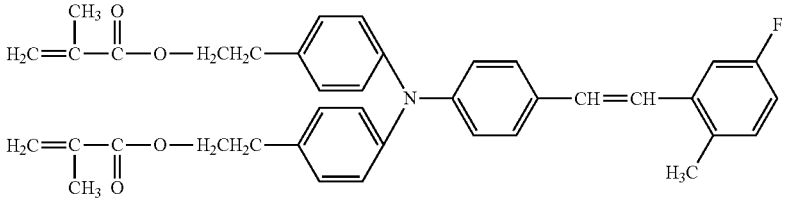
Exemplified Compound No. 120
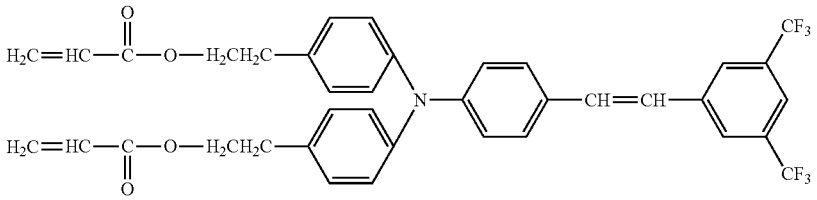
Exemplified Compound No 121
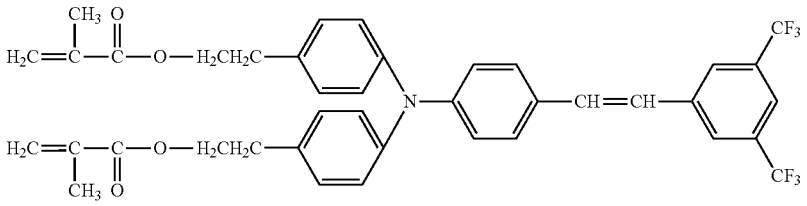
Exemplified Compound No. 122
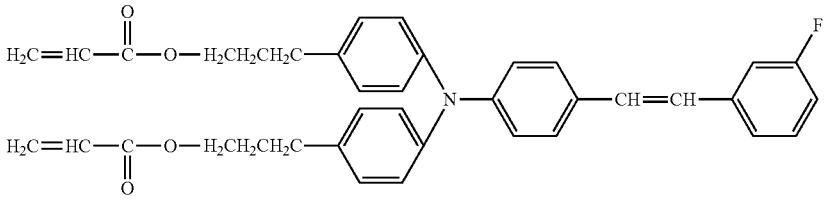

-continued
Exemplified Compound No. 123
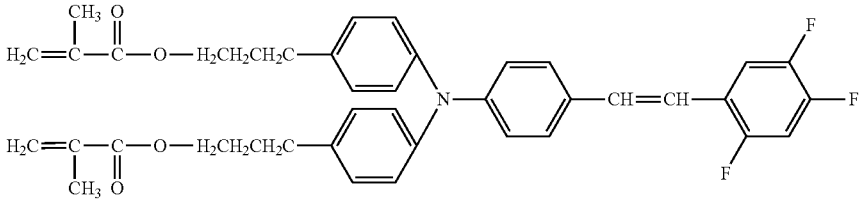
Exemplified Compound No. 124
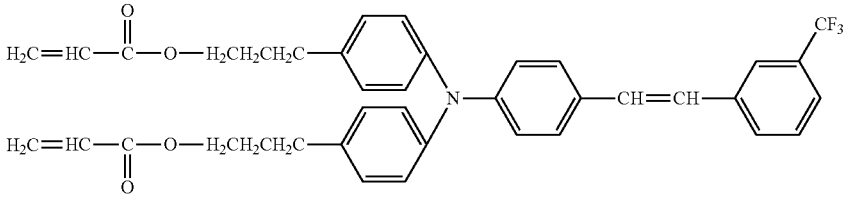
Exemplified Compound No. 125
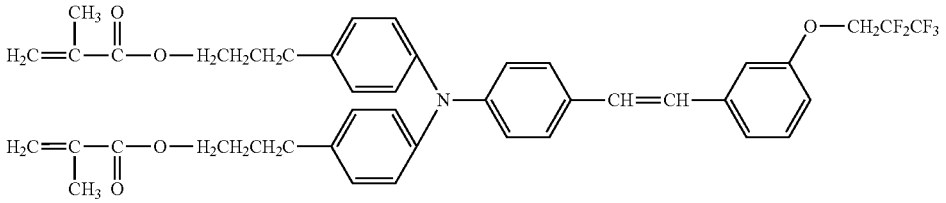
Exemplified Compound No. 126
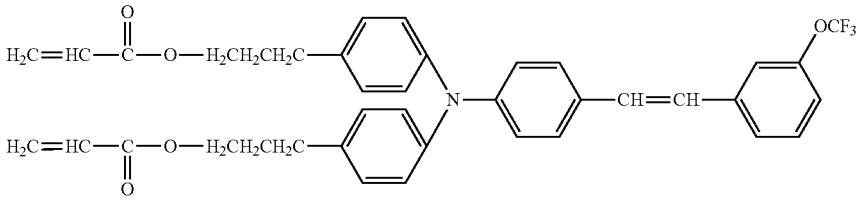
Exemplified Compound No. 127
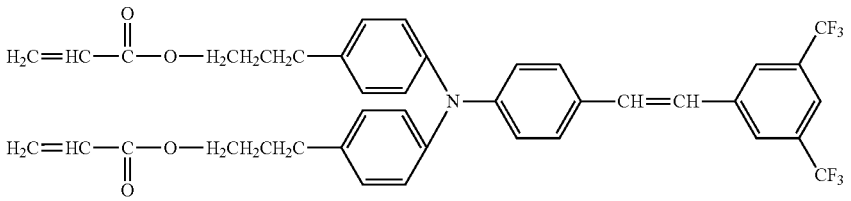
Exemplified Compound No. 128
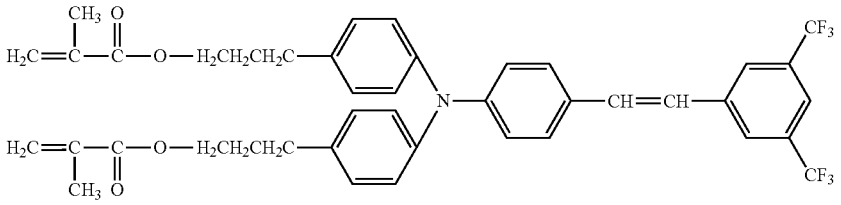
Exemplified Compound No. 129
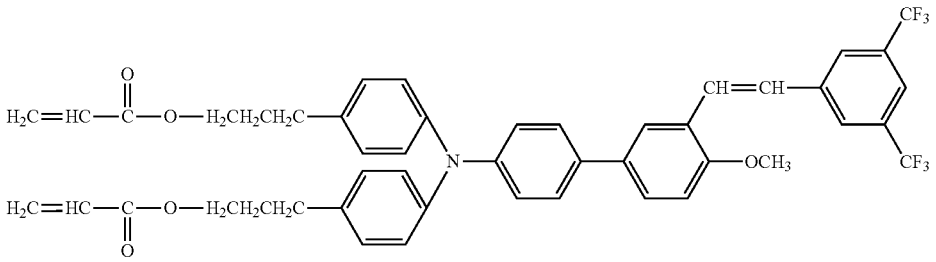

-continued
Exemplified Compound No. 130
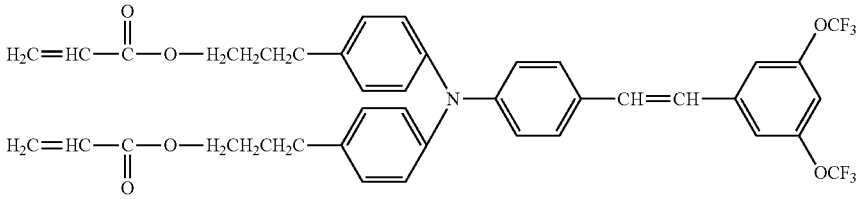
Exemplified Compound No. 131
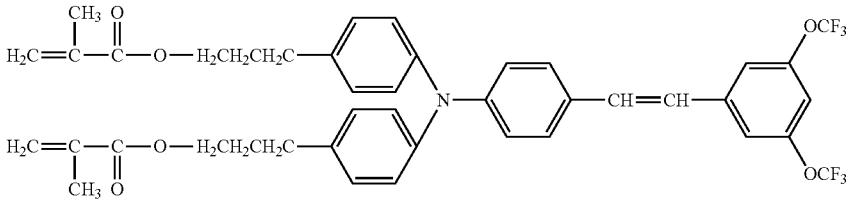
Exemplified Compound No. 132
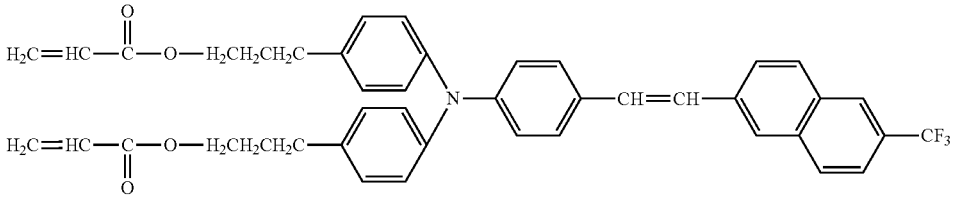
Exemplified Compound No. 133
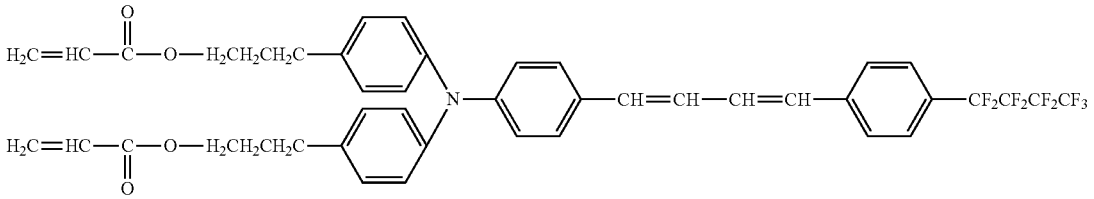
Exemplified Compound No. 134
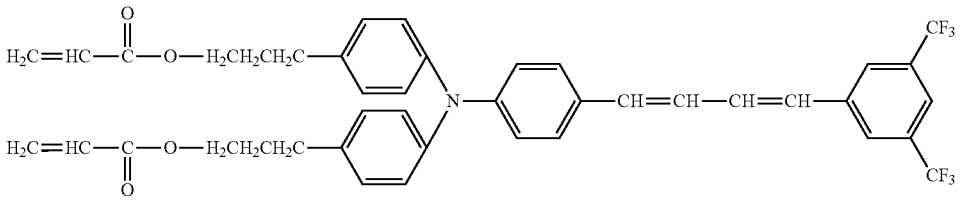
Exemplified Compound No. 135
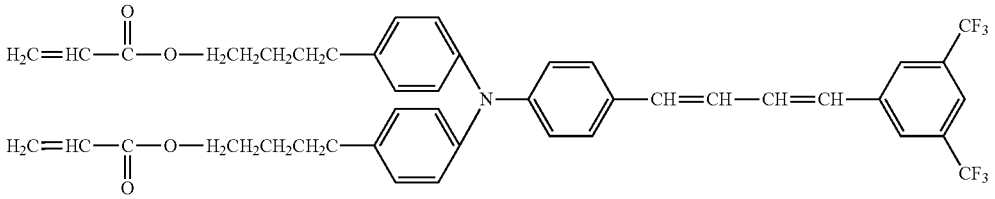
Exemplified Compound No. 136
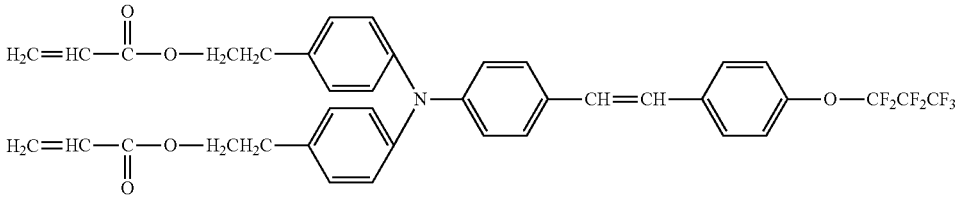

-continued
Exemplified Compound No. 137
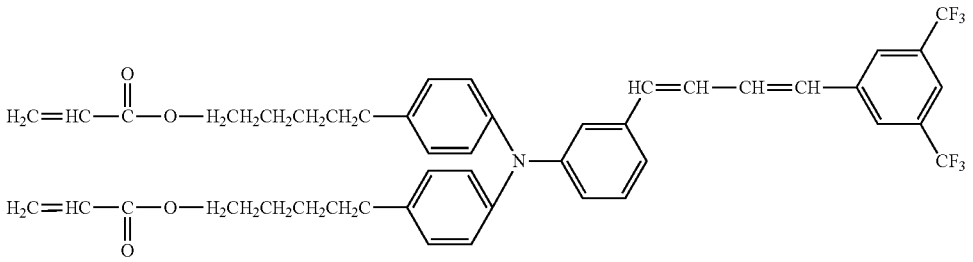
Exemplified Compound No. 138
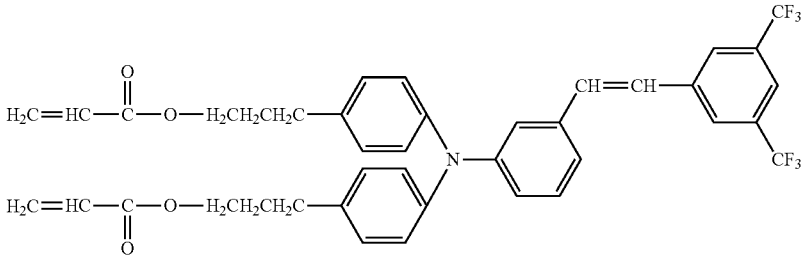
Exemplified Compound No. 139
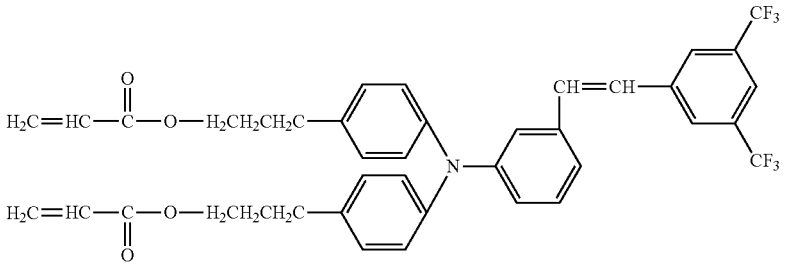
Exemplified Compound No. 140
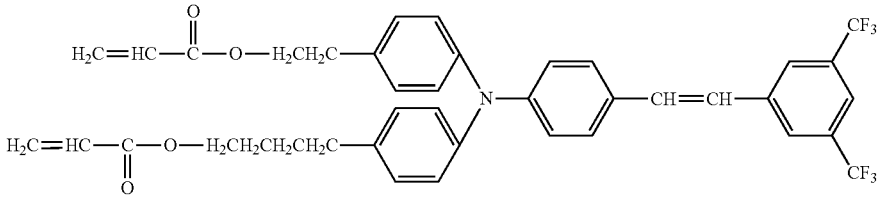
Exemplified Compound No 141
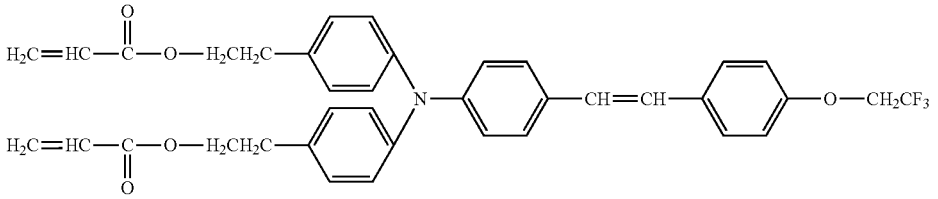
Exemplified Compound No. 142
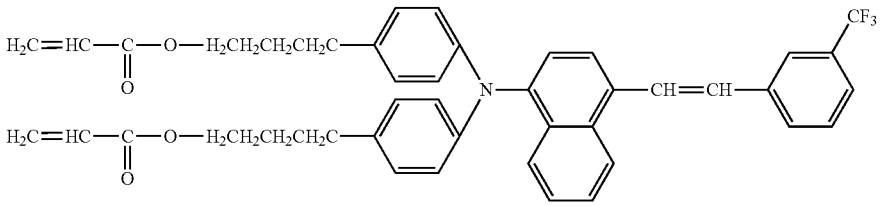

-continued
Exemplified Compound No. 143
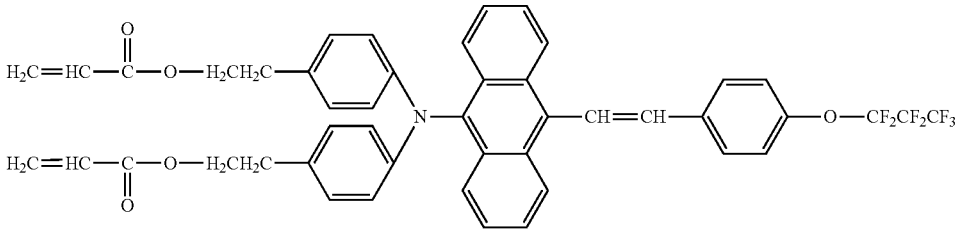
Exemplified Compound No. 144
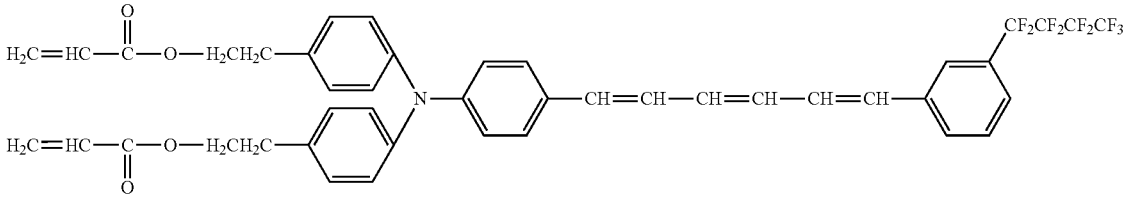
Exemplified Compound No. 145
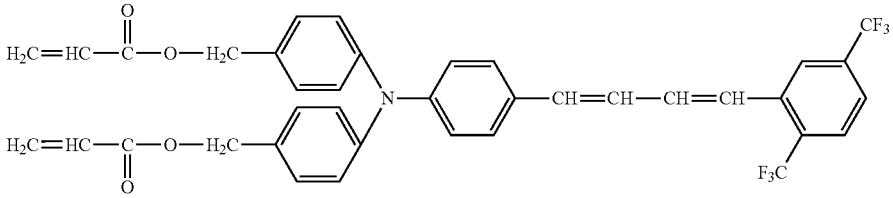
Exemplified Compound No. 146
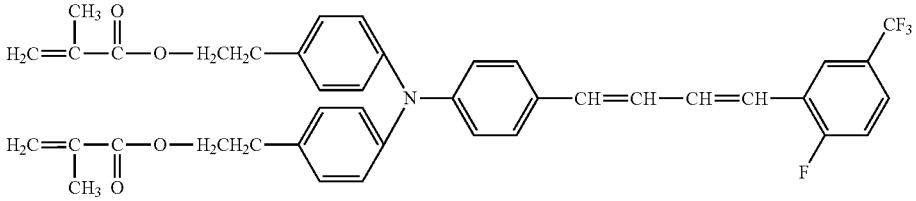
Exemplified Compound No. 147
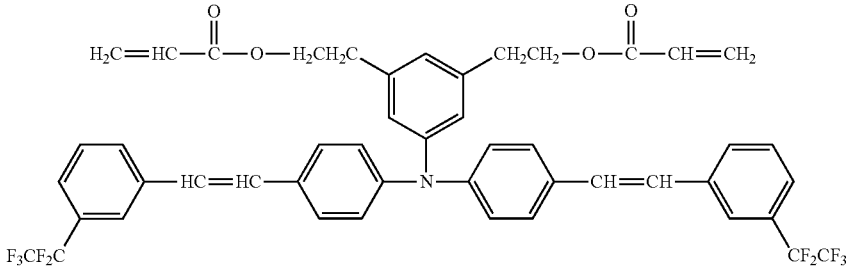
Exemplified Compound No. 148
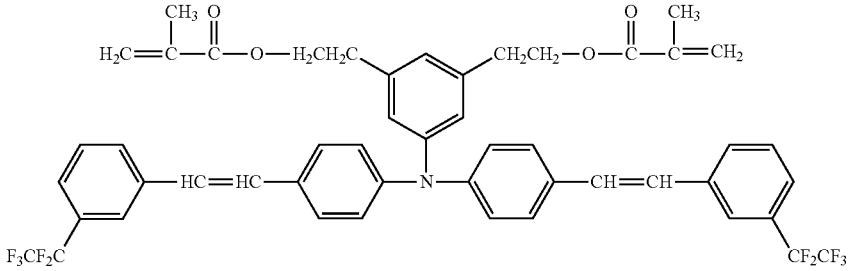

-continued
Exemplified Compound No. 149
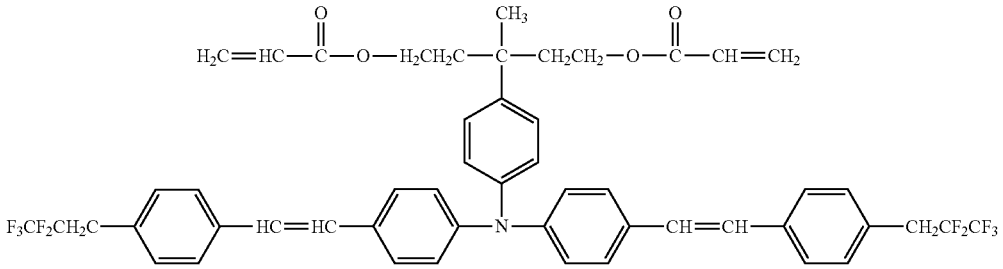
Exemplified Compound No. 150
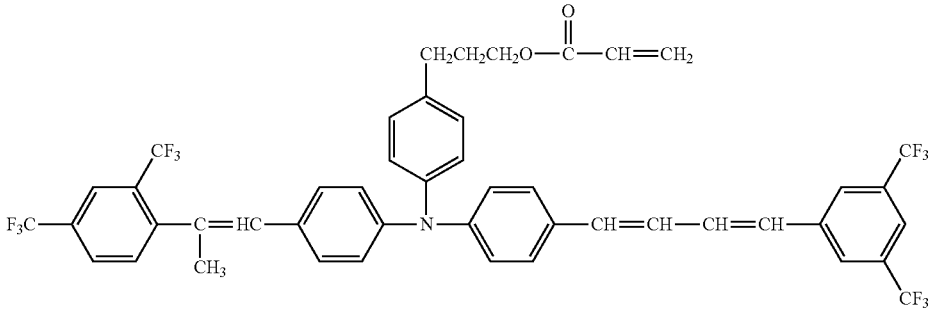
Exemplified Compound No. 151
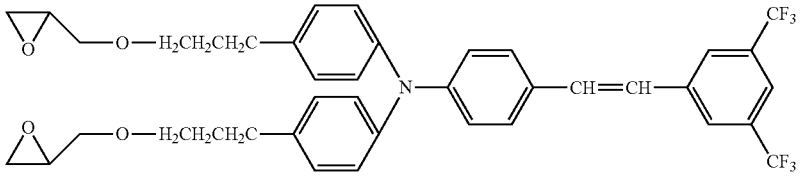
Exemplified Compound No. 152
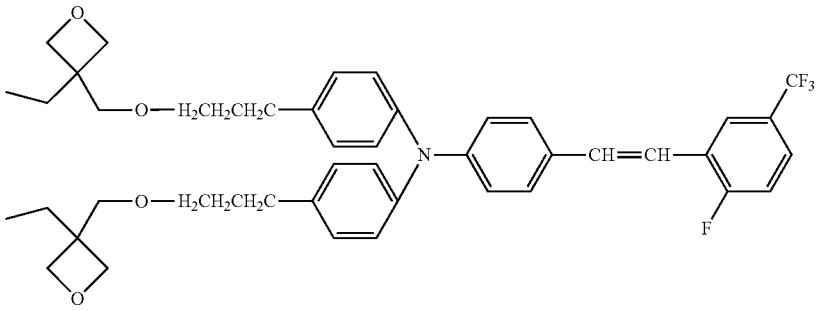
Exemplified Compound No.153
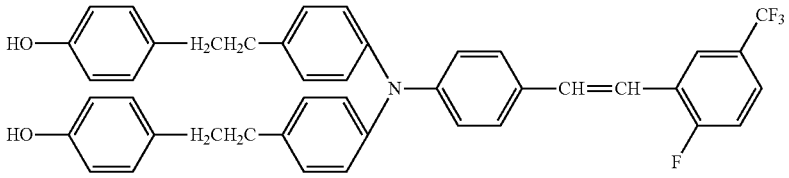

-continued

Exemplefied Compound No. 154

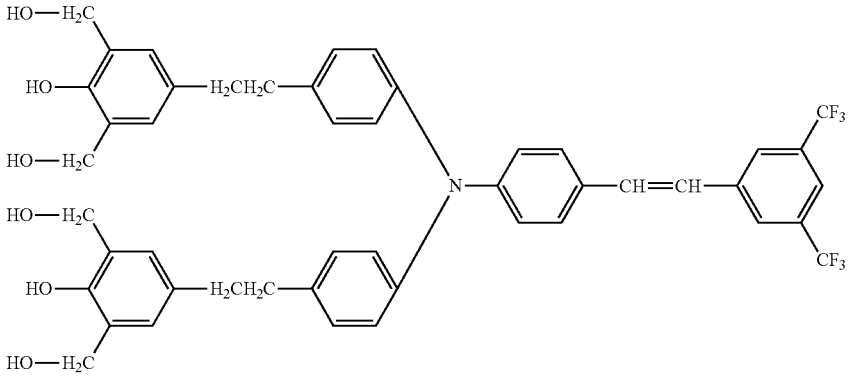

Representative synthesis examples of the hole transport material used in the present invention are shown below

SYNTHESIS EXAMPLE 1

A synthesis example of a hole transport material having a bifunctional polymerizable acrylic group, represented by Exemplified Compound No. 38 is described below.

Intermediate 1 (nitro compound) was synthesized by a reaction represented by the following Reaction Formula (1).

Reaction Formula (1)

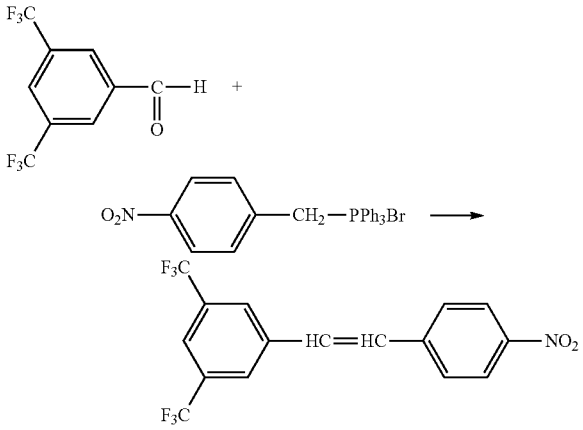

A reactor was charged with 29.3 parts of potassium t-butoxide and 535 parts of dry tetrahydrofuran, and stirring and nitrogen replacement were carried out. The reaction mixture was cooled to an internal temperature of about 5° C. Next, 125 parts of (4-nitrobenzyl)triphenylphosphonium bromide were divided and added in the reactor. A change in the internal temperature was 5° C. to 7° C. After the addition, the mixture was stirred and mixed for 30 minutes.

Next, a mixed solution of 57.5 parts of 3,5-bis(trifluoromethyl)benzaldehyde and 71 parts of tetrahydrofuran was added dropwise over about 1 hour while observing to a change in internal temperature. The change in internal temperature was up to 10° C. Continuously, the reaction was completed with stirring at room temperature for 2 hours.

After the reaction, a reaction mixture was poured into 2500 parts of ice water, and ethyl acetate was additionally added thereto to extract a product. An organic layer was separated, washed with water, washed with saline water, and then dehydrated and concentrated.

To the obtained product, 200 parts of ethyl acetate were added, heated and dissolved, and 800 parts of n-hexane were added, the mixture was cooled to room temperature, and a precipitated by-product was taken by filtration. Again, a filtrate on a filter was washed using a mixed solution of n-hexane and ethyl acetate (n-hexane/ethyl acetate=4/1), and the filtrate was collected and recovered.

A crude product was taken from the recovered filtrate and purified by silica gel column chromatography, thereby obtaining Intermediate 1.

Amount: 65 parts, yield: 75.8%

Next, Intermediate 2 (amine compound) was synthesized by a reaction represented by the following Reaction Formula (2).

Reaction Formula (2)

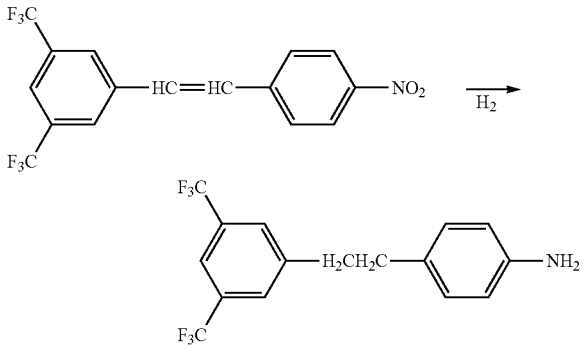

A reactor was charged with 65 parts of Intermediate (1) and 514 parts of ethanol, 11.5 parts of 10% palladium/carbon (55% wet with water) as a catalyst were added thereto, and the inside of the reactor was replaced with hydrogen gas. A reaction was carried out by stirring at an internal temperature of 30° C. for about 20 hours.

After the reaction, filtration, washing with ethanol, and concentration were carried out, thereby obtaining a crude product of Intermediate 2. Subsequently, the residue was purified by silica gel column chromatography and recrystallized from a toluene/hexane mixed solvent, thereby obtaining Intermediate 2.

Amount: 41.9 parts, yield: 70%

Next, Intermediate 3 was synthesized according to the following Reaction Formula (3).

Reaction Formula (3)

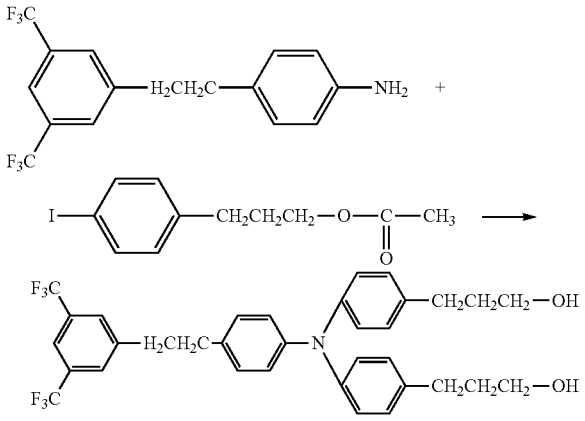

Synthesis of a triphenylamine structure and hydrolysis of an ester moiety were performed using Intermediate 2 obtained as described above. In a reactor, 41.9 parts of Intermediate 2, 91.7 parts of an iodine compound represented by Reaction Formula (3), and 260 parts of o-dichlorobenzene were mixed with each other, 52 parts of potassium carbonate, 24 parts of copper powder were added thereto, and a reaction was carried out at an internal temperature of about 190° C. The reaction was carried out with stirring for 20 hours. After the reaction, filtration, washing with toluene, and concentration were carried out, thereby obtaining a crude product.

Again, hydrolysis was subsequently carried out, and an acetic acid ester moiety was converted into a hydroxyl group. Then, 267 parts of tetrahydrofuran, 100 parts of methanol, and 300 parts of 24% sodium hydroxide aqueous solution were mixed, heated, and stirred at an internal temperature of 70° C., a reaction was carried out for 2 hours, and hydrolysis was performed. After the reaction, a reaction mixture was extracted with ethyl acetate, and an organic layer was washed with water, washed with saline water, dehydrated, and concentrated. The resultant was purified by silica gel chromatography, thereby obtaining Intermediate 3.

Amount: 41.6 parts, yield (two steps): 55%

Exemplified Compound No. 38 was synthesized according to the following Reaction Formula (4).

Reaction Formula (4)

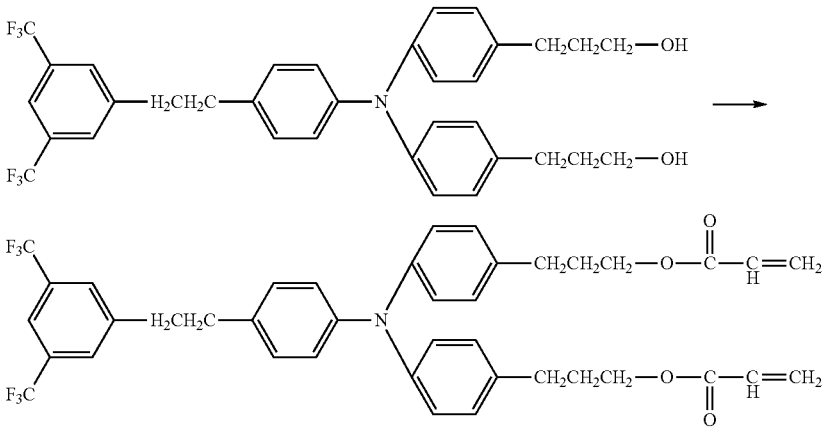

After mixing 41.6 parts of Intermediate 3 obtained by the reaction, 356 parts of dry tetrahydrofuran, and 17.5 parts of triethylamine with each other, the reactor was cooled to maintain an internal temperature at 5° C. or less.

While stirring, 13.8 parts of acryloyl chloride were slowly dropped over about 30 minutes, and dropping and stirring were continued while maintaining the internal temperature at 10° C. or less. Thereafter, the internal temperature was returned to room temperature, a reaction was continued for 2 hours, and then, the reaction was completed.

After the reaction, the reaction solution was poured into 1200 parts of cooled 5% sodium hydroxide aqueous solution, and extraction was performed with ethyl acetate. The resultant was washed with water, dehydrated, and concentrated, thereby obtaining a crude product.

Subsequently, the crude product was purified by silica gel column chromatography, thereby obtaining a hole transport material having a non-crystalline polymerizable functional group, represented by Exemplified Compound No. 38.

Amount: 24.3 parts, yield: 49.5%

SYNTHESIS EXAMPLE 2

A synthesis example of a hole transport material having a bifunctional polymerizable acrylic group, represented by Exemplified Compound No. 127 is described below.

Intermediate 1 (nitro compound) was synthesized by the same process as in Reaction Formula (1).

Subsequently, Intermediate 4 (amino compound) was synthesized by a reaction represented by the following Reaction Formula (5).

Reaction Formula (5)

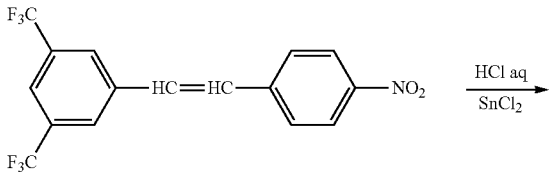

-continued

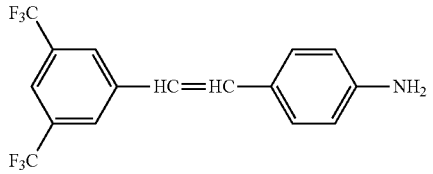

In a reactor, 65 parts of Intermediate (1) and 650 parts of ethanol were added. Next, 130 parts of concentrated hydrochloric acid aqueous solution was slowly added into the reactor while maintaining an internal temperature at 35° C. or less. As a catalyst, 136.5 parts of tin (II) chloride were added thereto. The reaction mixture was heated to an internal temperature of 80° C. and stirred for 5 hours. After the reaction mixture was kept overnight, 2000 parts of 24% cooled sodium hydroxide aqueous solution and 700 parts of toluene were added to the reaction mixture, and liquid separation was performed. An obtained organic layer was washed with water, dehydrated, and concentrated, thereby obtaining a crude product.

The obtained crude product was purified by silica gel column chromatography. Thereafter, the resultant was recrystallized using a mixed solvent of toluene and n-hexane, filtered, and dried, etc., thereby obtaining a purified product of Intermediate 4.

Amount: 40.5 parts, yield: 68%

Intermediate 5 was synthesized according to the following Reaction Formula (6).

Reaction Formula (6)

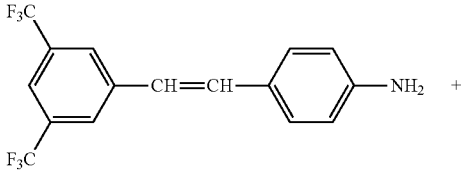

-continued

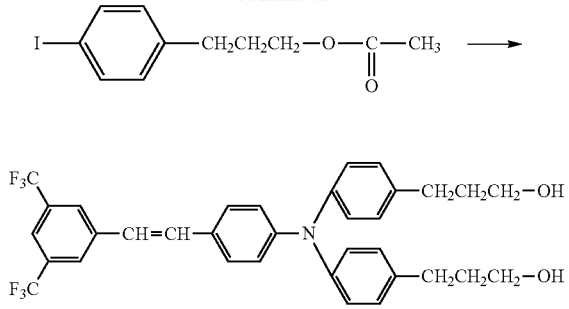

Synthesis of a triphenylamine structure and hydrolysis of an ester moiety were performed using Intermediate 4 obtained as described above. In a reactor, 40 parts of Intermediate 4, 88.1 parts of an iodine compound represented by Reaction Formula (6), and 260 parts of o-dichlorobenzene were mixed with each other, 50 parts of potassium carbonate, 23 parts of copper powder were added thereto, and a reaction was carried out at an internal temperature of about 190° C. The reaction was carried out with stirring for 20 hours. After the reaction, filtration, washing with toluene, and concentration were carried out, thereby obtaining a crude product.

Again, hydrolysis was subsequently carried out to convert an acetic acid ester moiety to a hydroxyl group. Then, 260 parts of tetrahydrofuran, 100 parts of methanol, and 300 parts of 24% sodium hydroxide aqueous solution were mixed, heated and stirred at an internal temperature of 70° C., a reaction was carried out for 2 hours, and hydrolysis was performed. After the reaction, a reaction mixture was extracted with ethyl acetate, and an organic layer was washed with water, washed with saline solution, dehydrated, and concentrated. The resultant was purified by silica gel chromatography, thereby obtaining Intermediate 6.

Amount: 42.7 parts, yield (two steps): 59%

Exemplified Compound No. 127 was synthesized according to the following Reaction Formula (7).

Reaction Formula (7)

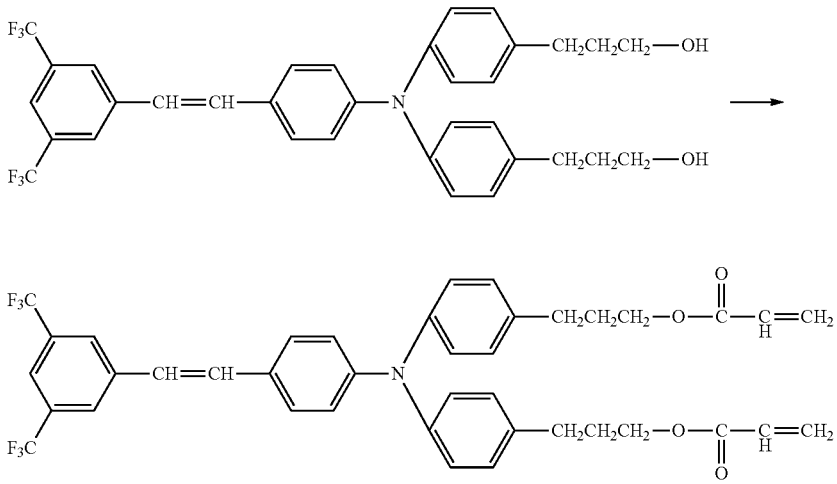

After mixing 42 parts of Intermediate 6 obtained by the reaction, 350 parts of dry tetrahydrofuran, and 17.7 parts of triethylamine with each other, the reactor was cooled to maintain an internal temperature to 5° C. or less. While stirring the reaction mixture in the reactor, 13.9 parts of acryloyl chloride were slowly dropped over about 30 minutes. Here, dropping and stirring were continued while cooling the reactor so that the internal temperature was 10° C. or less. Thereafter, the internal temperature was returned to room temperature, a reaction was continued for 2 hours, and then, the reaction was completed.

After the reaction, the resultant was poured into 1200 parts of 5% cooled sodium hydroxide aqueous solution, and extraction was performed with ethyl acetate. The resultant was washed with water, dehydrated, and concentrated, thereby obtaining a crude product. Subsequently, the crude product was purified by silica gel column chromatography, thereby obtaining a hole transport material having a non-crystalline polymerizable functional group, represented by Exemplified Compound No. 127.

Amount: 26.8 parts, yield: 54%

The hole transport material according to the present invention, obtained by the above-mentioned synthesis method can be prepared in a form of solution by appropriately adjusting the kind and an amount of solvent to thereby be used as a surface layer coating solution of the electrophotographic photosensitive member according to the present invention.

Further, the surface layer coating solution may contain the hole transport material according to the present invention and a hole transport material having a polymerizable functional group, known in the art as long as the object of the present invention is not inhibited. As the hole transport material having a polymerizable functional group known in the art, an aromatic amine compound having a polymerizable functional group may be used.

The surface layer of the electrophotographic photosensitive member according to the present invention can contain a polymer of a mixed composition containing a compound having a polymerizable functional group and having no hole transport properties in addition to the hole transport material according to the present invention. Mechanical strength of the obtained polymer can be further improved by using the hole transport material according to the present invention and the compound having the polymerizable functional group and having no hole transport properties together with each other. More preferably, the surface layer of the electrophotographic photosensitive member according to the present invention contains a polymer of a mixed composition containing the hole transport material according to the present invention, having one or more polymerizable functional groups, and a compound having two or more polymerizable functional groups and having no hole transport properties.

The polymerizable functional group of the compound having the polymerizable functional group and having no hole transport properties may be a polymerizable functional group of the above-mentioned hole transporting compound represented by Formula (1). Preferably, a radical polymerizable functional group such as a styryl group, a vinyl group, an acryloyloxy group, a methacryloyloxy group, or the like, is preferable. The radical polymerizable functional group such as the acryloyloxy group or the methacryloyloxy group is more preferable.

Examples of the compound having the polymerizable functional group and having no hole transport structure can include compounds described below. The term "monofunctional" as described below means having one polymerizable functional group. Examples of a compound having an acryloyloxy group as a polymerizable functional group and having no hole transport properties (hereinafter also referred to as 'polymerizable monomer') will be described below.

Examples of a monofunctional polymerizable monomer can include ethyl acrylate, n-propyl acrylate, n-butyl acrylate, isobutyl acrylate, 2-ethylhexyl acrylate, 2-hydroxyethyl acrylate, tetrahydrofurfuryl acrylate, benzyl acrylate, cyclohexyl acrylate, ethoxy-diethylene glycol acrylate, isoamyl acrylate, lauryl acrylate, stearyl acrylate, phenoxyethyl acrylate, phenoxydiethylene glycol acrylate, ethoxylated o-phenyl phenol acrylate, and the like.

Examples of a difunctional polymerizable monomer can include 1,4-butanediol diacrylate, 1,5-pentanediol diacrylate, 3-methyl-1,5-pentanediol diacrylate, 1,6-hexanediol diacrylate, 1,9-nonanediol diacrylate, 1,10-decanediol diacrylate, triethylene glycol diacrylate, neopentyl glycol diacrylate, tricyclodecanedimethanol diacrylate, and the like.

Examples of a trifunctional polymerizable monomer can include trimethylolpropane triacrylate, pentaerythritol triacrylate, ethoxylated isocyanuric acid triacrylate, and the like.

Examples of a tetrafunctional polymerizable monomer can include pentaerythritol tetraacrylate, dimethylol propane tetraacrylate, and the like.

Examples of a hexafunctional polymerizable monomer can include dipentaerythritol hexaacrylate, and the like.

As described above, acrylate monomers are mentioned by way of examples, but if necessary, compounds having a polymerizable functional group synthesized by substituting the acryloyloxy group with a methacryloyloxy group or another polymerizable functional group may also be used.

In view of abrasion resistance, various fine particles may be contained in the surface layer. The fine particles may be inorganic fine particles or organic fine particles. As the inorganic fine particles, particles containing alumina, silica, zinc oxide, tin oxide, titanium oxide, or the like, are used.

As the organic fine particles, various organic resin fine particles can be used. For example, fine particles made of a resin such as polyolefin, polytetrafluoroethylene, polystyrene, polyacrylic acid ester, polymethacrylic acid ester, polyamide, polyester, polyurethane, and the like, can be used.

The surface layer can be formed by forming a coating film of the surface layer coating solution containing the hole transporting compound represented by the Formula (1), polymerizing the hole transporting compound represented by Formula (1) in the coating film to cure the coating film.

As the solvent used in the surface layer coating solution, alcohol based solvents, sulfoxide based solvents, ketone based solvents, ether based solvents, ester based solvents, aliphatic halogenated hydrocarbon based solvents, aliphatic hydrocarbon based solvents, aromatic hydrocarbon based solvents, or the like, can be used.

When the surface layer is a protective layer, it is preferable that a film thickness of the surface layer is 0.1 μm or more and 15 μm or less. Further, when the surface layer is a charge transport layer, it is preferable that the film thickness of the surface layer is 5 μm or more and 40 μm or less.

As a method of curing the coating film of the surface layer coating solution (as a method of polymerizing the hole transporting compound represented by Formula (1)), a polymerization method using heat, light (UV light, or the like), or radioactive rays (electron beam, or the like) can be used. Among them, the radioactive rays are preferable, and among the ratioactive rays, the electron beam is more preferable.

Polymerization is performed using the electron beam, which is preferable in that a significantly dense (high-density) three-dimensional network structure is obtained, and thus abrasion resistance is improved. Further, since an efficient polymerization reaction is performed within a short time, productivity is also increased. In the case of irradiating electron beam, as an accelerator, for example, a scanning type accelerator, an electrocurtain type accelerator, a broad beam type accelerator, a pulse type accelerator, a laminar type accelerator, or the like, can be used.

In the case of using the electron beam, an accelerating voltage of the electron beam is preferably 150 kV or less in view of suppressing material characteristics from being degraded by the electron beam without impairing polymerization efficiency. In addition, an electron beam absorbed dose on a surface of the coating film of the surface layer coating solution is preferably 5 kGy or more and 50 kGy or less, and more preferably 1 kGy or more and 10 kGy or less.

Further, in the case of polymerizing the hole transport material according to the present invention using the electron beam, in order to suppress polymerization from being inhibited by oxygen, it is preferable that the electron beam is irradiated under an inert gas atmosphere and then, heating is performed under the inert gas atmosphere. Examples of inert gas can include nitrogen, argon, helium, and the like.

Next, an entire configuration of the electrophotographic photosensitive member according to the present invention will be described.

<Electrophotographic Photosensitive Member>

A preferable configuration of the electrophotographic photosensitive member according to the present invention is a configuration in which a charge generating layer and a hole transport layer are sequentially stacked in the stated order on a support member. If necessary, an electroconductive layer or an undercoat layer (an intermediate layer) may be installed between the charge generating layer and the support member, and a protective layer may be installed on the hole transport layer. Further, in the present invention, the charge generating layer and the hole transport layer will be collectively referred to as a photosensitive layer.

The hole transport material according to the present invention is contained in a surface layer. In the present invention, the surface layer means the protective layer when the protective layer is formed in the electrophotographic photosensitive member, and the surface layer means the whole transport layer when the protective layer is not installed. Further, the photosensitive layer may also be composed of a single photosensitive layer containing a charge generating material and the hole transport material.

<Support Member>

It is preferable that the support member used in the electrophotographic photosensitive member according to the present invention is an electroconductive support member made of a material having electroconductivity. Examples of the material of the support member can include metals or alloys such as iron, copper, gold, silver, aluminum, zinc, titanium, lead, nickel, tin, antimony, indium, chromium, aluminum alloy, stainless steel, and the like. Further, a metal support member or a resin support member having a coating film formed by vacuum deposition of aluminum, an aluminum alloy, an indium oxide-tin oxide alloy, or the like, can also be used. In addition, a support member obtained by impregnating electroconductive particles such as carbon black, tin oxide particles, titanium oxide particles, silver particles, or the like, into plastic or paper, or a support member containing an electroconductive resin can also be used. The support member can have a cylindrical shape, a belt shape, a sheet shape, a plate shape, or the like, but the cylindrical shape is most common.

A surface of the support member may be subjected to treatment such as cutting treatment, roughening treatment, alumite treatment, and the like, in view of suppression of interference fringes due to scattering of laser light, improvement of defects on the surface of the support member, improvement of electroconductivity of the support member, etc.

The electroconductive layer may be installed between the support member and an undercoat layer or charge generating layer to be described below in order to suppress interference fringes by scattering of laser, or the like, control resistance, or cover scratches on the support member.

The electroconductive layer can be formed by applying an electroconductive layer coating solution obtained by dispersing carbon black, an electroconductive pigment, a resistance controlling pigment, and the like, together with a binder resin and drying the obtained coating film. A compound cured and polymerized by heating, UV light irradiation, radioactive ray irradiation, or the like, may be added to the electroconductive layer coating solution. A surface of an electroconductive layer formed by dispersing an electroconductive pigment or resistance controlling pigment tends to be roughened.

A film thickness of the electroconductive layer is preferably 0.1 μm or more and 50 μm or less, more preferably, 0.5 μm or more and 40 μm or less, and further more preferably 1 μm or more and 30 μm or less.

Examples of the binder resin used in the electroconductive layer can include polymers and copolymers of vinyl compounds such as styrene, vinyl acetate, vinyl chloride, acrylic acid ester, methacrylic acid ester, vinylidene fluoride, trifluoroethylene, and the like, polyvinyl alcohol, polyvinyl acetal, polycarbonate, polyester, polysulfone, polyphenylene oxide, polyurethane, a cellulose resin, a phenol resin, a melamine resin, a silicone resin, an epoxy resin, and an isocyanate resin.

Examples of the electroconductive pigment and the resistance controlling pigment include particles of metals (alloys) such as aluminum, zinc, copper, chromium, nickel, silver, stainless steel, and the like, and those obtained by depositing these particles on surfaces of plastic particles. Further, particles of metal oxides such as zinc oxide, titanium oxide, tin oxide, antimony oxide, indium oxide, bismuth oxide, indium oxide doped with tin, tin oxide doped with antimony or tantalum, or the like, may also be used. These materials may be used alone or a combination of two or more thereof may also be used.

The undercoat layer may be installed between the support member or the electroconductive layer and the charge generating layer in order to improve an adhesion property of the charge generating layer and a hole injection property from the support member, and protect electrical breakdown of the charge generating layer, etc.

The undercoat layer can be formed by applying an undercoat layer coating solution obtained by dissolving a binder resin in a solvent and drying an obtained coating film.

Examples of the binder resin used in the undercoat layer can include polyvinyl alcohol, poly-N-vinylimidazole, polyethylene oxide, an ethylcellulose resin, an ethylene-acrylic acid copolymer, a casein resin, polyamide, N-methoxymethylated 6 nylon, copolymerized nylon, a phenol resin, polyurethane, an epoxy resin, an acrylic resin, a melamine resin, polyester, or the like.

Metal oxide particles may also be contained in the undercoat layer. Examples of the metal oxide particles can include particles containing titanium oxide, zinc oxide, tin oxide, zirconium oxide, and aluminum oxide. Further, the metal oxide particles may also be metal oxide particles of which surfaces are treated with a surface treating agent such as a silane coupling agent, or the like.

A film thickness of the undercoat layer is preferably 0.05 μm or more and 30 μm or less, and more preferably, 1 μm or more and 25 μm or less. The undercoat layer may also further contain organic resin fine particles and a leveling agent.

Next, the charge generating layer will be described. The charge generating layer can be formed by applying a charge generating layer coating solution obtained by dispersing a charge generating material together with a binder resin and a solvent to form a coating film, and drying the obtained coating film. Further, the charge generating layer may also be a deposition film of the charge generating material.

Examples of the charge generating material used in the charge generating layer can include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinoneimine dyes, styryl dyes, and the like. One of these charge generating materials may be used alone or two or more thereof may also be used. Among these charge generating materials, the phthalocyanine pigments or azo pigments are preferable in view of sensitivity. Particularly, the phthalocyanine pigments are more preferable.

Among the phthalocyanine pigments, particularly, oxytitanium phthalocyanine, or chlorogallium phthalocyanine, or hydroxygallium phthalocyanine exhibits excellent charge generation efficiency. Further, among the hydroxygallium phthalocyanines, in view of sensitivity, crystalline hydroxygallium phthalocyanine crystal having peaks at Bragg angles 2θ of 7.4° ±0.3° and 28.2° ±0.3° in CuKα characteristic X-ray diffraction is more preferable.

Examples of the binder resin used in the charge generating layer can include polymers of vinyl compounds such as styrene, vinyl acetate, vinyl chloride, acrylic acid ester, methacrylic acid ester, vinylidene fluoride, trifluoroethylene, and the like, polyvinyl alcohol, polyvinyl acetal, polycarbonate, polyester, polysulfone, polyphenylene oxide, polyurethane, a cellulose resin, a phenol resin, a melamine resin, a silicone resin, an epoxy resin, and the like.

It is preferable that a weight ratio of the charge generating material and the binder resin is in a range of 1:0.3 to 1:4.

A film thickness of the charge generating layer is preferably 0.05 μm or more and 1 μm or less, and more preferably 0.1 μm or more and 0.5 μm or less.

Next, the hole transport layer will be described. When the hole transport layer is the surface layer, the hole transport layer contains a polymer of the hole transport material according to the present invention as described above.

Meanwhile, in the case of installing the protective layer on the hole transport layer, the hole transport layer can be formed by forming a coating film of a hole transport layer coating solution in which the hole transport material and a binder resin are mixed with a solvent, and drying the coating film. Hereinafter, the hole transport material used in the hole transport layer having the protective layer formed thereon and the binder resin will be described.

Examples of the hole transport material can include a carbazole compound, a hydrazone compound, an N,N-dialkylaniline compound, a diphenylamine compound, a triphenylamine compound, a triphenylmethane compound, a pyrazoline compound, a styryl compound, a stilbene compound, and the like.

Examples of the binder resin can include acrylic acid ester, methacrylic acid ester, polyvinyl alcohol, polyvinyl acetal, polycarbonate, polyester, and the like. Further, a curable resin such as a curable phenol resin, a curable urethane resin, a curable melamine resin, a curable epoxy resin, a curable acrylic resin, and a curable methacrylic resin can also be used.

Examples of the solvent used in the hole transport layer coating solution can include alcohol based solvents, sulfoxide based solvents, ketone based solvents, ether based solvents, ester based solvents, aliphatic halogenated hydrocarbon based solvents, aromatic hydrocarbon based solvents, and the like.

A film thickness of the hole transport layer is preferably 1 μm or more and 100 μm or less, more preferably, 3 μm or more and 50 μm or less, and further more preferably 5 μm or more and 40 μm or less.

Various additives can be added to each of the layers of the electrophotographic photosensitive member according to the present invention. Specific examples of the additives can include organic pigments, organic dyes, coating surface conditioners, electron transport agents, oil, wax, anti-oxidants, light absorbers, polymerization initiators, radical deactivators, organic resin fine particles, inorganic particles, and the like.

A surface of each of the layers of the electrophotographic photosensitive member may be subjected to a surface processing process using a polishing sheet, a shape transfer type member, glass beads, zirconia beads, or the like. Further, unevenness may be formed on the surface using the material configuring the coating solution. In the case of applying the coating solution of each of the layers, any coating method known in the art, for example, a dip coating method, a spray coating method, a circular amount regulation (ring) type coating method, a spin coating method, a roller coating method, a Mayer bar coating method, or a blade coating method can be used.

Next, a process cartridge including the electrophotographic photosensitive member according to the present invention and an image formation process will be described.

An example of a configuration of the process cartridge according to the present invention is illustrated in FIG. 1. In FIG. 1, a cylindrical electrophotographic photosensitive member 1 is rotationally driven in an arrow direction at a predetermined peripheral speed. A peripheral surface of the rotatably driven electrophotographic photosensitive member 1 is uniformly charged to a predetermined positive or negative potential by a charging unit (charging roller, or the like) 2. Next, the charged peripheral surface of the electrophotographic photosensitive member 1 receives exposure light (image exposure light) 3 output from an exposure unit (not illustrated) such as slit exposure or laser beam scanning exposure. In this way, an electrostatic latent image corresponding to a target image is sequentially formed on the peripheral surface of the electrophotographic photosensitive member 1. As a voltage applied to the charging unit 2, any one of a voltage obtained by superimposing an alternating current (AC) component on a direct current (DC) component or a voltage having only a DC component may be used.

The electrostatic latent image formed on the peripheral surface of the electrophotographic photosensitive member 1 is developed with a toner contained in a developer of a developing unit 4 to become a toner image. Next, the toner image formed and carried on the peripheral surface of the electrophotographic photosensitive member 1 is sequentially transferred from a transfer unit (transfer roller, or the like) 5 onto a transfer material (paper, an intermediate transfer member, or the like) 6 by a transfer bias. The transfer material 6 is fed in sync with the rotation of the electrophotographic photosensitive member 1.

After transferring the toner image, the surface of the electrophotographic photosensitive member 1 is subjected to electricity removal treatment by pre-exposure light 7 from a pre-exposure unit (not illustrated), the transfer residual toner was removed by a cleaning unit 8 to clean the surface of the electrophotographic photosensitive member 1, such that the electrophotographic photosensitive member 1 is repeatedly used for image formation. Further, the pre-exposure unit may also be used before or after a cleaning process, but the pre-exposure unit is not necessarily required.

The electrophotographic photosensitive member 1 may be mounted in an electrophotographic apparatus such as a copying machine or a laser beam printer. Further, a process cartridge 9 in which two or more components of configuration components such as the electrophotographic photosensitive member 1, the charging unit 2, the developing unit 4, and the cleaning unit 8 are accommodated in a container and integrally supported may also be configured to be detachably attached to a main body of the electrophotographic apparatus. In FIG. 1, a process cartridge 9 integrally supporting the electrophotographic photosensitive member 1, the charging unit 2, the developing unit 4, and the cleaning unit 8 and detachably attached to the main body of the electrophotographic apparatus is illustrated.

Next, the electrophotographic apparatus including the electrophotographic photosensitive member according to the present invention will be described.

Figure 2:
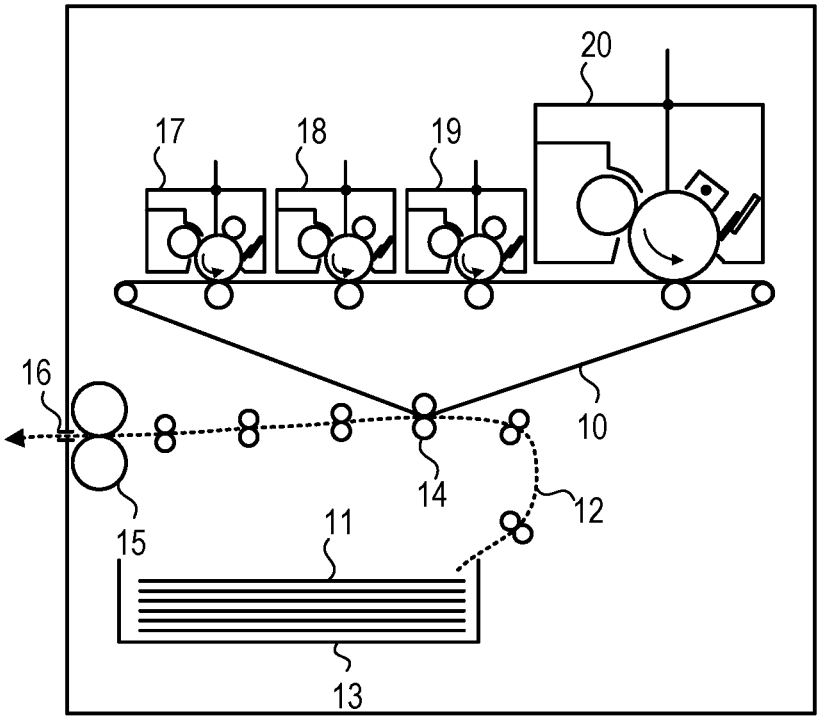
FIG. 2 is a schematic view illustrating an example of an electrophotographic apparatus having an electrophotographic photosensitive member.

An example of the electrophotographic photosensitive apparatus according to the present invention is illustrated in FIG. 2. A process cartridge 17 for a yellow color, a process cartridge 18 for a magenta color, a process cartridge 19 for a cyan color, and a process cartridge 20 for a black color, corresponding to the respective colors, i.e., the yellow color, the magenta color, the cyan color, and the black color, are installed side by side along an intermediate transfer member 10. As illustrated in FIG. 2, a diameter and constituent materials of the electrophotographic photosensitive member, a developer, a charging method, and any other unit do not necessarily need to be standardized for the respective colors. For example, in the electrophotographic apparatus of FIG. 2, the diameter of the electrophotographic photosensitive member for the black color is larger than that for any other color (yellow, magenta, or cyan). In addition, a method using corona discharge is adopted as a charging method for the black color while a method of applying a voltage obtained by superimposing an AC component on a DC component is adopted as a charging method for any other color.

When an image formation operation starts, toner images of the respective colors are sequentially superimposed on the intermediate transfer member 10 according to the image formation process described above. In tandem with the foregoing, transfer paper 11 is sent from a paper feeding tray 13 along a paper feeding path 12, and is then fed to a secondary transfer unit 14 in timing with a rotation operation of the intermediate transfer member. The toner images on the intermediate transfer member 10 are transferred onto the transfer paper 11 by a transfer bias from the secondary transfer unit 14. The toner images transferred onto the transfer paper 11 are conveyed along the paper feeding path 12, fixed on the transfer paper by a fixing unit 15, and then discharged from a paper discharging portion 16.

EXAMPLE

Hereinafter, the present invention is described in more detail through specific Examples. In addition, the term 'part(s)' in Examples means part(s) by mass. Further, an electrophotographic photosensitive member is hereinafter sometimes simply referred to as 'photosensitive member'.

<Manufacturing of Electrophotographic Photosensitive Member>

Example 1

A cylindrical aluminum cylinder having an outer diameter of 30.0 mm, a length of 357.5 mm, and a thickness of 0.7 mm was used as a support member (electroconductive support member).

Next, 10 parts of zinc oxide particles (specific surface area: 19 $m^2/g$, powder resistivity: $4.7\times10^6$ Ω·cm) were mixed with 50 parts of toluene by stirring, and 0.08 parts of a silane coupling agent were added thereto, followed by stirring for 6 hours. Thereafter, toluene was distilled and removed under reduced pressure, and the resultant was heated and dried at 130° C. for 6 hours, thereby obtaining surface treated zinc oxide particles. As the silane coupling agent, KBM602 (compound name: N-2-(aminoethyl)-3-aminopropylmethyldimethoxysilane, manufactured by Shin-Etsu Chemical Co., Ltd.) was used.

Next, 15 parts of a polyvinyl butyral resin (weight average molecular weight: 40,000, trade name: BM-1, manufactured by SEKISUI CHEMICAL Co., Ltd.) and 15 parts of a blocked isocyanate (trade name: Duranate TPA-B80E, manufactured by Asahi Kasei Chemicals Corp.) were dissolved in a mixed solution of 73.5 parts of methyl ethyl ketone and 73.5 parts of 1-butanol. After 80.8 parts of the surface treated zinc oxide particles and 0.8 parts of 2,3,4-trihydroxybenzophenone (manufactured by Wako Pure Chemical Industries, Ltd.) were added to this solution, the mixture was dispersed at 23±3° C. for 3 hours by a sand mill device using glass beads each having a diameter of 0.8 mm. After dispersion, 0.01 parts of silicone oil (trade name: SH28PA, Dow Corning Toray Co., Ltd.) and 5.6 parts of crosslinked polymethyl methacrylate (PMMA) particles (trade name: TECHPOLYMER SSX-102, manufactured by Sekisui Plastics Co., Ltd., average primary diameter: 2.5 μm) were added thereto and stirred, thereby preparing an undercoat layer coating solution.

An undercoat layer having a film thickness of 18 μm was formed by dip-coating the undercoat layer coating solution onto the support member to form a coating film, and drying the obtained coating film at 160° C. for 40 minutes.

Next, a crystalline hydroxygallium phthalocyanine crystal (charge generating material) having peaks at Bragg angles (2θ±0.2°) of 7.4° and 28.2° in CuKα characteristic X-ray diffraction was prepared. After 2 parts of this hydroxygallium phthalocyanine crystal, 0.02 parts of calixarene compound represented by the following Formula (A), 1 part of polyvinyl butyral (trade name: S-LEC BX-1, manufactured by SEKISUI CHEMICAL Co., Ltd.), and 60 parts of cyclohexanone were loaded into a sand mill using glass beads each having a diameter of 1 mm, dispersion treatment was performed thereon for 4 hours. Thereafter, 70 parts of ethyl acetate were added thereto, thereby preparing a charge generating layer coating solution. A charge generating layer having a film thickness of 0.15 μm was formed by dip-coating this charge generating layer coating solution onto the undercoat layer and drying the obtained coating film at 90° C. for 15 minutes.

(A)

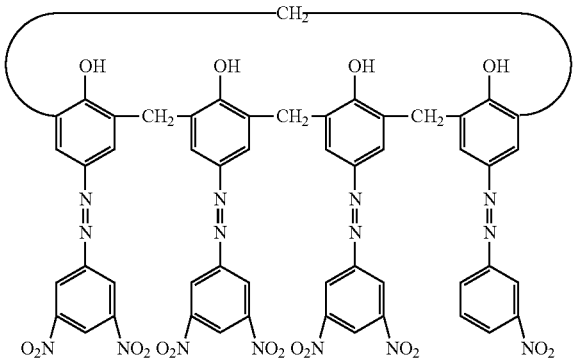

Next, 6 parts of a compound represented by the following Formula (B), 3 parts of a compound represented by the following Formula (C), 1 part of a compound represented by the following Formula (D), and 10 parts of a bisphenol Z-type polycarbonate resin (trade name: Iupilon Z400, manufactured by Mitsubishi Engineering-Plastics Corp.) were dissolved in a mixed solvent of 60 parts of monochlorobenzene and 20 parts of dimethoxymethane, thereby preparing a hole transport layer coating solution. A first hole transport layer having a film thickness of 18 m was formed by dip-coating this hole transport layer coating solution onto the charge generating layer and drying the obtained coating film at 100° C. for 50 minutes.

(B)

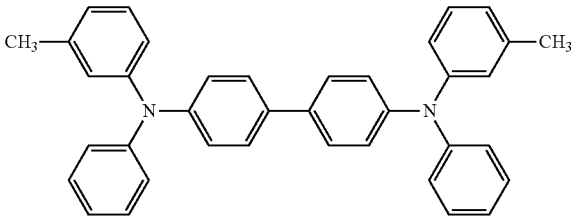

(C)

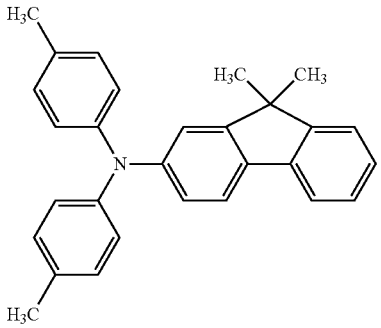

-continued (D)

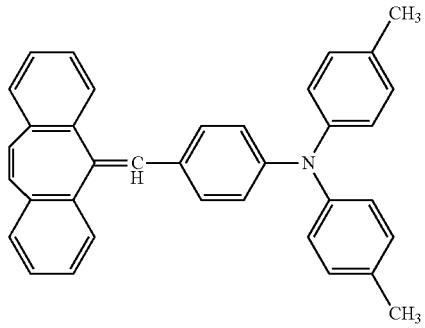

Then, 3 parts of the hole transport material represented by Exemplified Compound No. 5 and 3 parts of a hole transport material represented by the following Formula (E) were dissolved in 7 parts of 1-propanol and 7 parts of Zeorora H (manufactured by Nippon Zeon Corp.) used as solvents, thereby preparing a protective layer coating solution.

(E)

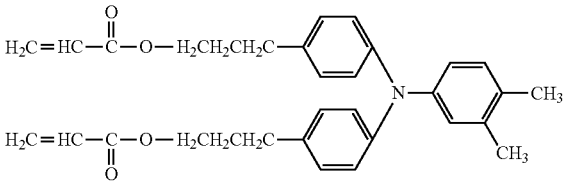

A coating film obtained by dip-coating this protective layer coating solution onto the hole transport layer was dried at 50° C. for 10 minutes, polymerization curing treatment was performed by irradiating electron beam and heating under the following conditions.

Under an atmosphere having an oxygen concentration of 100 ppm or less, the electron beam was irradiated using an electron beam irradiation apparatus under the conditions of an irradiation distance of 30 mm, an acceleration voltage of 70 kV, a beam current of 7 mA, and an irradiation time of 2.4 seconds while the aluminum cylinder was rotated at a speed of 300 rpm. After irradiating the electron beam, a temperature of a surface of the coating film of the protective layer was allowed to rapidly reach 130° C. over 20 seconds using an induction heating apparatus under the same condition of the oxygen concentration of 100 ppm or less.

Next, the aluminum cylinder was taken out under air atmosphere, and additionally heated at 100° C. for 10 minutes, thereby forming a protective layer having a film thickness of 3.5 μm. A photosensitive member 1 of Example was manufactured as described above.

Example 2

An electrophotographic photosensitive member was manufactured in the same manner as in the photosensitive member 1 of Example except that a protective layer was formed as described below. A protective layer coating solution was prepared by dissolving 3 parts of a hole transport material represented by Exemplified Compound No. 10 and 3 parts of a hole transport material represented by the following Formula (F) in 7 parts of 1-propanol and 7 parts of Zeorora H.

(F)

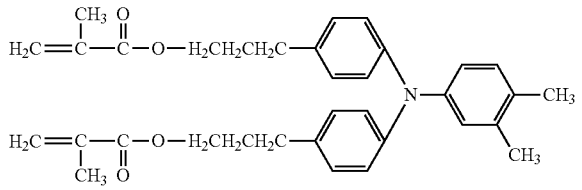

A protective layer having a film thickness of 3.5 μm was formed by dip-coating the protective layer coating solution onto the hole transport layer in the same manner as in Example 1. A photosensitive member 2 of Example was manufactured as described above.

Example 3

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 22 in 7 parts of 1-propanol and 7 parts of Zeorora H.

A protective layer having a film thickness of 3.5 μm was formed by dip-coating the protective layer coating solution onto the hole transport layer in the same manner as in Example 1. A photosensitive member 3 of Example was manufactured as described above.

Example 4

An electrophotographic photosensitive member was manufactured in the same manner as in the photosensitive member 1 of Example except that a protective layer was formed as described below. A protective layer coating solution was prepared by dissolving 4 parts of a hole transport material represented by Exemplified Compound No. 25 and 2 parts of the hole transport material represented by Formula (F) in 7 parts of 1-propanol and 7 parts of Zeorora H.

A protective layer having a film thickness of 3.5 μm was formed by dip-coating the protective layer coating solution onto the hole transport layer in the same manner as in Example 1. A photosensitive member 4 of Example was manufactured as described above.

Example 5

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 34 in 7 parts of 1-propanol and 7 parts of Zeorora H (manufactured by Nippon Zeon Corp.).

A protective layer having a film thickness of 3.5 μm was formed by dip-coating the protective layer coating solution onto the hole transport layer in the same manner as in Example 1. A photosensitive member 5 of Example was manufactured as described above.

Example 6

An aluminum cylinder similar to that used in the photosensitive member 1 of Example was used as a support member.

Next, 60 parts of $TiO_2$ particles coated with oxygen-deficient $SnO_2$ (powder resistivity: 100 Ω·cm, coverage of $SnO_2$ (mass ratio): 35%) as electroconductive particles, 36.5 parts of a phenol resin (trade name: Plyophen J-325, manufactured by DIC Corp., (Formerly, Dainippon Ink and Chemicals), resin solid content: 60%) as a binder resin, and 20 parts of methoxypropanol as a solvent were dispersed with a horizontal sand mill disperser using glass beads each having a diameter of 1 mm.

After the glass beads were removed from the dispersion with a mesh, 1.6 parts of silicone resin particles (trade name: TOSPEARL 120, manufactured by Momentive Performance Materials Inc. (Formerly, GE Toshiba Silicone Ltd.) average particle diameter: 2 μm) as a surface roughening agent and 0.008 parts of silicone oil (trade name: SH28PA, manufactured by Dow Corning Toray Co., Ltd.) as a leveling agent were added to the dispersion and stirred, thereby preparing an electroconductive layer coating solution. An average particle diameter of the $TiO_2$ particles coated with oxygen-deficient $SnO_2$ in the electroconductive layer coating solution was 0.35 μm. An electroconductive layer having a film thickness of 18 μm was formed by dip-coating the electroconductive layer coating solution onto the support member and drying and curing the resultant at 140° C. for 30 minutes.

Next, 10 parts of a methoxymethylated 6 nylon resin (trade name: TORESIN EF-30T, manufactured by Teikoku Kagaku Sangyo K.K.) were dissolved in a mixed solvent of 100 parts of methanol and 50 parts of n-butanol, thereby preparing an undercoat layer coating solution. An undercoat layer having a film thickness of 0.45 μm was formed by dip-coating the undercoat layer coating solution onto the electroconductive layer, and drying the obtained coating film at 100° C. for 30 minutes. Next, a charge generating layer and a hole transport layer were sequentially formed in the stated order in the same manner as in Example 1.

Then, a protective layer coating solution was prepared by dissolving 6 parts of a hole transport material represented by Exemplified Compound No. 36 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 6 of Example was manufactured as described above.

Example 7

An electrophotographic photosensitive member was manufactured in the same manner as in the photosensitive member 1 of Example except that a protective layer was formed as described below. A protective layer coating solution was prepared by dissolving 4 parts of a hole transport material represented by Exemplified Compound No. 36 and 2 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 7 of Example was manufactured as described above.

Example 8

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 38 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 8 of Example was manufactured as described above.

Figure 3:
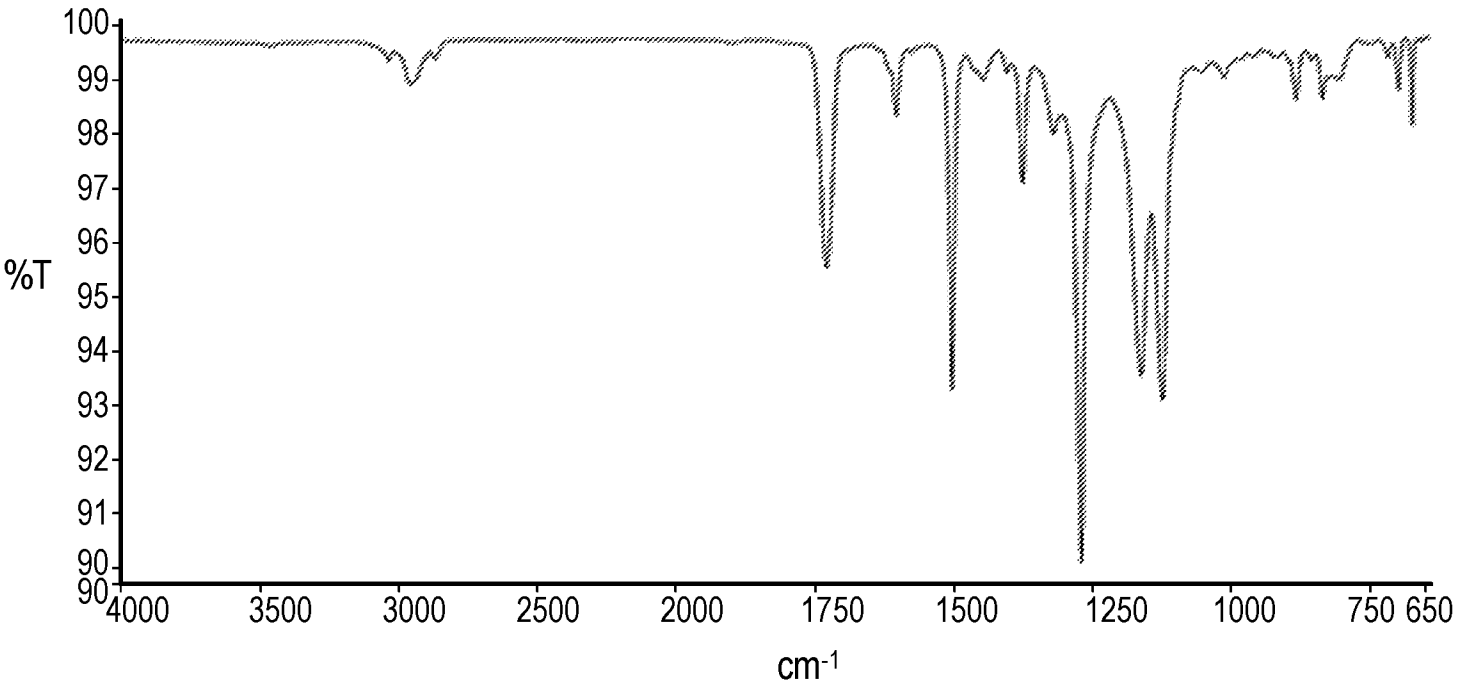
FIG. 3 is an IR spectrum of a cured film of a surface of a photosensitive member 8 of Example using a hole transport material represented by Exemplified Compound No. 38 according to an attenuated total reflection (ATR) method.

An IR spectrum of a cured film of a surface of the photosensitive member 8 of Example by an attenuated total reflection (ATR) method was measured as described below. The cured film of the photosensitive member 8 of Example was cut into a small piece using a blade of a cutter, and this small piece was delaminated. An IR spectrum in a surface layer side of the delaminated test piece was measured using an IR measurement device. As the IR measurement device, a Frontier FT-IR spectrometer (manufactured by PerkinElmer Inc.) equipped with a measurement device according to the ATR method using a germanium prism was used. The surface of the test piece was pressed against a surface of an ATR prism, the spectrum thereof was measured. The results are illustrated in FIG. 3.

Example 9

An electrophotographic photosensitive member was manufactured in the same manner as in the photosensitive member 1 of Example except that a protective layer was formed as described below. A protective layer coating solution was prepared by dissolving 3 parts of a hole transport material represented by Exemplified Compound No. 38 and 3 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 9 of Example was manufactured as described above.

Example 10

An electrophotographic photosensitive member was manufactured in the same manner as in the photosensitive member 1 of Example except that a protective layer was formed as described below.

In a mixed solvent of 45 parts of 1-propanol and 45 parts of Zeorora H, 1.5 parts of a fluorine atom-containing resin (trade name: GF-400, manufactured by Toagosei Co., Ltd.) were dissolved. Thereafter, 30 parts of ethylene fluoride resin powder (trade name: Lubron L-2, manufactured by DAIKIN INDUSTRIES, Ltd.) were added thereto, and the resultant was dispersed with a high-pressure disperser (trade name: Microfluidizer M-110EH, manufactured by Microfluidics Inc., U.S.), thereby obtaining an ethylene fluoride resin dispersion.

A protective layer coating solution was prepared by stirring and uniformly dispersing 2 parts of a hole transport material represented by Exemplified Compound No. 38, 2 parts of a hole transport material represented by Formula (E), 8 parts of the ethylene fluoride resin dispersion, and 4 parts of 1-propanol and 4 parts of Zeorora H. A protective layer having a film thickness of 3.5 μm was formed by dip-coating the protective layer coating solution onto the hole transport layer in the same manner as in Example 1. A photosensitive member 10 of Example was manufactured as described above.

Example 11

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 41 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 11 of Example was manufactured as described above.

Example 12

An electrophotographic photosensitive member was manufactured in the same manner as in the photosensitive member 1 of Example except that a protective layer was formed as described below. A protective layer coating solution was prepared by dissolving 4 parts of a hole transport material represented by Exemplified Compound No. 41 and 2 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 12 of Example was manufactured as described above.

Example 13

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 44 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 13 of Example was manufactured as described above.

Figure 4:
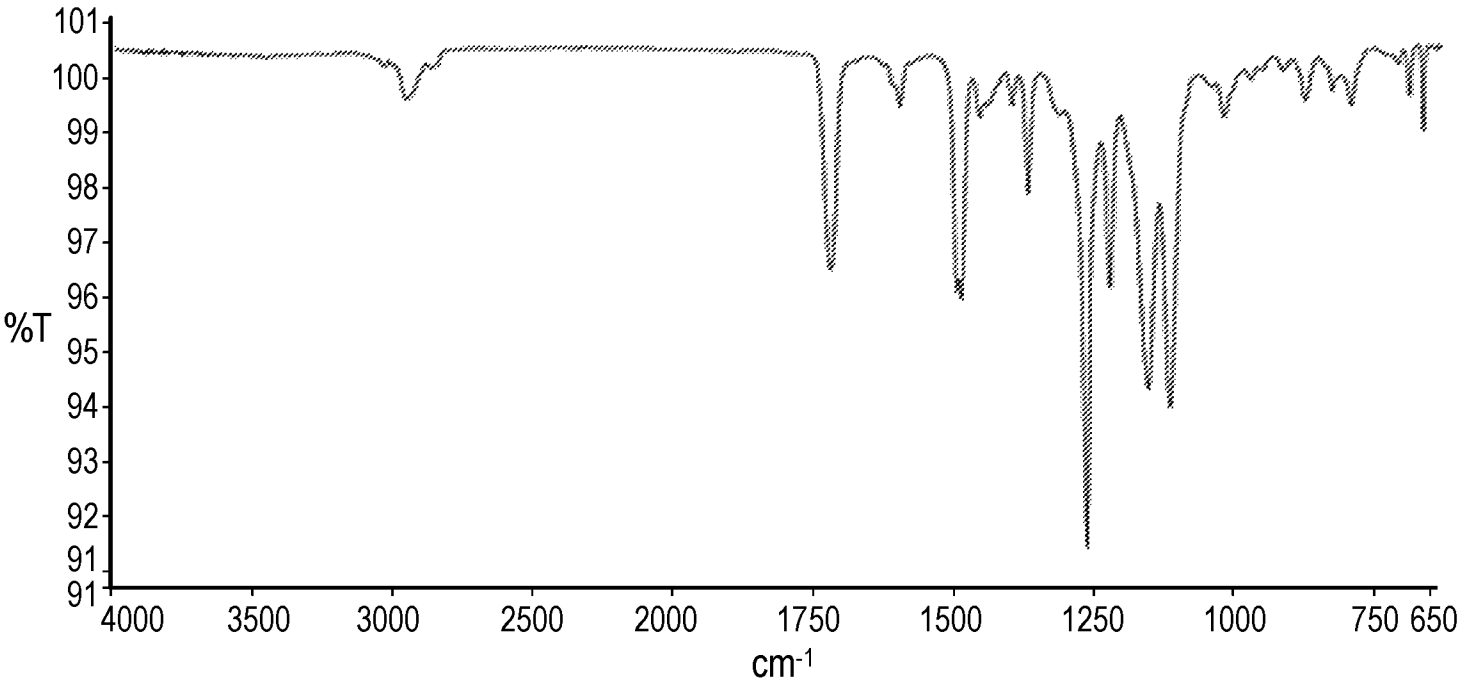
FIG. 4 is an IR spectrum of a cured film of a surface of a photosensitive member 13 of Example using a hole transport material represented by Exemplified Compound No. 44 according to an ATR method.

An IR spectrum of a cured film of a surface of the photosensitive member 13 of Example by an attenuated total reflection (ATR) method was measured in the same manner as in Example 8. The results are illustrated in FIG. 4.

Example 14

An electrophotographic photosensitive member was manufactured in the same manner as in the photosensitive member 1 of Example except that a protective layer was formed as described below. A protective layer coating solution was prepared by dissolving 4 parts of a hole transport material represented by Exemplified Compound No. 44 and 2 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 14 of Example was manufactured as described above.

Example 15

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 47 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 15 of Example was manufactured as described above.

Example 16

An electrophotographic photosensitive member was manufactured in the same manner as in the photosensitive member 1 of Example except that a protective layer was formed as described below. A protective layer coating solution was prepared by dissolving 4 parts of a hole transport material represented by Exemplified Compound No. 47 and 2 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 16 of Example was manufactured as described above.

Example 17

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 59 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 17 of Example was manufactured as described above.

Example 18

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 63 in 7 parts of 1-propanol and 7 parts of Zeorora H. A protective layer having a film thickness of 3.5 m was formed by dip-coating the protective layer coating solution onto the hole transport layer in the same manner as in Example 1. A photosensitive member 18 of Example was manufactured as described above.

Example 19

An electrophotographic photosensitive member was manufactured in the same manner as in the photosensitive member 1 of Example except that a protective layer was formed as described below. A protective layer coating solution was prepared by dissolving 6 parts of a hole transport material represented by Exemplified Compound No. 84 in 7 parts of 1-propanol and 7 parts of Zeorora H. A protective layer having a film thickness of 3.5 m was formed by dip-coating the protective layer coating solution onto the hole transport layer in the same manner as in Example 1. A photosensitive member 19 of Example was manufactured as described above.

Example 20

An electrophotographic photosensitive member was manufactured in the same manner as in the photosensitive member 1 of Example except that a protective layer was formed as described below. After mixing 4.8 parts of a hole transport material represented by Exemplified Compound No. 28 and 1.2 parts of an acrylic compound which does not have a hole transport structure, represented by the following Formula (G),

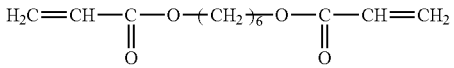

(G)

and 0.06 parts of a siloxane modified acrylic compound represented by the following Formula (H), 7 parts of 1-propanol, and 7 parts of Zeorora H, the mixture was stirred and dissolved.

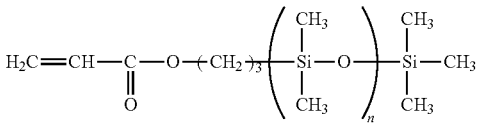

(H)

Therefore, this solution was filtered using a membrane filter, thereby preparing a surface layer coating solution. A protective layer having a film thickness of 3.5 μm was formed by dip-coating the surface layer coating solution onto the hole transport layer in the same manner as in Example 1. A photosensitive member 20 of Example was manufactured as described above.

Example 21

An undercoat layer similar to that in Example 1 was formed on an aluminum cylinder similar to that in Example 1.

Next, a crystalline oxytitanium phthalocyanine crystal (charge generating material) having a peak at a Bragg angle (2θ±0.2°) of 27.2° in CuKα characteristic X-ray diffraction was prepared. After 2 parts of the oxytitanium phthalocyanine crystal, 1 part of polyvinyl butyral (trade name: S-LEC BM-S, manufactured by SEKISUI CHEMICAL Co., Ltd.) and 50 parts of cyclohexane were put into a sand mill using glass beads each having a diameter of 1 mm, dispersion was performed for 4 hours. Thereafter, 40 parts of ethyl acetate was added thereto, thereby preparing a charge generating layer coating solution. A charge generating layer having a film thickness of 0.18 μm was formed by dip-coating this charge generating layer coating solution onto the undercoat layer and drying the obtained coating film at 80° C. for 10 minutes.

A charge transport layer similar to that in Example 1 was formed on the charge generating layer.

Next, 5.4 parts of a hole transport material represented by Exemplified Compound No. 38, 0.3 parts of 1-hydroxycyclohexyl phenyl ketone as a photopolymerization initiator, 2.4 parts of the ethylene fluoride resin dispersion prepared in Example 10, 6 parts of 1-propanol, and 6 parts of Zeorora H were mixed with each other, stirred, and uniformly dispersed, thereby preparing a protective layer coating solution. The protective layer coating solution was dip-coated on the hole transport layer, and a coating film was dried at 45° C. for 10 minutes, and then photo-cured under the following conditions.

Under an atmosphere having an oxygen concentration of 6000 to 8000 ppm, the aluminum cylinder having the coating film of the protective layer coating solution was rotated at a speed of 100 rpm, light was irradiated using a metal halide lamp having an output of 160 W/cm$^2$ under the conditions of an irradiation distance of 100 mm, an irradiation intensity of 600 mW/cm$^2$, and an irradiation time of 2 minutes. After irradiating the light, heating was performed thereon at 135° C. for 30 minutes, thereby forming a protective layer having a film thickness of 3.5 μm. A photosensitive member 21 of Example was manufactured as described above.

Example 22

An electrophotographic photosensitive member was manufactured in the same manner as in the photosensitive member 21 of Example except that a protective layer was formed as described below.

After 2.7 parts of a hole transport material represented by Exemplified Compound No. 38, 2.7 parts of a hole transport material represented by Formula (E), 0.3 parts of 1-hydroxycyclohexyl phenyl ketone as a photopolymerization initiator, 2.4 parts of the ethylene fluoride resin dispersion prepared in Example 10, 6 parts of 1-propanol, and 6 parts of Zeorora H were mixed with each other, coating, drying, and photocuring were performed under conditions similar to those in Example 21. A protective layer having a film thickness of 3.51 μm was formed by heating the resultant in the same manner as in Example 21. A photosensitive member 22 of Example was manufactured as described above.

Example 23

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by Exemplified Compound No. 108, 2 parts of trimethylol propane triacrylate (TMPTA, manufactured by Tokyo Chemical Industry Co., Ltd.), 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 23 of Example was manufactured as described above.

Example 24

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by Exemplified Compound No. 121, 2 parts of a hole transport material represented by Formula (F), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 24 of Example was manufactured as described above.

Example 25

An electrophotographic photosensitive member was manufactured in the same manner as in the photosensitive member 1 of Example except that a protective layer was formed as described below. A protective layer coating solution was prepared by dissolving 2 parts of a hole transport material represented by Exemplified Compound No. 125 and 4 parts of the hole transport material represented by Formula (E) in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 25 of Example was manufactured as described above.

Example 26

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by Exemplified Compound No. 127, 2 parts of a hole transport material represented by Formula (E), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 26 of Example was manufactured as described above.

Example 27

An electrophotographic photosensitive member was manufactured in the same manner as in the photosensitive member 1 of Example except that a protective layer was formed as described below. A protective layer coating solution was prepared by stirring and uniformly dispersing 1.5 parts of a hole transport material represented by Exemplified Compound No. 133, 2.5 parts of a hole transport material represented by Formula (E), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 27 of Example was manufactured as described above.

Example 28

An electrophotographic photosensitive member was manufactured in the same manner as in the photosensitive member 1 of Example except that a protective layer was formed as described below. A protective layer coating solution was prepared by stirring and uniformly dispersing 2.5 parts of a hole transport material represented by Exemplified Compound No. 138, 1.5 parts of a hole transport material represented by Formula (E), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 28 of Example was manufactured as described above.

Example 29

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by Exemplified Compound No. 141, 2 parts of a hole transport material represented by Formula (E), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 29 of Example was manufactured as described above.

Example 30

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by Exemplified

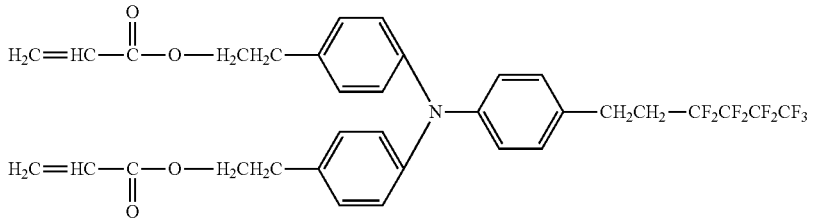

Compound No. 146, 2 parts of a hole transport material represented by Formula (E), and 8 parts of the ethylene fluoride resin dispersion prepared in Example 10, 4 parts of 1-propanol, and 4 parts of Zeorora H. A protective layer having a film thickness of 3.5 μm was formed by dip-coating the protective layer coating solution onto the hole transport layer in the same manner as in Example 1. A photosensitive member 30 of Example was manufactured as described above.

Comparative Example 1

An electrophotographic photosensitive member was manufactured in the same manner as in the photosensitive member 1 of Example except that a protective layer was formed as described below. A protective layer coating solution was prepared by dissolving 6 parts of a hole transport material represented by the following Comparative Compound No. 1 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 1 of Comparative Example was manufactured as described above.

Comprarative Compound No. 1

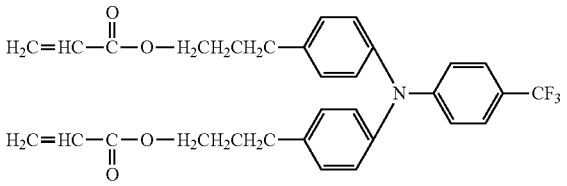

Comparative Example 2

An electrophotographic photosensitive member was manufactured in the same manner as in the photosensitive member 1 of Example except that a protective layer was formed as described below. A protective layer coating solution was prepared by dissolving 6 parts of a hole transport material represented by the following Comparative Compound No. 2 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 2 of Comparative Example was manufactured as described above.

Comprarative Compound No. 2

Comparative Example 3

An electrophotographic photosensitive member was manufactured in the same manner as in the photosensitive member 1 of Example except that a protective layer was formed as described below. A protective layer coating solution was prepared by dissolving 6 parts of a hole transport material represented by the following Comparative Compound No. 3 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 3 of Comparative Example was manufactured as described above.

Comparative Compound No. 3

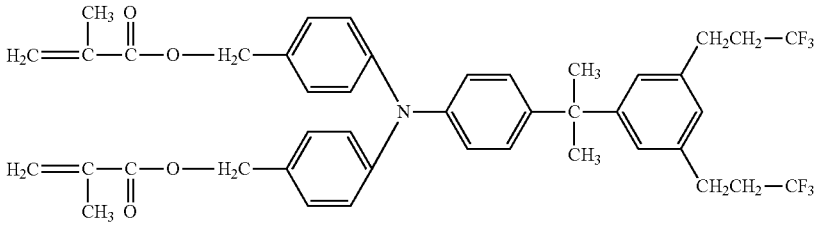

Comparative Example 4

An electrophotographic photosensitive member was manufactured in the same manner as in the photosensitive member 1 of Example except that a protective layer was formed as described below. A protective layer coating solution was prepared by dissolving 6 parts of a hole transport material represented by the following Comparative Compound No. 4 in 7 parts of 1-propanol and 7 parts of Zeorora H. A protective layer having a film thickness of 3.5p m was formed by dip-coating the protective layer coating solution onto the hole transport layer in the same manner as in Example 1. A photosensitive member 4 of Comparative Example was manufactured as described above.

Comprarative Compound No. 4

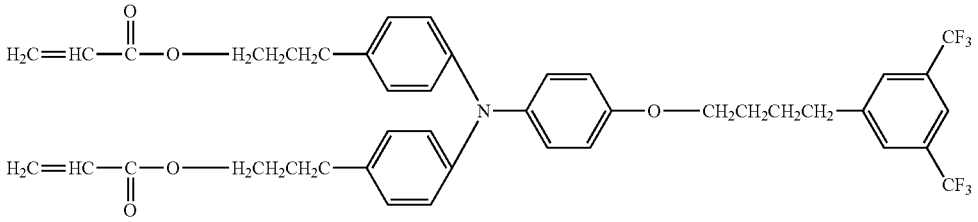

Comparative Example 5

An electrophotographic photosensitive member was manufactured in the same manner as in the photosensitive member 1 of Example except that a protective layer was formed as described below. A protective layer coating solution was prepared by dissolving 6 parts of a hole transport material represented by the following Comparative Compound No. 5 in 7 parts of 1-propanol and 7 parts of Zeorora H. A protective layer having a film thickness of 3.5 μm was formed by dip-coating the protective layer coating solution onto the hole transport layer in the same manner as in Example 1. A photosensitive member 5 of Comparative Example was manufactured as described above.

Comprarative Compound No. 5

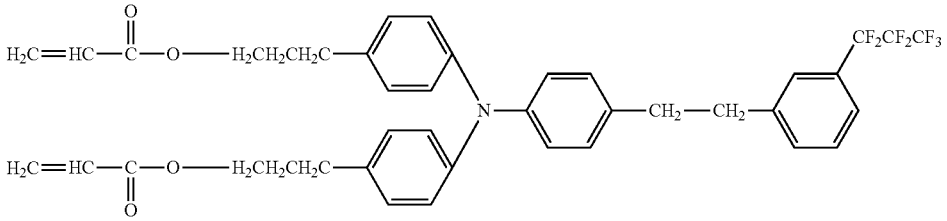

Comparative Example 6

An electrophotographic photosensitive member was manufactured in the same manner as in the photosensitive member 1 of Example except that a protective layer was formed as described below. A protective layer coating solution was prepared by dissolving 4 parts of a hole transport material represented by the following Comparative Compound No. 6 and 2 parts of an acrylic compound which does not have a hole transport structure, represented by Formula (G), in 7 parts of 1-propanol and 7 parts of Zeorora H. A protective layer having a film thickness of 3.5 m was formed by dip-coating the protective layer coating solution onto the hole transport layer in the same manner as in Example 1. A photosensitive member 6 of Comparative Example was manufactured as described above.

Comparative Compound No. 6

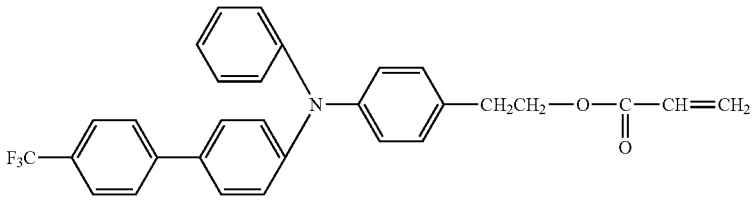

Comparative Example 7

An electrophotographic photosensitive member was manufactured in the same manner as in the photosensitive member 21 of Example except that a protective layer was formed as described below. A protective layer was formed using 5.4 parts of a hole transport material represented by Comparative Compound No. 2 instead of the hole transport material used in the protective layer in Example 21. A protective layer having a film thickness of 3.5 μm was formed in the same manner as in Example 21. A photosensitive member 7 of Comparative Example was manufactured as described above.

Comparative Example 8

An electrophotographic photosensitive member was manufactured in the same manner as in the photosensitive member 1 of Example except that a protective layer was formed as described below. A protective layer coating solution was prepared by stirring and uniformly dispersing 2 parts of a hole transport material represented by the following Comparative Compound No. 7, 2 parts of trimethylol propane triacrylate (TMPTA, manufactured by Tokyo Chemical Industry Co., Ltd.), 8 parts of the ethylene fluoride resin dispersion prepared in Example 10, 4 parts of 1-propanol, and 4 parts of Zeorora H. A protective layer having a film thickness of 3.5 m was formed by dip-coating the protective layer coating solution onto the hole transport layer in the same manner as in Example 1. A photosensitive member 8 of Comparative Example was manufactured as described above.

Comparative Compound No. 7

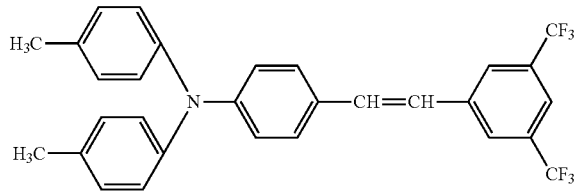

<Evaluation: Initial Sensitivity and Residual Potential>

Evaluation of Sensitivity and endurance potential variation in a low humidity environment was performed on the manufactured photosensitive members 1 to 30 of Examples and photosensitive members 1 to 8 of Comparative Examples under the following Conditions.

A photosensitive member testing apparatus (trade name: CYNTHIA 59, manufactured by GENTEC Co., Ltd.) was used. First, a condition for a charging device was set so that a surface potential of the electrophotographic photosensitive member became −700 V under an environment having a temperature of 23° C. and a relative humidity (RH) of 50%. The photosensitive member was irradiated with monochromatic light having a wavelength of 780 nm, and a light quantity required to decrease the potential of −700 V to −200 V was measured and defined as sensitivity (μJ/cm$^2$). Further, the potential of the photosensitive member when the photosensitive member was irradiated with light quantity of 20 (μJ/cm$^2$) was measured and defined as a residual potential (−V).

<Evaluation: Evaluation of Image Deletion>

Image deletion was evaluated using the manufactured photosensitive members 1 to 30 of Examples and photosensitive members 1 to 8 of Comparative Examples under the following conditions.

A reconstructed machine of a copying machine (trade name: iR-C3380F, manufactured by Canon Inc.) was used as an electrophotographic apparatus. With regard to reconstructed points, the machine was reconstructed so that image exposure laser power, an amount of a current flowing from a charging roller to a support member of an electrophotographic photosensitive member (hereinafter, referred to as a 'total current'), and a voltage to be applied to the charging roller could be adjusted and measured. Further, a cassette heater was removed.

First, after the electrophotographic apparatus and the electrophotographic photosensitive members were kept to stand in an environment having a temperature of 30° C. and a relative humidity (RH) of 80% for 24 hours or more, each of the electrophotographic photosensitive members of Examples and Comparative Examples was mounted onto a cartridge for a cyan color of the electrophotographic apparatus.

Next, a solid image was output on A4 size plain paper with a cyan color alone, and an image exposure light quantity was set so that a density on the paper measured with a spectral densitometer (trade name: X-rite 504, manufactured by X-rite Inc.) became 1.45.

Next, the applied voltage was applied while being changed from −400V to −2000V by an interval of 100V, and a total current at each of the applied voltages was measured. Then, a graph whose X and Y axes indicate the applied voltage and the total current, respectively, was created, and the applied voltage at which a current component (hereinafter, sometimes referred to as a 'discharge current') diverging from a first-order approximation curve in the applied voltage from −400V to −800V became 100 μA was measured. The total current was set to a total current value at the applied voltage at which the discharge current became 100 μA.

Next, an A4 size square lattice image having a line width of 0.1 mm and a line interval of 10 mm was read with a scanner and continuously output on 5,000 sheets with a cyan color alone. After outputting the image, a main power source of the electrophotographic apparatus was turned off and the electrophotographic apparatus was kept to stand for 3 days. After the standing, the main power source of the electrophotographic apparatus was turned on. Then, immediately, the square lattice image was similarly output on 1 sheet, image deletion of the output image was observed by the naked eyes, and the image deletion was evaluated by the following criteria.

Evaluation ranks were as described below.

Rank 5: No anomaly is confirmed in the lattice image.

Rank 4: A horizontal line of the lattice image is broken but no anomaly is confirmed in a vertical line thereof.

Rank 3: A horizontal line of the lattice image disappears but no anomaly is confirmed in a vertical line thereof.

Rank 2: A horizontal line of the lattice image disappears and a vertical line thereof is broken.

Rank 1: A horizontal line of the lattice image disappears and a vertical line thereof also disappears Here, the horizontal line of the lattice image refers to a line parallel to a cylinder axis direction of the photosensitive member and the vertical line thereof refers to a line vertical to the cylinder axis direction of the photosensitive member.

<Evaluation: Evaluation of Potential Variation and Abrasion Amount in Long-Term Use Under Low Humidity Environment>

Endurance potential variations and abrasion amounts of the protective layers in a low humidity environment were evaluated using the prepared photosensitive members 1 to 30 of Examples and the prepared photosensitive members 1 to 8 of Comparative Examples under the following conditions.

A reconstructed machine of a copying machine (iR ADVANCE C5051F, manufactured by Canon Inc.) was used as an electrophotographic apparatus. With regard to a reconstructed point, the machine was reconstructed so that image exposure laser power could be adjusted.

First, the film thickness of the protective layer of each of the electrophotographic photosensitive members before 50,000-sheet output was measured with an interference film thickness measuring instrument (trade name: MCPD-3700, manufactured by Otsuka Electronics Co., Ltd.).

After the electrophotographic apparatus and each of the electrophotographic photosensitive members were kept to stand in an environment having a temperature of 23° C. and a relative humidity (RH) of 5% for 24 hours or more, each of the electrophotographic photosensitive members was mounted onto a cartridge for a cyan color of the electrophotographic apparatus. First, a condition for a charging device was set so that an initial surface potential of the electrophotographic photosensitive member became −700V. Here, setting for a light quantity required to decrease the potential of −700V to −200V by adjusting image exposure laser power was recorded.

Next, a halftone image was output on A4 size plain paper with a cyan color alone, an image exposure laser power was set so that a density of eh output image measured with a spectral densitometer (trade name: X-rite 504, manufactured by X-rite Inc.) became 0.85, and the halftone image was continuously output on 50,000 sheets.

Thereafter, the condition for the charging device was set so that the surface potential of the electrophotographic photosensitive member became −700V, and a surface potential when image exposure laser power was re-adjusted to the initially recorded image exposure laser power was read. An increase or decrease amount of an absolute value of the potential was measured as an endurance potential variation.

Next, the electrophotographic photosensitive member was taken out from the electrophotographic apparatus, the film thickness of the protective layer after 50,000-sheet output was measured, and a difference between the film thicknesses of the protective layer before and after the 50,000-sheet output (i.e., an abrasion amount) was calculated. The evaluation results are illustrated in Table 1.

TABLE 1

| | | Evaluation Results of Photosensitive Member | | | | |
|---|---|---|---|---|---|---|
| | Hole Transport Material in Surface Layer | Sensitivity [μJ/cm$^2$] | Residual Potential [−V] | Endurance Potential Variation [V] | Image Deletion [rank] | Abrasion Amount [μm] |
| Example 1 | Mixture of Exemplified Compound No. 5 and Formula (E) | 0.27 | 24 | 26 | 5 | 0.6 |
| Example 2 | Mixture of Exemplified Compound No. 10 and Formula (F) | 0.27 | 26 | 25 | 5 | 0.6 |
| Example 3 | Exemplified Compound No. 22 | 0.28 | 35 | 25 | 4 | 0.3 |
| Example 4 | Mixture of Exemplified Compound No. 25 and Formula (F) | 0.27 | 26 | 30 | 4 | 0.4 |
| Example 5 | Exemplified Compound No. 34 | 0.29 | 35 | 31 | 5 | 0.3 |
| Example 6 | Exemplified Compound No. 36 | 0.27 | 24 | 26 | 4 | 0.4 |
| Example 7 | Mixture of Exemplified Compound No. 36 and Formula (E) | 0.27 | 23 | 24 | 4 | 0.3 |
| Example 8 | Exemplified Compound No. 38 | 0.28 | 32 | 22 | 5 | 0.4 |

TABLE 1-continued

| | Hole Transport Material in Surface Layer | Evaluation Results of Photosensitive Member | | | | |
|---|---|---|---|---|---|---|
| | | Sensitivity [μJ/cm$^2$] | Residual Potential [−V] | Endurance Potential Variation [V] | Image Deletion [rank] | Abrasion Amount [μm] |
| Example 9 | Mixture of Exemplified Compound No. 38 and Formula (E) | 0.27 | 28 | 25 | 5 | 0.3 |
| Example 10 | Mixture of Exemplified Compound No. 38 and Formula (E) | 0.27 | 30 | 23 | 5 | 0.5 |
| Example 11 | Exemplified Compound No. 41 | 0.28 | 29 | 25 | 5 | 0.4 |
| Example 12 | Mixture of Exemplified Compound No. 41 and Formula (E) | 0.27 | 26 | 25 | 5 | 0.3 |
| Example 13 | Exemplified Compound No. 44 | 0.28 | 26 | 24 | 5 | 0.5 |
| Example 14 | Mixture of Exemplified Compound No. 44 and Formula (E) | 0.27 | 24 | 22 | 5 | 0.4 |
| Example 15 | Exemplified Compound No. 47 | 0.28 | 25 | 23 | 5 | 0.3 |
| Example 16 | Mixture of Exemplified Compound No. 47 and Formula (E) | 0.27 | 24 | 22 | 5 | 0.2 |
| Example 17 | Exemplified Compound No. 59 | 0.28 | 31 | 26 | 4 | 0.4 |
| Example 18 | Exemplified Compound No. 63 | 0.30 | 28 | 27 | 4 | 0.5 |
| Example 19 | Exemplified Compound No. 84 | 0.29 | 32 | 28 | 4 | 0.5 |
| Example 20 | Mixture of Exemplified Compound No. 28 and Formula (G, H) | 0.30 | 34 | 30 | 4 | 0.3 |
| Example 21 | Exemplified Compound No. 38 | 0.27 | 38 | 36 | 5 | 0.4 |
| Example 22 | Mixture of Exemplified Compound No. 38 and Formula (E) | 0.27 | 34 | 33 | 5 | 0.3 |
| Example 23 | Mixture of Exemplified Compound No. 108 and TMPTA | 0.30 | 36 | 38 | 5 | 0.3 |
| Example 24 | Mixture of Exemplified Compound No. 121 and Formula (F) | 0.28 | 30 | 29 | 4 | 0.6 |
| Example 25 | Mixture of Exemplified Compound No. 125 and Formula (E) | 0.27 | 26 | 25 | 5 | 0.4 |
| Example 26 | Mixture of Exemplified Compound No. 127 and Formula (E) | 0.27 | 25 | 23 | 4 | 0.4 |
| Example 27 | Mixture of Exemplified Compound No. 133 and Formula (E) | 0.27 | 32 | 30 | 5 | 0.5 |
| Example 28 | Mixture of Exemplified Compound No. 138 and Formula (E) | 0.28 | 34 | 33 | 4 | 0.5 |
| Example 29 | Mixture of Exemplified Compound No. 141 and Formula (E) | 0.27 | 26 | 29 | 4 | 0.6 |
| Example 30 | Mixture of Exemplified Compound No. 146 and Formula (E) | 0.27 | 29 | 35 | 4 | 0.6 |
| Comparative Example 1 | Comparative Compound No. 1 | 0.46 | 144 | Measurement was impossible | Measurement was impossible | 0.6 |
| Comparative Example 2 | Comparative Compound No. 2 | 0.34 | 40 | 132 | 2 | 0.8 |
| Comparative Example 3 | Comparative Compound No. 3 | 0.35 | 61 | 98 | 2 | 0.8 |
| Comparative Example 4 | Comparative Compound No. 4 | 0.46 | 163 | 88 | 1 | 1.1 |
| Comparative Example 5 | Comparative Compound No. 5 | 0.43 | 91 | 90 | 3 | 0.7 |
| Comparative Example 6 | Mixture of Comparative Compound No. 6 and Formula (G) | 0.36 | 108 | 110 | 3 | 0.6 |

TABLE 1-continued

| | Hole Transport Material in Surface Layer | Evaluation Results of Photosensitive Member | | | | |
|---|---|---|---|---|---|---|
| | | Sensitivity [μJ/cm²] | Residual Potential [−V] | Endurance Potential Variation [V] | Image Deletion [rank] | Abrasion Amount [μm] |
| Comparative Example 7 | Comparative Compound No. 2 | 0.35 | 66 | 91 | 2 | 0.8 |
| Comparative Example 8 | Mixture of Comparative Compound No. 7 and TMPTA | 0.36 | 122 | 83 | 2 | 2.2 |

Further, in Table 1, the term 'Formula (E)' indicates the hole transport material represented by Formula (E), and the term 'Formula (F)' indicates the hole transport material represented by Formula (F). The term 'Formula (G, H)' indicates the acrylic compound which does not have a hole transport structure, represented by Formula (G), and the siloxane modified acrylic compound represented by Formula (H), and the term 'Formula (G)' indicates the acrylic compound which does not have a hole transport structure, represented by Formula (G).

As can be seen from the results of Table 1, the electrophotographic photosensitive member according to the present invention has good electrical properties and durability. In view of suppression of image deletion, the photosensitive members of Examples had better performance than the photosensitive members of Comparative Examples.

As described above, according to the present invention, an electrophotographic photosensitive member capable of having good electrical properties and durability and suppressing image deletion, and an electrophotographic apparatus and a process cartridge having the electrophotographic photosensitive member can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An electrophotographic photosensitive member, comprising a support member bearing a photosensitive layer, said electrophotographic photosensitive member having a surface layer comprising a polymerization product of a hole transporting compound represented by Formula (1)

(1)

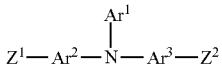

where $Ar^1$ is a substituted or unsubstituted aryl group; $Ar^2$ and $Ar^3$ are independently a substituted or unsubstituted arylene group; $Ar^1$ to $Ar^3$ do not have a fluorine atom; substituents of the aryl group or arylene groups of $Ar^1$ to $Ar^3$ are selected from the group consisting of $C_{1-6}$ alkyl, $C_{1-6}$ alkoxy, and a monovalent group having a polymerizable functional group, and at least one of the aryl group or arylene groups of $Ar^1$ to $Ar^3$ has the monovalent group having the polymerizable functional group; $Z^1$ is a monovalent group represented by Formula (2) or a monovalent group represented by Formula (3); $Z^2$ is a hydrogen atom, a monovalent group represented by Formula (2), or a monovalent group represented by Formula (3); and when $Z^1$ and $Z^2$ are the monovalent groups represented by Formula (2), or when $Z^1$ and $Z^2$ are the monovalent groups represented by Formula (3), $Z^1$ and $Z^2$ may be the same or different from each other), (2)

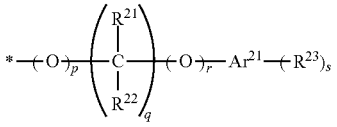

where * is a bonding position of the substituent bonded to $Ar^2$ or $Ar^3$; $R^{21}$ and $R^{22}$ are independently a hydrogen atom or $C_{1-4}$ alkyl; p is 0 or 1; q is an integer of 1 to 4; r is 0 or 1; p, q, and r satisfy $2 \leq p+q+r \leq 4$; $R_{21}$ may be the same or different and $R_{22}$ may be the same or different when q is 2 or more; $Ar^{21}$ is an (s+1) valent group derived by removing (s+1) hydrogen atoms from substituted or unsubstituted arene; $R^{23}$ is a fluorine atom, a $C_1$ or $C_2$ alkyl having a fluorine atom as a substituent, or a methoxy group having a fluorine atom as a substituent; s is the number of $R^{23}$s directly bonded to $Ar^{21}$ and is an integer of 1 to 5; and $R^{23}$s may be the same or different when s is 2 or more, (3)

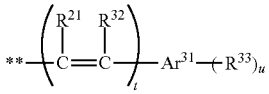

where ** is a bonding position of the substituent bonded to $Ar^2$ or $Ar^3$; $R^{31}$ and $R^{32}$ are independently a hydrogen atom or $C_{1-4}$ alkyl; t is an integer of 1 to 3; $R^{31}$ may be the same or different and $R^{32}$ may be the same or different when t is 2 or more; $Ar^{31}$ is a (u+1) valent group derived by removing (u+1) hydrogen atoms from substituted or unsubstituted arene; $R^{33}$ is a fluorine atom, $C_{1-4}$ alkyl having a fluorine atom as a substituent, or $C_{1-3}$ alkoxy having a fluorine atom as a substituent; u is the number of $R^{33}$s directly bonded to $Ar^{31}$ and is an integer of 1 to 5; and $R^{33}$s may be the same or different when u is 2 or more.

2. The electrophotographic photosensitive member of claim 1, wherein the monovalent group having the polymerizable functional group is represented by Formula (4)

(4)

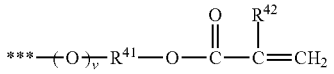

where *** is a bonding position of the substituent bonded to any one of $Ar^1$ to $Ar^3$; $R^{41}$ is a single bond or $C_{1-6}$ alkylene; $R^{42}$ is a hydrogen atom or a methyl group; v is 0 or 1; and $R^{41}$ is not a single bond when v is 1.

3. The electrophotographic photosensitive member of claim 1, wherein $Ar^1$ is a substituted or unsubstituted phenyl group.

4. The electrophotographic photosensitive member of claim 1, wherein $Ar^2$ is a substituted or unsubstituted phenylene group.

5. The electrophotographic photosensitive member of claim 1, wherein $Ar^3$ is a substituted or unsubstituted phenylene group.

6. The electrophotographic photosensitive member of claim 1, wherein $Z^1$ is a monovalent group represented by Formula (2) and $Z^2$ is a hydrogen atom.

7. The electrophotographic photosensitive member of claim 6, wherein $Ar^{21}$ is a (s+1) valent group derived by removing (s+1) hydrogen atoms from benzene.

8. The electrophotographic photosensitive member of claim 6, wherein at least one $R^{23}$ is a trifluoromethyl group.

9. The electrophotographic photosensitive member of claim 8, wherein s is 2, and $R^{23}$ are both trifluoromethyl groups.

10. The electrophotographic photosensitive member of claim 6, wherein r is 0.

11. The electrophotographic photosensitive member of claim 1, wherein $Z^1$ is a monovalent group represented by Formula (3) and $Z^2$ is a hydrogen atom.

12. The electrophotographic photosensitive member of claim 11, wherein $Ar^{31}$ is a (u+1) valent group derived by removing (u+1) hydrogen atoms from benzene.

13. The electrophotographic photosensitive member of claim 11, wherein at least one $R^{33}$ is a trifluoromethyl group.

14. The electrophotographic photosensitive member of claim 13, wherein u is 1 or 2, and all $R^{33}$s are trifluoromethyl groups.

15. An electrophotographic apparatus comprising an electrophotographic photosensitive member, a charging unit, an exposure unit, a developing unit and a transfer unit, the electrophotographic photosensitive member comprising a support member bearing a photosensitive layer, said electrophotographic photosensitive member having a surface layer comprising a polymerization product of a hole transporting compound represented by Formula (1)

(1)

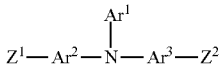

where $Ar^1$ is a substituted or unsubstituted aryl group; $Ar^2$ and $Ar^3$ are independently a substituted or unsubstituted arylene group; $Ar^1$ to $Ar^3$ do not have a fluorine atom; substituents of the aryl group or arylene groups of $Ar^1$ to $Ar^3$ are selected from the group consisting of $C_{1-6}$ alkyl, $C_{1-6}$ alkoxy, and a monovalent group having a polymerizable functional group, and at least one of the aryl group or arylene groups of $Ar^1$ to $Ar^3$ has the monovalent group having the polymerizable functional group; $Z^1$ is a monovalent group represented by Formula (2) or a monovalent group represented by Formula (3); $Z^2$ is a hydrogen atom, a monovalent group represented by Formula (2), or a monovalent group represented by Formula (3); and when $Z^1$ and $Z^2$ are the monovalent groups represented by Formula (2)or when $Z^1$ and $Z^2$ are the monovalent groups represented by Formula (3), $Z^1$ and $Z^2$ may be the same or different from each other, (2)

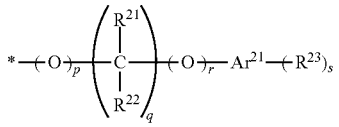

where * is a bonding position of the substituent bonded to $Ar^2$ or $Ar^3$; $R^{21}$ and $R^{22}$ are independently a hydrogen atom or $C_{1-4}$ alkyl; p is 0 or 1; q is an integer of 1 to 4; r is 0 or 1; p, q, and r satisfy $2 \leq p+q+r \leq 4$; $R_{21}$ may be the same or different and $R_{22}$ may be the same or different when q is 2 or more; $Ar^{21}$ is an (s+1) valent group derived by removing (s+1) hydrogen atoms from substituted or unsubstituted arene; $R^{23}$ is a fluorine atom, a $C_1$ or $C_2$ alkyl having a fluorine atom as a substituent, or a methoxy group having a fluorine atom as a substituent; s is the number of $R^{23}$s directly bonded to $Ar^{21}$ and is an integer of 1 to 5; and $R^{23}$s may be the same or different when s is 2 or more, (3)

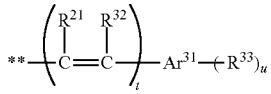

where ** is a bonding position of the substituent bonded to $Ar^2$ or $Ar^3$; $R^{31}$ and $R^{32}$ are independently a hydrogen atom or $C_{1-4}$ alkyl; t is an integer of 1 to 3; $R^{31}$ may be the same or different and $R^{32}$ may be the same or different when t is 2 or more; $Ar^{31}$ is a (u+1) valent group derived by removing (u+1) hydrogen atoms from substituted or unsubstituted arene; $R^{33}$ is a fluorine atom, $C_{1-4}$ alkyl having a fluorine atom as a substituent, or $C_{1-3}$ alkoxy having a fluorine atom as a substituent; u is the number of $R^{33}$s directly bonded to $Ar^{31}$ and is an integer of 1 to 5; and $R^{33}$s may be the same or different when u is 2 or more.

16. A process cartridge integrally supporting an electrophotographic photosensitive member and at least one of charging unit, a developing unit and a cleaning unit, and being attachable to and detachable from a main body of an electrophotographic apparatus, the electrophotographic photosensitive member comprising a support member bearing a photosensitive layer, said electrophotographic photosensitive member having a surface layer comprising a polymerization product of a hole transporting compound represented by Formula (1)

(1)

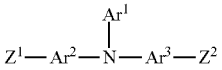

where $Ar^1$ is a substituted or unsubstituted aryl group; $Ar^2$ and $Ar^3$ are independently a substituted or unsubstituted arylene group; $Ar^1$ to $Ar^3$ do not have a fluorine atom; substituents of the aryl group or arylene groups of $Ar^1$ to $Ar^3$ are selected from the group consisting of $C_{1-6}$ alkyl, $C_{1-6}$ alkoxy, and a monovalent group having a polymerizable functional group, and at least one of the aryl group or arylene groups of $Ar^1$ to $Ar^3$ has the monovalent group having the polymerizable functional group; $Z^1$ is a monovalent group represented by Formula (2) or a monovalent group represented by Formula (3); $Z^2$ is a hydrogen atom, a monovalent group represented by Formula (2), or a monovalent group represented by Formula (3); and when $Z^1$ and $Z^2$ are the monovalent groups represented by Formula (2)or when $Z^1$ and $Z^2$ are the monovalent groups represented by Formula (3), $Z^1$ and $Z^2$ may be the same or different from each other, (2)

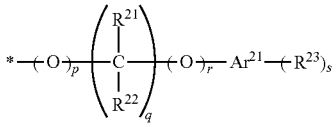

where * is a bonding position of the substituent bonded to $Ar^2$ or $Ar^3$; $R^{21}$ and $R^{22}$ are independently a hydrogen atom or $C_{1-4}$ alkyl; p is 0 or 1; q is an integer of 1 to 4; r is 0 or 1; p, q, and r satisfy $2 \leq p+q+r \leq 4$; $R_{21}$ may be the same or different and $R_{22}$ may be the same or different when q is 2 or more; $Ar^{21}$ is an (s+1) valent group derived by removing (s+1) hydrogen atoms from substituted or unsubstituted arene; $R^{23}$ is a fluorine atom, a $C_1$ or $C_2$ alkyl having a fluorine atom as a substituent, or a methoxy group having a fluorine atom as a substituent; s is the number of $R^{23}$s directly bonded to $Ar^{21}$ and is an integer of 1 to 5; and $R^{23}$s may be the same or different when s is 2 or more, (3)

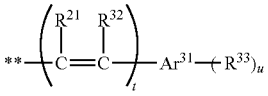

where ** is a bonding position of the substituent bonded to $Ar^2$ or $Ar^3$; $R^{31}$ and $R^{32}$ are independently a hydrogen atom or $C_{1-4}$ alkyl; t is an integer of 1 to 3; $R^{31}$ may be the same or different and $R^{32}$ may be the same or different when t is 2 or more; $Ar^{31}$ is a (u+1) valent group derived by removing (u+1) hydrogen atoms from substituted or unsubstituted arene; $R^{33}$ is a fluorine atom, $C_{1-4}$ alkyl having a fluorine atom as a substituent, or $C_{1-3}$ alkoxy having a fluorine atom as a substituent; u is the number of $R^{33}$s directly bonded to $Ar^{31}$ and is an integer of 1 to 5; and $R^{33}$s may be the same or different when u is 2 or more.

17. A manufacturing method of an electrophotographic photosensitive member having a support member bearing a photosensitive layer, said electrophotographic photosensitive member having a surface layer comprising a polymerization product of a hole transporting compound, the manufacturing method comprising the steps of:

providing said support member bearing said photosensitive layer;

forming thereon a coating film of a surface layer coating solution comprising a hole transporting compound represented by Formula (1); and forming said surface layer by polymerizing the hole transporting compound represented by Formula (1) in the coating film (1)

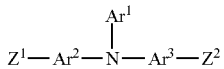

where $Ar^1$ is a substituted or unsubstituted aryl group; $Ar^2$ and $Ar^3$ are independently a substituted or unsubstituted arylene group; $Ar^1$ to $Ar^3$ do not have a fluorine atom; substituents of the aryl group or arylene groups of $Ar^1$ to $Ar^3$ are selected from the group consisting of $C_{1-6}$ alkyl, $C_{1-6}$ alkoxy, and a monovalent group having a polymerizable functional group, and at least one of the aryl group or arylene groups of $Ar^1$ to $Ar^3$ has the monovalent group having the polymerizable functional group; $Z^1$ is a monovalent group represented by Formula (2) or a monovalent group represented by Formula (3); $Z^2$ is a hydrogen atom, a monovalent group represented by Formula (2), or a monovalent group represented by Formula (3); and when $Z^1$ and $Z^2$ are the monovalent groups represented by Formula (2)or when $Z^1$ and $Z^2$ are the monovalent groups represented by Formula (3), $Z^1$ and $Z^2$ may be the same or different from each other, (2)

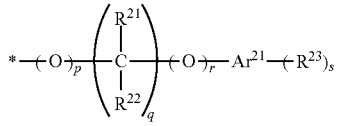

where * is a bonding position of the substituent bonded to $Ar^2$ or $Ar^3$; $R^{21}$ and $R^{22}$ are independently a hydrogen atom or $C_{1-4}$ alkyl; p is 0 or 1; q is an integer of 1 to 4; r is 0 or 1; p, q, and r satisfy $2 \leq p+q+r \leq 4$; $R_{21}$ may be the same or different and $R_{22}$ may be the same or different when q is 2 or more; $Ar^{21}$ is an (s+1) valent group derived by removing (s+1) hydrogen atoms from substituted or unsubstituted arene; $R^{23}$ is a fluorine atom, a $C_1$ or $C_2$ alkyl having a fluorine atom as a substituent, or a methoxy group having a fluorine atom as a substituent; s is the number of $R_{23}$s directly bonded to $Ar^{21}$ and is an integer of 1 to 5; and $R^{23}$s may be the same or different when s is 2 or more, (3)

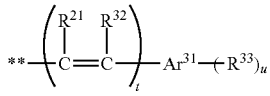

where ** is a bonding position of the substituent bonded to $Ar^2$ or $Ar^3$; $R^{31}$ $R^{32}$ are independently a hydrogen atom or $C_{1-4}$ alkyl; t is an integer of 1 to 3; $R^{31}$ may be the same or different and $R^{32}$ may be the same or different when t is 2 or more; $Ar^{31}$ is a (u+1) valent group derived by removing (u+1) hydrogen atoms from substituted or unsubstituted arene; $R^{33}$ is a fluorine atom, $C_{1-4}$ alkyl having a fluorine atom as a substituent, or $C_{1-3}$ alkoxy having a fluorine atom as a substituent; u is the number of $R^{33}$s directly bonded to $Ar^{31}$ and is an integer of 1 to 5; and $R^{33}$s may be the same or different when u is 2 or more.

* * * * *